US012163715B2

(12) United States Patent
Kim et al.

(10) Patent No.: US 12,163,715 B2
(45) Date of Patent: Dec. 10, 2024

(54) ICE MAKER AND REFRIGERATOR

(71) Applicant: LG ELECTRONICS INC., Seoul (KR)

(72) Inventors: Yonghyun Kim, Seoul (KR); Jinil Hong, Seoul (KR); Hyunji Park, Seoul (KR); Seungjin Choi, Seoul (KR); Seunggeun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/224,356

(22) Filed: Jul. 20, 2023

(65) Prior Publication Data

US 2023/0358457 A1 Nov. 9, 2023

Related U.S. Application Data

(63) Continuation of application No. 17/701,609, filed on Mar. 22, 2022, now Pat. No. 11,740,000, which is a (Continued)

(30) Foreign Application Priority Data

Nov. 16, 2018 (KR) ..... 10-2018-0142122
Mar. 22, 2019 (KR) ..... 10-2019-0033192

(51) Int. Cl.
*F25C 1/10* (2006.01)
*F25C 5/04* (2006.01)
*F25C 5/182* (2018.01)

(52) U.S. Cl.
CPC ..... *F25C 1/10* (2013.01); *F25C 5/04* (2013.01); *F25C 5/182* (2013.01); *F25C 2305/0221* (2021.08); *F25C 2400/10* (2013.01)

(58) Field of Classification Search
CPC ..... F25C 1/10; F25C 5/182; F25C 2400/10; F25C 1/243
See application file for complete search history.

(56) References Cited

U.S. PATENT DOCUMENTS

2006/0086134 A1 4/2006 Voglewede et al.
2013/0014535 A1* 1/2013 Son ..... F25C 1/10 62/340

(Continued)

FOREIGN PATENT DOCUMENTS

EP 2549207 1/2013
EP 2578969 4/2013

(Continued)

OTHER PUBLICATIONS

Extended European Search Report in European Appln. No. 19209301.1, dated Apr. 8, 2020, 10 pages.

(Continued)

*Primary Examiner* — Elizabeth J Martin
(74) *Attorney, Agent, or Firm* — Fish & Richardson P.C.

(57) ABSTRACT

An ice maker includes an upper assembly provided with an upper tray which has an upper chamber recessed upwardly to define an upper side of an ice chamber in which water is filled to generate ice, a lower assembly provided with a lower tray which has a lower chamber recessed downwardly to define a lower side of the ice chamber, and a lower supporter which supports a lower side of the lower tray, in which the lower assembly is rotatably connected to the upper assembly. The ice maker also includes an upper ejector provided with an upper ejecting pin which separates ice from the upper tray after ice-making is completed, in which the upper ejector is connected to the lower assembly to be interlocked with each other, such that when the lower assembly is rotated, the upper ejector is lifted and lowered.

20 Claims, 52 Drawing Sheets

Related U.S. Application Data continuation of application No. 16/685,656, filed on Nov. 15, 2019, now Pat. No. 11,313,603.

(56) References Cited

U.S. PATENT DOCUMENTS

| | | | | |
|---|---|---|---|---|
| 2013/0014536 | A1* | 1/2013 | Son | F25C 1/25 62/351 |
| 2013/0081412 | A1 | 4/2013 | Son et al. | |
| 2022/0228786 | A1 | 7/2022 | Kim et al. | |

FOREIGN PATENT DOCUMENTS

| | | | |
|---|---|---|---|
| KR | 10-2010-0138108 | A | 12/2010 |
| KR | 10-2013-0009521 | A | 1/2013 |
| KR | 101850918 | | 5/2018 |

OTHER PUBLICATIONS

Office Action in Korean Appln. No. 10-2019-0033192, mailed on Jan. 17, 2024, 12 pages (with English translation).
Notice of Allowance in Korean Appln. No. 10-2018-0142122, mailed on May 2, 2024, 10 pages (with English translation).
Notice of Allowance in Korean Appln. No. 10-2019-0033192, mailed on Aug. 26, 2024, 9 pages (with English translation).

* cited by examiner

ICE MAKER AND REFRIGERATOR

CROSS-REFERENCE TO RELATED APPLICATIONS

This application is a continuation of U.S. application Ser. No. 17/701,609, filed on Mar. 22, 2022, which is a continuation of U.S. application Ser. No. 16/685,656, filed on Nov. 15, 2019, which claims priority under 35 U.S.C. 119 and 35 U.S.C. 365 to Korean Patent Application No. 10-2018-0142122, filed on Nov. 16, 2018, and Korean Patent Application No. 10-2019-0033192, filed on Mar. 22, 2019, the entire contents of which are hereby incorporated by reference in their entirety.

BACKGROUND

The present disclosure relates to an ice maker and a refrigerator.

In general, refrigerators are home appliances for storing foods at a low temperature in a storage space that is covered by a door.

The refrigerator may cool the inside of the storage space by using cold air to store the stored food in a refrigerated or frozen state.

Generally, an ice maker for making ice is provided in the refrigerator.

The ice maker is constructed so that water supplied from a water supply source or a water tank is received in a tray to make ice.

Also, the ice maker is constructed to separate the made ice from the ice tray in a heating manner or twisting manner.

As described above, the ice maker through which water is automatically supplied and the ice is automatically separated may be opened upward so that the molded ice is pumped up.

Ice made in the ice maker of such a structure has at least one surface flat surface, such as a crescent shape or cubic shape.

When the ice has a spherical shape, it is more convenient to use the ice, and also, it is possible to provide a different feeling of use to a user. Also, even when the made ice is stored, a contact area between the ice cubes may be minimized to minimize the sticking of the ice cubes.

Korean Patent No. 10-1850918 as the Related Art document discloses an ice maker.

The ice maker of the Related Art document includes an upper tray in which a plurality of upper cells of a hemispherical shape are arranged and a pair of link guides extending upwardly from both sides are disposed, a lower tray in which a plurality of lower cells of a hemispherical shape are arranged and which is pivotally connected to the upper tray, and an ice-removal heater to heat the upper tray, a rotation shaft which is connected to rear ends of the lower tray and the upper tray and which allows the lower tray to be rotated with respect to the upper tray, a pair of links having an end which is connected to the lower tray and the other end which is connected to the link guide portion, and an upper ejecting pin assembly which is connected to the pair of links, respectively, with both ends fitted to the link guide portion and is lifted and lowered together with the link.

The upper ejecting pin assembly is lifted and lowered to separate the ice of the upper tray. Thus, the upper ejecting pin assembly needs to be lifted and lowered in the vertical direction.

In addition, the lower tray is rotated to one side for the ice-separation, and then to the other side again for ice-making. In this process, when the upper tray and the lower tray are not completely coupled to each other, there is a problem that a leak occurs in the gap, or the production of spherical ice becomes difficult.

In addition, in a case of the prior document, it includes a lower ejecting pin assembly fixed to press the lower tray when the lower tray rotates.

By the lower ejecting pin assembly, when the lower tray is pressed, the ice of the lower tray is separated from the lower tray.

At this time, as the load applied to the lower ejecting pin assembly increases, there is a possibility that the deformation of the lower ejecting pin assembly occurs.

In addition, there may be problems that, due to the tolerance of the motor gear, while the lower tray does not reach the maximum ice-separation position or the lower ejecting pin assembly does not fully press the center of the lower tray, all ice is not separated from the lower tray.

In addition, while a plurality of ice is separated at the same time, there is also a problem that the load applied to the motor to rotate the lower tray increases.

In addition, there may be a problem that the upper ejecting pin is not inserted into the air hole of the upper tray while the upper ejecting pin assembly flows in the left and right direction or the front and rear direction.

SUMMARY

According to the present disclosure, there is provided an ice maker and a refrigerator including the same in which, after the lower tray is rotated to a side of the upper tray for ice-making, in a state where the operation of the motor is stopped, while the lower tray is further rotated to a side of the upper tray, the upper tray and the lower tray are more securely coupled to each other.

In addition, there is provided an ice maker and a refrigerator including the same which, in the ice-making process, can maintain a state where the upper tray and the lower tray is securely coupled to each other.

In addition, there is provided an ice maker and a refrigerator including the same which, when rotating the lower assembly, the upper ejector can be lifted and lowered in the vertical direction while being stably supported.

In addition, there is provided an ice maker and a refrigerator including the same in which plastic deformation of the upper tray is prevented despite repeated ice formation.

In addition, in the present disclosure, there is provided an ice maker and a refrigerator including the same in which the deformation of the upper case and the lower case which are fixed to the upper tray is minimized.

In addition, in the present disclosure, there is provided an ice maker and a refrigerator including the same in which the phenomenon of stretching the horizontal extension portion which extends from the upper tray body is prevented.

In the present disclosure, there is provided an ice maker and a refrigerator including the same in which while the lower ejecting pin can be in line contact or surface contact with a spherical lower chamber and the contact area therebetween increases, the pressing force can be properly transmitted.

In addition, in the present disclosure, there is provided an ice maker and a refrigerator including the same in which the lower ejecting pin is extended so that the pressing force can be properly transmitted to the center of the spherical lower chamber, and even if the lower assembly does not reach the maximum ice-separation position by the tolerance of the motor gear, a sufficient pressing force is transmitted to the lower chamber.

In addition, in the present disclosure, there is provided an ice maker and a refrigerator including the same which can solve the problem of breaking the ice while the pressing force is concentrated on the ice during the ice-separation.

In addition, in the present disclosure, there is provided an ice maker and a refrigerator including the same in which, when the upper ejector is moved in the vertical direction for the ice-separation, the generation of flow of the upper ejector in the left and right direction or the front and rear direction is prevented and thus the upper ejecting pin is smoothly inserted into an inlet opening of the upper tray.

In addition, in the present disclosure, there is provided an ice maker and a refrigerator including the same which is prevented from decreasing the vertical movable distance by the vertical guide for the stable vertical movement of the upper ejector.

The ice maker of the present disclosure may include an upper assembly having an upper tray defining a hemispherical upper chamber, and a lower assembly having a lower tray defining a hemispherical lower chamber.

The ice maker may be fixed to the housing provided in the freezing chamber of the refrigerator.

The upper assembly may be fixed to the housing, and the lower assembly may be rotatably connected to the upper assembly. The upper assembly may further include an upper supporter which contacts the first surface of the upper tray and supports the first surface.

In addition, the upper assembly may further include an upper case which is in contact with the second surface of the upper tray and coupled to the upper supporter.

The upper tray may include an upper tray body forming the upper chamber and a horizontal extension portion extending in a horizontal direction from the upper tray body.

The horizontal extension portion may be located between a portion of the upper supporter and a portion of the upper case.

The first surface may be an upper surface of the horizontal extension portion, and the second surface may be a lower surface of the horizontal extension portion.

In addition, the ice maker, after completion of ice-making, may further include an upper ejector which includes an upper ejector pin for separating the ice from the top tray.

In addition, the upper ejector is connected to the lower assembly to be interlocked with each other, and, when the lower assembly is rotated, the upper ejector may be lifted and lowered.

In addition, the ice maker may further include a connection unit which includes a plurality of links and thus connects the upper ejector and the lower assembly to each other, and a driving unit which provides rotational power to the lower assembly.

In addition, the connection unit may include a first link for rotating the lower supporter while receiving the power of the drive unit and rotating.

In addition, the connection unit may include a second link connecting the lower supporter and the upper ejector and transmitting the rotational force of the lower supporter to the upper ejector when the lower supporter is rotated.

In addition, the ice maker may further include an elastic member which connects the first link and the lower supporter to each other and provides a tensile force between the first link and the lower supporter.

In addition, the upper ejector may include an ejector body formed in a horizontal direction and a plurality of upper ejecting pins extending from the lower side of the ejector body in a vertical direction.

In addition, while the drive unit is operating, when the shaft connection portion rotates, the lower assembly rotates to the first position while rotating upwards, and when the drive unit is stopped, by the tension force of the elastic member, the lower assembly may rotate to a second position higher than the first position.

In addition, the upper supporter may include a plurality of unit guides for guiding the vertical movement of the upper ejector.

In addition, each unit guide may be provided with a guide slot through which the upper ejector penetrates and which guides the vertical movement of the upper ejector.

The ice maker of the present disclosure may include an upper assembly having an upper tray having a hemispherical upper chamber, and a lower assembly having a lower tray having a hemispherical lower chamber.

In addition, the upper assembly may include an upper tray having an upper chamber recessed upwardly to define an upper side of the ice chamber in which water is filled to generate ice, an upper supporter which is in contact with the first surface of the upper tray and thus supports the first surface, and an upper case which is in contact with the second surface of the upper tray and coupled to the upper supporter.

In addition, the lower assembly may further include a lower tray having a lower chamber recessed downwardly to define a lower side of the ice chamber, a lower supporter supporting a lower side of the lower tray, and a lower case in which a least a portion thereof covers the upper side of the lower tray, and the lower assembly can be rotatably connected to the upper assembly.

In addition, after the completion of the ice-making, the ice maker may include an ejector having an ejecting pin for separating the ice from the ice chamber.

Spherical ice may be generated by the upper chamber and the lower chamber, and the generated ice may be separated from the upper chamber and the lower chamber by the rotation of the lower assembly.

In addition, the ejector may also include an upper ejector having an upper ejecting pin for separating ice from the upper tray and a lower ejector having a lower ejecting pin for separating ice from the lower tray.

In addition, the upper ejector may include an upper ejector body formed in a horizontal direction and the upper ejecting pin formed to extend from the lower side of the ejector body in the vertical direction, and both ends of the ejector body may include a separation prevention protrusion in which both sides thereof protrudes in a direction intersecting the ejector body and an upper and lower guide protruding in the same direction as the upper ejecting pin.

In addition, the upper and lower guide may be inclined in a direction toward the separation prevention protrusion from the center of the ejector body.

In addition, the upper case may include an interference prevention groove into which the upper and lower guide is inserted.

In addition, the interference prevention groove may be formed symmetrically in the center of the upper case.

In addition, the upper case may include one or more ribs formed adjacent to the interference prevention groove in at least one of the upper direction and the lower direction.

In addition, the lower ejector may include a lower ejector body and a plurality of lower ejecting pins protruding from the lower ejector body.

In addition, the lower ejecting pin may include a pin body protruding from the lower ejector body and a pressing portion extending from the pin body.

In addition, the pin body may be formed in a curved shape. In addition, the pressing portion may be formed with a recessed groove portion in the end portion which is in contact with the lower tray.

In addition, the pressing portion may include a pressing inclined portion in contact with the lower tray.

In addition, the pin body and the pressing portion may be bent to form a constant angle.

A refrigerator according to another aspect may include a cabinet provided with a freezing chamber; a housing provided in the freezing chamber; and an ice maker installed in the housing. The ice maker may include an ejector having an ejecting pin for separating the ice from the ice chamber after the ice-making is completed.

According to the proposed invention, there are advantages that, for the ice-making, after the lower tray is rotated to a side of the upper tray, in a state where the operation of the motor is stopped, while the lower tray is further rotated to a side of the upper tray, the upper tray and the lower tray are more reliably coupled to each other.

In addition, in the ice-making process, there is an advantage that the upper tray and the lower tray can be securely maintained in a coupled state.

In addition, since the unit guide for guiding the upper ejector is provided in the upper supporter, the transfer force of the upper ejector to the upper case can be minimized, and thus deformation of the upper case can be prevented.

In addition, there is an advantage that, when rotating the lower assembly, while the upper ejector is securely supported, the upper ejector can be lifted and lowered in the vertical direction.

In addition, since ice is produced in the upper tray and the upper tray is fixed by the upper case and the upper supporter, deformation of the upper case and the upper supporter other than the upper tray can be minimized, and the structure of the upper tray, the upper case, and the upper supporter can be simplified.

In addition, as the upper tray is formed of a silicone material, plastic deformation of the upper tray can be prevented despite repeated ice formation.

In addition, the upper tray may include an upper tray body forming an upper chamber, and a horizontal extension portion extending from the upper tray body, and since the horizontal extension portion is fixed to the upper supporter and the upper case, deformation of the horizontal extension portion can be minimized.

In addition, since the upper protrusion and the lower protrusion is provided in the horizontal extension portion and the upper protrusion and the lower protrusion are received in the slots of the upper case and the upper supporter, respectively, it is possible to prevent plastic deformation of the horizontal extension portion.

In addition, since an inlet wall is formed around the inlet opening of the upper tray body and the inlet wall is connected to the upper tray body by the connection ribs, the deformation of the inlet wall can be prevented.

Since the upper case is fixed to the housing and a water-supply portion is coupled to the upper case, when the deformation of the upper case is prevented, a state where the upper case is fixed to the housing can be stably maintained, and a state where the water-supply portion is coupled to the upper case can be stably maintained.

According to the proposed invention, since the upper end portion of the lower ejecting pin is formed to protrude more than the lower end portion, there is an advantage that the upper end portion of the lower ejecting pin can be in line contact or surface contact with the spherical lower chamber and as the contact area increases, the pressing force can be properly transmitted.

In addition, there are advantages that the length of the lower ejecting pin is extended so that the pressing force can be properly transmitted to the center of the spherical lower chamber, and a sufficient pressing force is transmitted to the lower chamber even if the lower assembly does not reach the maximum ice-separation position by tolerance of motor gear.

In addition, there is an advantage that, when separating ice, although the pressing force is concentrated on the ice, the problem of breaking the ice can be solved.

In addition, as the length of the upper and lower guide provided in the upper ejector extends, when the upper ejector moves in the vertical direction for the ice-separation, there are advantages that the flow generation of the upper ejector in the left and right direction and the front and rear direction is prevented and the upper ejector pin is smoothly inserted into the inlet opening of the upper tray.

In addition, by including an interference prevention groove corresponding to the upper and lower guide provided in the upper ejector, it is possible to prevent the vertical movement distance of the upper ejector from being reduced.

DETAILED DESCRIPTION OF THE EMBODIMENTS

Figure 1:
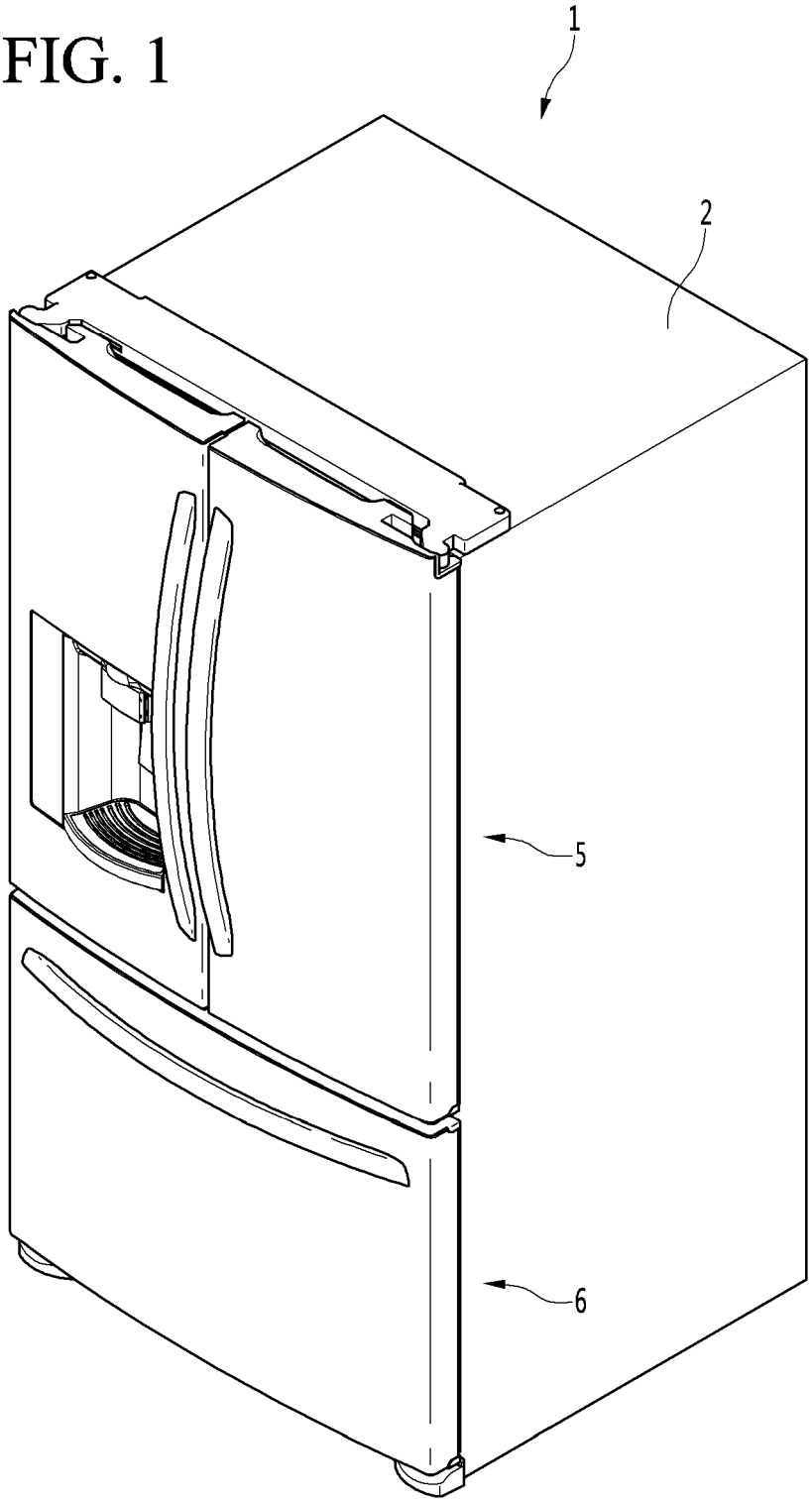
FIG. 1 is a perspective view of a refrigerator according to one embodiment of the present disclosure.

Hereinafter, some embodiments of the present disclosure will be described in detail with reference to the accompanying drawings. In adding reference numerals to the components of each drawing, it should be noted that the same reference numerals are assigned to the same components as much as possible even though they are illustrated in different drawings. In addition, in describing the embodiments of the present disclosure, when it is determined that the detailed description of the related well-known configuration or function interferes with the understanding of the embodiments of the present disclosure, the detailed description thereof will be omitted.

In addition, in describing the components of the embodiments of the present disclosure, terms such as first, second, A, B, (a), and (b) may be used. These terms are only to distinguish the components from other components, and the nature, order, or the like of the components are not limited by the terms. If a component is described as being "joined", "coupled" or "connected" to another component, that component may be directly joined, connected to that other component, but it is to be understood that another component may be "joined", "coupled" or "connected" between each component.

Figure 2:
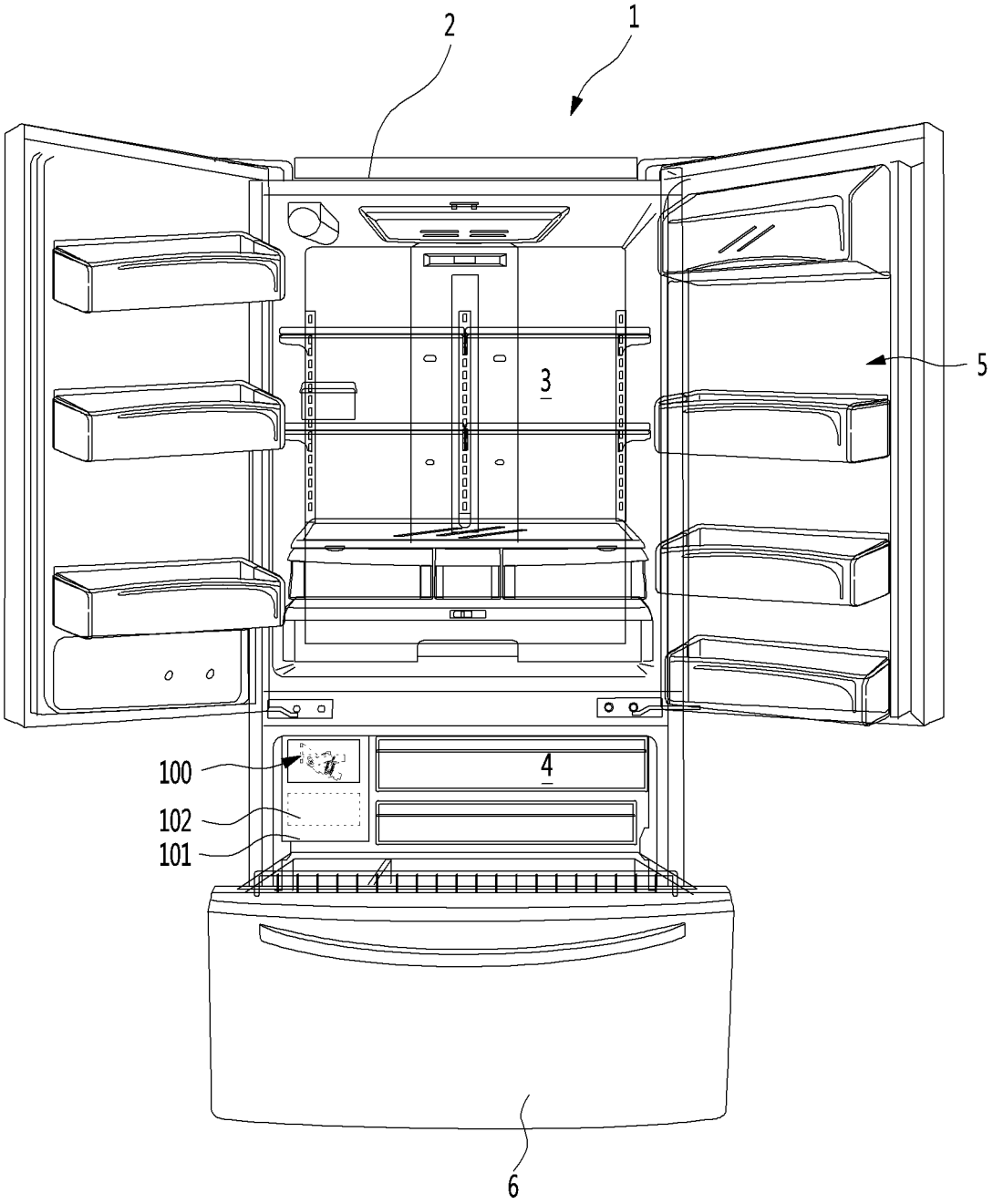
FIG. 2 is a view illustrating a state where a door of the refrigerator of FIG. 1 is opened.

FIG. 1 is a perspective view of a refrigerator according to one embodiment of the present disclosure, and FIG. 2 is a view illustrating a state where a door of the refrigerator of FIG. 1 is opened.

Referring to FIGS. 1 and 2, a refrigerator 1 according to an embodiment may include a cabinet 2 defining a storage space and a door that opens and closes the storage space.

In detail, the cabinet 2 may define the storage space that is vertically divided by a barrier. Here, a refrigerating compartment 3 may be defined at an upper side, and a freezing compartment 4 may be defined at a lower side.

Receiving members such as a drawer, a shelf, a basket, and the like may be provided in the refrigerating chamber 3 and the freezing chamber 4.

The door may include a refrigerating chamber door 5 opening/closing the refrigerating chamber 3 and a freezing chamber door 6 opening/closing the freezing chamber 4.

The refrigerating chamber door 5 may be constituted by a pair of left and right doors and be opened and closed through rotation thereof. In addition, the freezing chamber door 6 may be inserted and withdrawn in a drawer manner.

Alternatively, the arrangement of the refrigerating chamber 3 and the freezing chamber 4 and the shape of the door may be changed according to kinds of refrigerators, but are not limited thereto. For example, the embodiments may be applied to various kinds of refrigerators. For example, the freezing chamber 4 and the refrigerating chamber 3 may be disposed at left and right sides, or the freezing chamber 4 may be disposed above the refrigerating chamber 3.

An ice maker 100 may be provided in the freezing chamber 4. The ice maker 100 is constructed to make ice by using supplied water. Here, the ice may have a spherical shape.

In addition, an ice bin 102 in which the made ice is stored after being separated from the ice maker 100 may be further provided below the ice maker 100.

The ice maker 100 and the ice bin 102 may be mounted in the freezing chamber 4 in a state of being respectively received in separate housings 101.

A user may open the refrigerating chamber door 6 to approach the ice bin 102, thereby obtaining the ice.

For another example, a dispenser 7 for dispensing purified water or the made ice to the outside may be provided in the refrigerating chamber door 5.

Also, the ice made in the ice maker 100 or the ice stored in the ice bin 102 after being made in the ice maker 100 may be transferred to the dispenser 7 by a transfer unit. Thus, the user may obtain the ice from the dispenser 7.

Hereinafter, the ice maker will be described in detail with reference to the accompanying drawings.

Figure 3A:
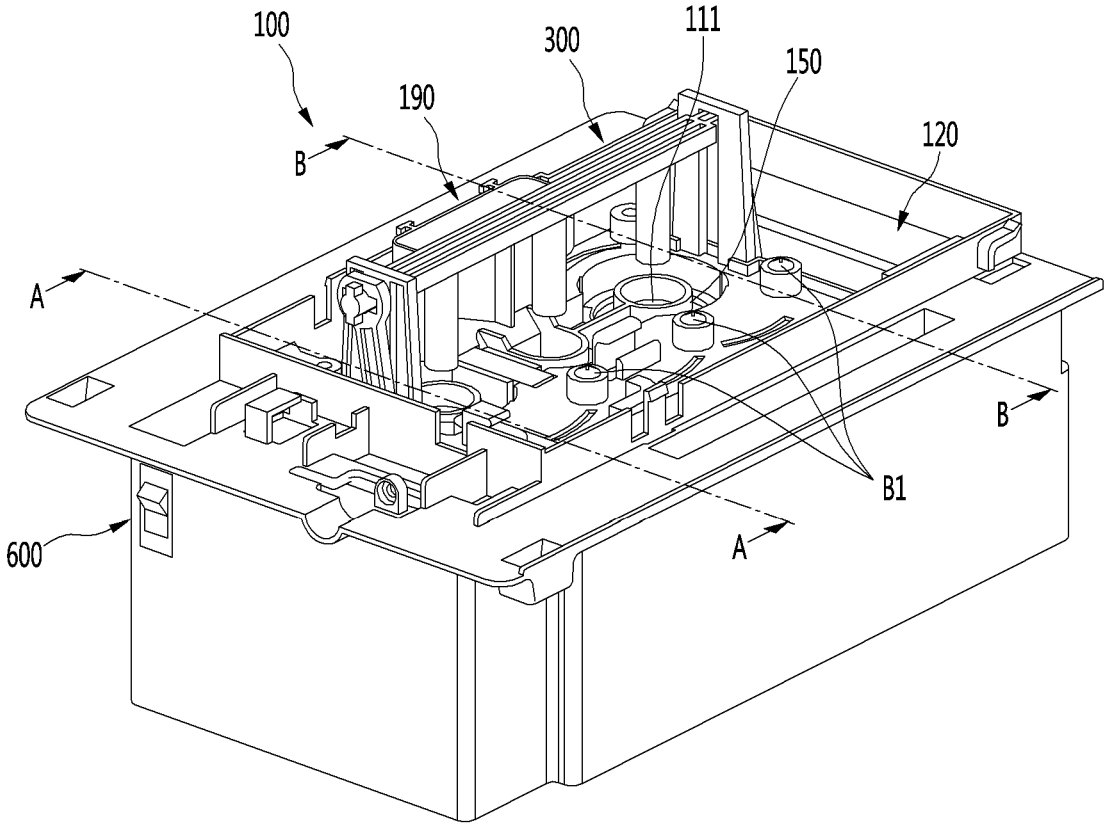
FIGS. 3A and 3B are perspective views illustrating an ice maker according to an embodiment of the present disclosure.
Figure 3B:
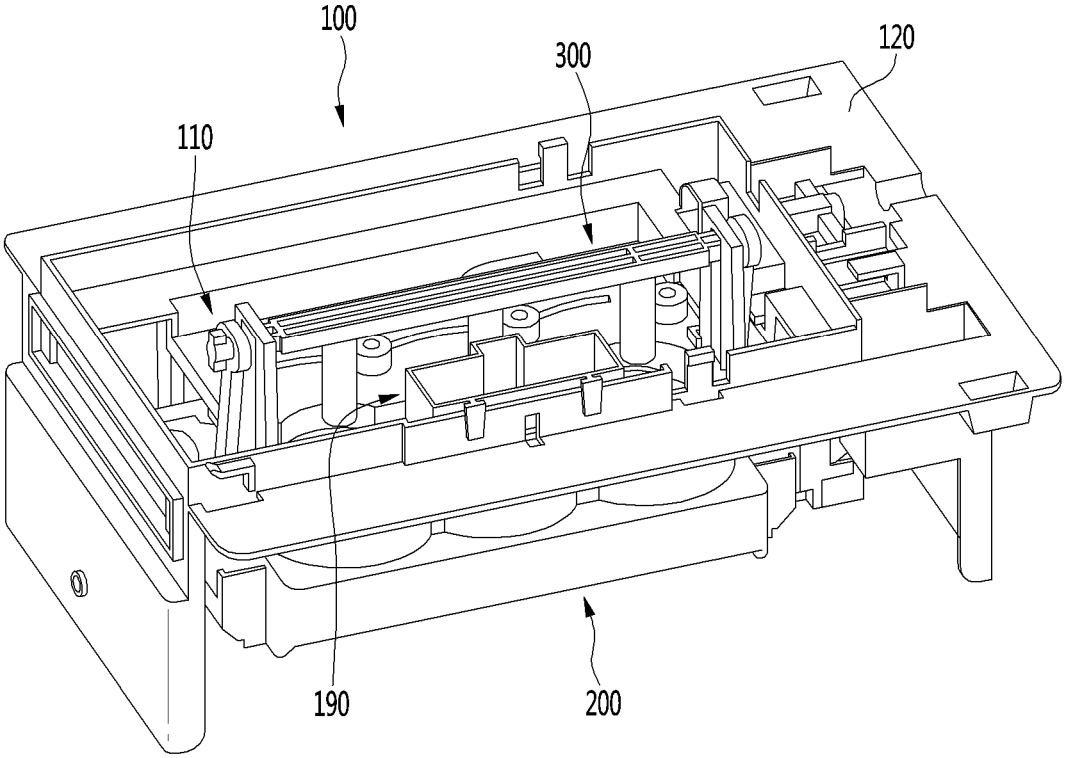
Figure 4:
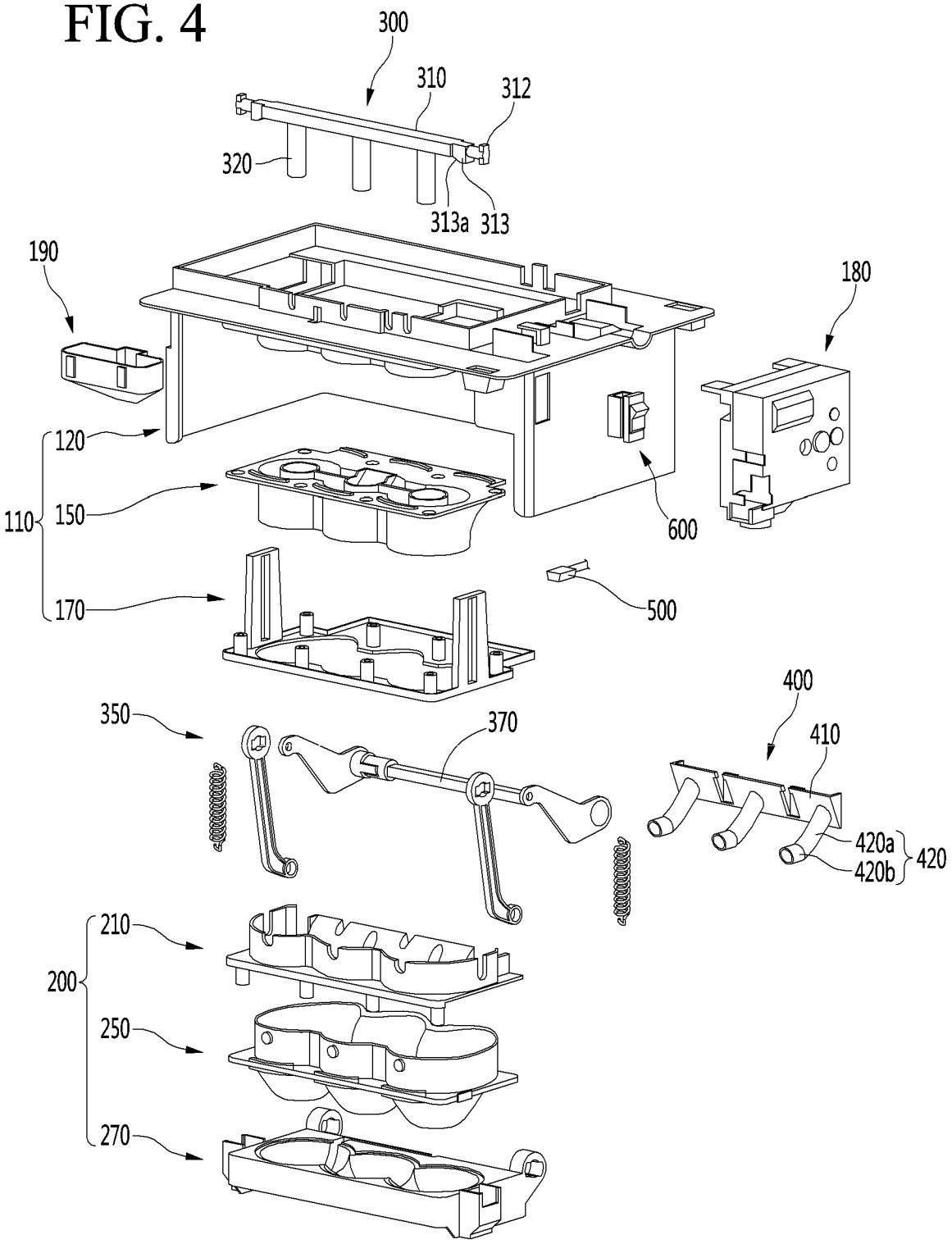
FIG. 4 is an exploded perspective view illustrating an ice maker according to an embodiment of the present disclosure.

FIGS. 3*a* and 3*b* are perspective views illustrating an ice maker according to an embodiment of the present disclosure, and FIG. 4 is an exploded perspective view illustrating an ice maker according to an embodiment of the present disclosure.

Referring to FIGS. 3*a* to 4, the ice maker 100 may include an upper assembly 110 and a lower assembly 200.

The lower assembly 200 may rotate with respect to the upper assembly 110. For example, the lower assembly 200 may be connected to be rotatable with respect to the upper assembly 110.

In a state where the lower assembly 200 contacts the upper assembly 110, the lower assembly 200 together with the upper assembly 110 may make spherical ice.

In other words, the upper assembly 110 and the lower assembly 200 may define an ice chamber 111 for making the spherical ice. The ice chamber 111 may have a chamber having a substantially spherical shape.

The upper assembly 110 and the lower assembly 200 may define a plurality of ice chambers 111.

Hereinafter, a structure in which three ice chambers are defined by the upper assembly 110 and the lower assembly 200 will be described as an example, and also, the embodiments are not limited to the number of ice chambers 111.

In the state where the ice chamber 111 is defined by the upper assembly 110 and the lower assembly 200, water is supplied to the ice chamber 111 through a water supply portion 190.

The water supply portion 190 is coupled to the upper assembly 110 to guide water supplied from the outside to the ice chamber 111.

After the ice is made, the lower assembly 200 may rotate in a forward direction. Thus, the spherical ice made between the upper assembly 110 and the lower assembly 200 may be separated from the upper assembly 110 and the lower assembly 200.

The ice maker 100 may further include a driving unit 180 so that the lower assembly 200 is rotatable with respect to the upper assembly 110.

The driving unit 180 may include a driving motor and a power transmission portion for transmitting power of the driving motor to the lower assembly 200. The power transmission portion may include one or more gears.

The driving motor may be a bi-directional rotatable motor. Thus, the lower assembly 200 may rotate in both directions.

The ice maker 100 may further include an upper ejector 300 so that the ice is capable of being separated from the upper assembly 110.

When the upper ejector 300 is connected to the lower assembly 200 so as to be interlocked with the lower assembly and thus the lower assembly 200 rotates, the upper ejector 300 can be lifted and lowered.

For example, after the ice-making completion, if the lower assembly 200 is rotated downward to be spaced apart from the upper assembly 110, the upper ejector 300 can be lowered.

In addition, after the ice-separation completion, when the lower assembly 200 is rotated upward to be coupled with the upper assembly 110 for water-supply, the upper ejector 300 may be lifted.

At the time of the ice-separation, when the upper ejector 300 is lowered, the ice that is in close contact with the upper assembly 110 may be separated from the upper assembly 110.

The upper ejector 300 may include an upper ejector body 310 and a plurality of upper ejecting pins 320 extending in a direction intersecting the upper ejector body 310.

For example, the ejector body 310 may be formed in a horizontal direction, and the upper ejecting pin 320 may be formed to extend in a vertical direction from the lower side of the ejector body 130.

A plurality of grooves may be formed in the ejector body 310 along the longitudinal direction. A plurality of reinforcing ribs 311 may be formed in the groove. The reinforcing rib 311 may be formed in parallel to the longitudinal direction of the ejector body 310. In addition, the reinforcing rib 311 may be formed in a direction intersecting the longitudinal direction of the ejector body 310.

In addition, the upper ejecting pin 320 may be formed with a hollow 321. Thus, the strength of the upper ejecting pin 320 can be improved.

In addition, for the ice-separation, when the lower end of the upper ejecting pin 320 presses the spherical upper tray 150, that is, an upper side of the ice chamber 111, the stable contact is possible by the hollow 321.

The upper ejecting pins 320 may be provided in the same number of ice chambers 111.

A separation prevention protrusion 312 for preventing a connection unit 350 from being separated in the state of being coupled to the connection unit 350 that will be described later may be provided on each of both ends of the ejector body 310. For example, the pair of separation prevention protrusions 312 may protrude in opposite directions from the ejector body 310.

In detail, both ends of the ejector body 310 may be formed with a separation prevention protrusion 312 in which both sides thereof protrude in a direction intersecting the ejector body 310.

The separation prevention protrusion 312 may include a circular central portion 312*a* and a pair of protrusion portions 312*b* protruding in the radial direction of the central portion 312*a* from both sides of the central portion 312*a*.

While the upper ejecting pin 320 passing through the upper assembly 110 and inserted into the ice chamber 111, the ice within the ice chamber 111 may be pressed.

The ice pressed by the upper ejecting pin 320 may be separated from the upper assembly 110.

Also, the ice maker 100 may further include a lower ejector 400 so that the ice closely attached to the lower assembly 200 is capable of being separated.

The lower ejector 400 may press the lower assembly 200 to separate the ice closely attached to the lower assembly 200 from the lower assembly 200. For example, the lower ejector 400 may be fixed to the upper assembly 110.

The lower ejector 400 may include a lower ejector body 410 and a plurality of lower ejecting pins 420 protruding from the lower ejector body 410. The lower ejecting pins 420 may be provided in the same number of ice chambers 111.

In addition, the lower ejecting pin 420 may include a pin body 420*a* protruding from the lower ejector body 410 and a pressing portion 420*b* extending from the pin body 420*a*.

For example, the pin body 420*a* and the pressing portion 420*b* may be bent to form a predetermined angle, and the pressing portion 420*b* may extend from the pin body 420*a* so as to press the center of the ice chamber 111.

While the lower assembly 200 rotates to separate the ice, rotation force of the lower assembly 200 may be transmitted to the upper ejector 300.

For this, the ice maker 100 may further include the connection unit 350 connecting the lower assembly 200 to the upper ejector 300. The connection unit 350 may include one or more links.

For example, when the lower assembly 200 rotates in one direction, the upper ejector 300 may descend by the connection unit 350 to allow the upper ejector pin 320 to press the ice. On the other hand, when the lower assembly 200 rotates in the other direction, the upper ejector 300 may ascend by the connection unit 350 to return to its original position.

Hereinafter, the upper assembly 110 and the lower assembly 120 will be described in more detail.

The upper assembly 110 may include an upper tray 150 defining a portion of the ice chamber 111 making the ice. For example, the upper tray 150 may define an upper portion of the ice chamber 111.

The upper assembly 110 may further include an upper case 120 and an upper supporter 170 fixing a position of the upper tray 150.

The upper tray 150 may be disposed below the upper case 120. A portion of the upper supporter 170 may be disposed below the upper tray 150.

As described above, the upper case 120, the upper tray 150, and the upper supporter 170, which are vertically aligned, may be coupled to each other through a fastening member.

In other words, the upper tray 150 may be fixed to the upper case 120 through the fastening of the fastening member.

In addition, the upper supporter 170 may support the lower side of the upper tray 150 to limit the downward movement.

For example, the water supply portion 190 may be fixed to the upper case 120.

The ice maker 100 may further include a temperature sensor 500 detecting a temperature of the upper tray 150.

For example, the temperature sensor 500 may be mounted on the upper case 120. Also, when the upper tray 150 is fixed to the upper case 120, the temperature sensor 500 may contact the upper tray 150.

Meanwhile, the lower assembly 200 may include a lower tray 250 defining the other portion of the ice chamber 111 making the ice. For example, the lower tray 250 may define a lower portion of the ice chamber 111.

The lower assembly 200 may further include a lower supporter 270 supporting a lower portion of the lower tray 250 and a lower case 210 of which at least a portion covers an upper side of the lower tray 250.

The lower case 210, the lower tray 250, and the lower supporter 270 may be coupled to each other through a fastening member.

The ice maker 100 may further include a switch for turning on/off the ice maker 100. When the user turns on the switch 600, the ice maker 100 may make ice.

In other words, when the switch 600 is turned on, water may be supplied to the ice maker 100. Then, an ice-making process of making ice by using cold air and an ice-separation process of separating the ice through the rotation of the lower assembly 200 can be performed repeatedly.

On the other hand, when the switch 600 is manipulated to be turned off, the making of the ice through the ice maker 100 may be impossible. For example, the switch 600 may be provided in the upper case 120.

<Upper Case>

Figure 5A:
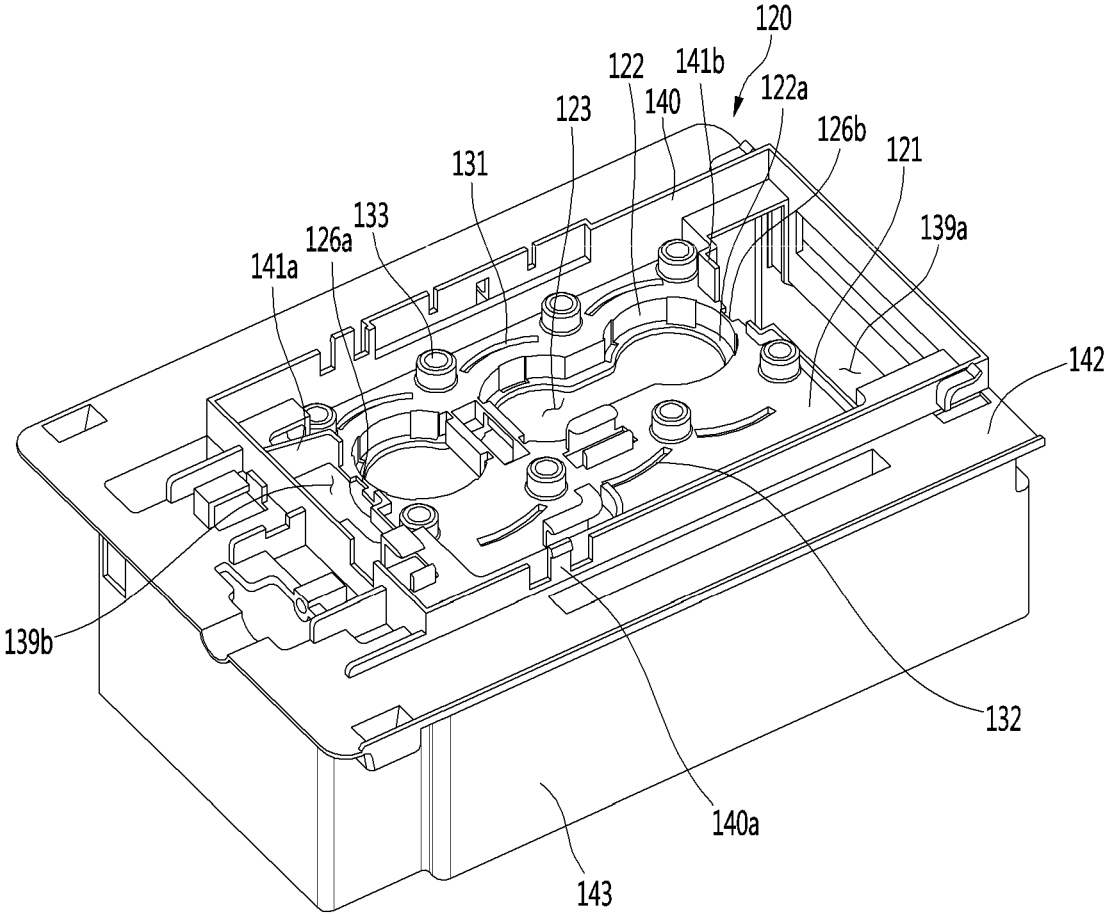
FIG. 5A is a top perspective view illustrating the upper case according to an embodiment of the present disclosure.
Figure 5B:
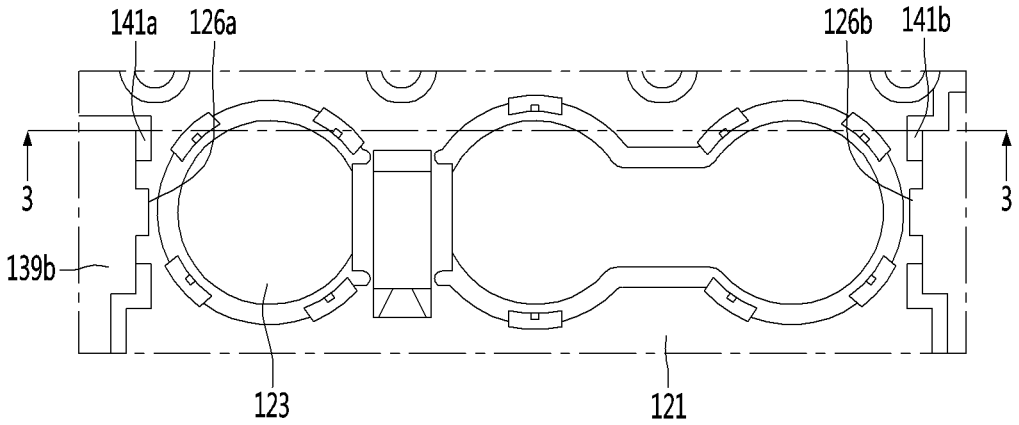
FIG. 5B is a plan view of illustrating a portion of an upper case according to an embodiment of the present disclosure.
Figure 5C:
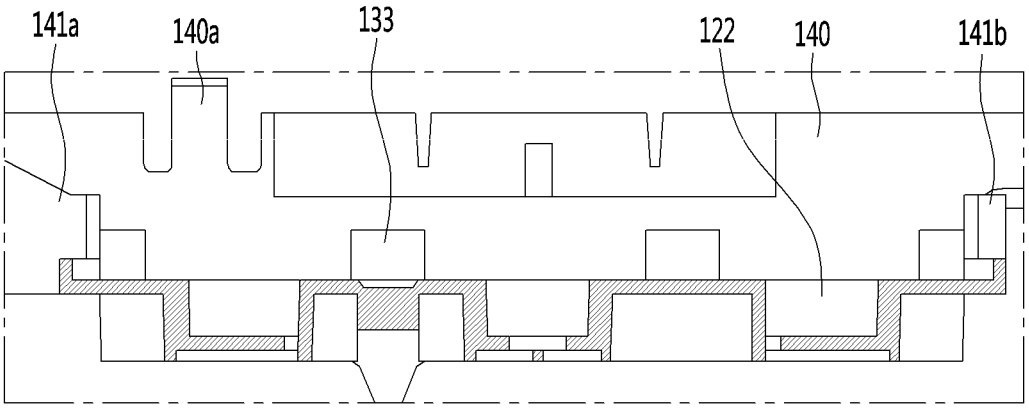
FIG. 5C is a sectional view taken along line 3-3 of FIG. 5B.
Figure 6:
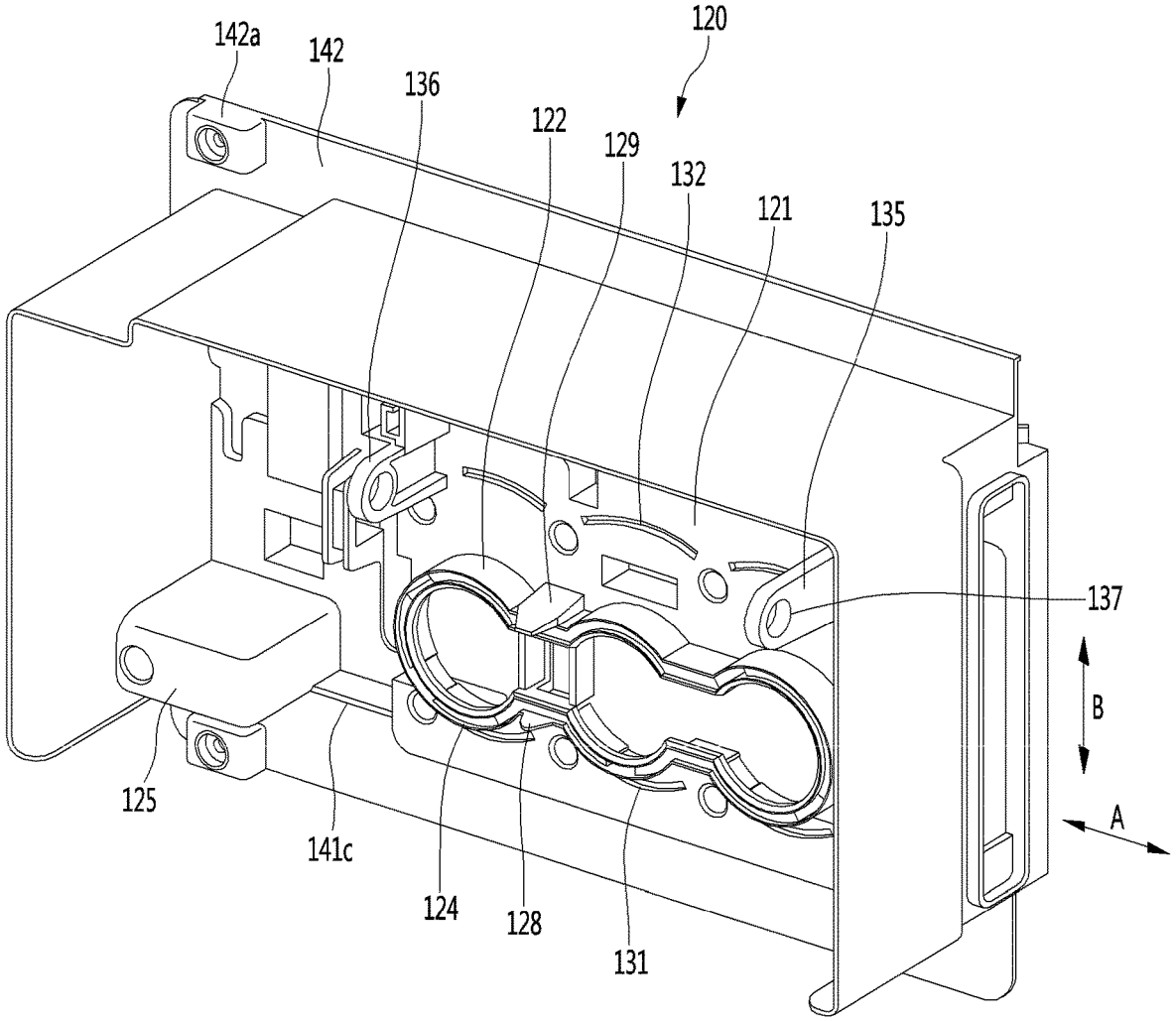
FIG. 6 is a bottom perspective view illustrating an upper case according to one embodiment of the present disclosure.

FIG. 5A is a top perspective view illustrating the upper case according to an embodiment of the present disclosure, FIG. 5B is a plan view of illustrating a portion of an upper case according to an embodiment of the present disclosure, FIG. 5C is a sectional view taken along line 3-3 of FIG. 5B, and FIG. 6 is a bottom perspective view illustrating an upper case according to one embodiment of the present disclosure. Referring to FIGS. 5 and 6, the upper case 120 may be fixed to a housing 101 within the freezing chamber 4 in a state where the upper tray 150 is fixed.

The upper case 120 may include an upper plate for fixing the upper tray 150.

The upper tray 150 may be fixed to the upper plate 121 in a state where a portion of the upper tray 150 contacts a bottom surface of the upper plate 121.

An opening 123 through which a portion of the upper tray 150 passes may be defined in the upper plate 121.

For example, when the upper tray 150 is fixed to the upper plate 121 in a state where the upper tray 150 is disposed below the upper plate 121, a portion of the upper tray 150 may protrude upward from the upper plate 121 through the opening 123.

Alternatively, the upper tray 150 may not protrude upward from the upper plate 121 through opening 123 but protrude downward from the upper plate 121 through the opening 123.

The upper plate 121 may include a through-opening (139*a* and 139*b* of FIG. 5A) into which the plurality of unit guides 181 and 182 of the upper supporter 170 to be described later is introduced.

In addition, the upper plate 121 may include interference prevention grooves 126*a* and 126*b*.

The opening 123 may be located between the pair of interference prevention grooves 126*a* and 126*b*.

The interference device grooves 126*a* and 126*b* have a configuration into which a portion of the upper and lower guide 313 to be described later may be inserted so as to prevent interference with the upper plate 121 when the upper ejector 300 moves up and down along the unit guides 181 and 182.

In detail, the interference prevention grooves 126*a* and 126*b* may have a width corresponding to a width of a portion of the upper and lower guide 313 which is inserted therein, correspond to the through-openings 139*a* and 139*b* positioned at both sides of the upper plate 121, and be formed symmetrically with respect to the opening 123.

In addition, it can be prevented the vertical movement distance of the upper ejector 300 from decreasing by receiving the lower portion of the vertical guide 313 in the interference prevention grooves 126*a* and 126*b* in a process of lowering the upper ejector 300.

The upper plate 121 may include a recessed portion 122 that is recessed downward. The opening 123 may be defined in a bottom surface 122*a* of the recessed portion 122.

Thus, the upper tray 150 passing through the opening 123 may be disposed in a space defined by the recessed portion 122.

A heater coupling portion 124 for coupling an upper heater 148 that heats the upper tray 150 so as to separate the ice may be provided in the upper case 120.

For example, the heater coupling portion 124 may be provided on the upper plate 121. The heater coupling portion 124 may be disposed below the recessed portion 122.

The upper case 120 may further include a switch case 125 for installing the switch 600.

The switch case 125 may be connected to the side circumference portion 143 which will be described later and may be provided at the lower end of the upper plate 121 and may include one or more holes for installing the switch 600.

The upper case 120 may further include a plurality of installation ribs 128 and 129 for installing the temperature sensor 500.

The pair of installation ribs 128 and 129 may be disposed to be spaced apart from each other in a direction of an arrow B of FIG. 6. The pair of installation ribs 128 and 129 may be disposed to face each other, and the temperature sensor 500 may be disposed between the pair of installation ribs 128 and 129. The pair of installation ribs 128 and 129 may be provided on the upper plate 121.

A plurality of slots 131 and 132 coupled to the upper tray 150 may be provided in the upper plate 121.

A portion of the upper tray 150 may be inserted into the plurality of slots 131 and 132.

The plurality of slots 131 and 132 may include a first upper slot 131 and a second upper slot 132 disposed at an opposite side of the first upper slot 131 with respect to the opening 123.

The opening 123 may be defined between the first upper slot 131 and the second upper slot 132.

The first upper slot 131 and the second upper slot 132 may be spaced apart from each other in a direction of an arrow B of FIG. 6.

Although not limited, the plurality of first upper slots 131 may be arranged to be spaced apart from each other in a direction of an arrow A (hereinafter, referred to as a first direction) that a direction crossing a direction of an arrow B (hereinafter, referred to as a second direction).

Also, the plurality of second upper slots 132 may be arranged to be spaced apart from each other in the direction of the arrow A.

In this specification, the direction of the arrow A may be the same direction as the arranged direction of the plurality of ice chambers 111.

For example, the first upper slot 131 may be defined in a curved shape. Thus, the first upper slot 131 may increase in length.

For example, the second upper slot 132 may be defined in a curved shape. Thus, the second upper slot 133 may increase in length.

When each of the upper slots 131 and 132 increases in length, a protrusion (that is disposed on the upper tray) inserted into each of the upper slots 131 and 132 may increase in length to improve coupling force between the upper tray 150 and the upper case 120.

A distance between the first upper slot 131 and the opening 123 may be different from that between the second upper slot 132 and the opening 123. For example, the distance between the first upper slot 131 and the opening 123 may be greater than that between the second upper slot 132 and the opening 123.

In addition, when viewed from the opening 123 toward each of the upper slots 131, a shape that is convexly rounded from each of the slots 131 toward the outside of the opening 123 may be provided.

The upper plate 121 may further include a sleeve 133 into which a fastening boss of the upper supporter, which will be described later, is inserted.

The sleeve 133 may have a cylindrical shape and extend upward from the upper plate 121.

For example, a plurality of sleeves 133 may be provided on the upper plate 121. The plurality of sleeves 133 may be arranged to be spaced apart from each other in the direction of the arrow A. Also, the plurality of sleeves 133 may be arranged in a plurality of rows in the direction of the arrow B.

A portion of the plurality of sleeves may be disposed between the two first upper slots 131 adjacent to each other.

The other portion of the plurality of sleeves may be disposed between the two second upper slots 132 adjacent to each other or be disposed to face a region between the two second upper slots 132.

The upper case 120 may further include a plurality of hinge supporters 135 and 136 allowing the lower assembly 200 to rotate. The plurality of hinge supporters 135 and 136 may be disposed to be spaced apart from each other in the direction of the arrow A with respect to FIG. 6. In addition, a first hinge hole 137 may be defined in each of the hinge supporters 135 and 136.

For example, the plurality of hinge supporters 135 and 136 may extend downward from the upper plate 121.

The upper case 120 may further include a vertical extension portion 140 vertically extending along a circumference of the upper plate 121. The vertical extension portion 140 may extend upward from the upper plate 121.

The vertical extension portion 140 may include one or more coupling hooks 140*a*. The upper case 120 may be hook-coupled to the housing 101 by the coupling hooks 140*a*.

In addition, the water supply portion 190 may be coupled to the vertical extension portion 140.

The upper case 120 may further include the upper rib 141*a*, 141*b*, and 141*c* in order to prevent the problem that the strength and durability can be weakened by forming the interference prevention grooves 126*a* and 126*b* adjacent to the through-openings 139*a* and 139*b*.

The upper ribs 141*a*, 141*b*, and 141*c* may extend from the upper plate 121, and a plurality of the upper ribs 141*a*, 141*b*, and 141*c* may be formed upward or downward of the upper plate 121 as long as there is no interference in assembling the upper assembly 110.

The upper ribs 141*a*, 141*b*, and 141*c* may include the first upper rib to the third upper rib 141*a*, 141*b*, and 141*c*.

The first upper rib 141*a* and the second upper rib 141*b* may be formed at positions symmetrical with respect to the opening 123 adjacent to the interference prevention grooves 126*a* and 126*b*.

In addition, the first and second upper ribs 141*a* and 141*b* may be formed to extend upward from the upper plate 121 in one bent shape.

In detail, the first and second upper ribs 141*a* and 141*b* may be vertically formed along the circumference of the through-openings 139*a* and 139*b* formed in the upper plate 121 at positions adjacent to the interference prevention grooves 126*a* and 126*b*.

In addition, the first and second upper ribs 141*a* and 141*b* may be formed only on one side surface of the interference prevention grooves 126*a* and 126*b* so as to prevent interference by the assembly of the upper supporter 170 and the connection unit 350.

In addition, one of the first and second upper ribs 141*a* and 141*b* may have a shape in which the height increases toward the outside of the upper plate 121.

The third upper rib 141*c* may be formed to extend downward from the upper plate 121.

In detail, the third upper rib 141*c* may be formed to connect the switch case 125 and the recessed portion 122 to support the switch case 125 that protrudes. In a case of the structure protruding by the third upper rib 141*c*, the problem that the durability or strength that may occur may be weakened can be solved.

The upper case 120 may further include a horizontal extension portion 142 horizontally extending to the outside of the vertical extension portion 140.

A screw fastening portion 142*a* protruding outward to screw-couple the upper case 120 to the housing 101 may be provided on the horizontal extension portion 142.

The upper case 120 may further include a side circumferential portion 143. The side circumferential portion 143 may extend downward from the horizontal extension portion 142.

The side circumferential portion 143 may be disposed to surround a circumference of the lower assembly 200. In other words, the side circumferential portion 143 may prevent the lower assembly 200 from being exposed to the outside.

Although the upper case is coupled to the separate housing 101 within the freezing chamber 4 as described above, the embodiment is not limited thereto. For example, the upper case 120 may be directly coupled to a wall defining the freezing chamber 4.

<Upper Tray>

Figure 7:
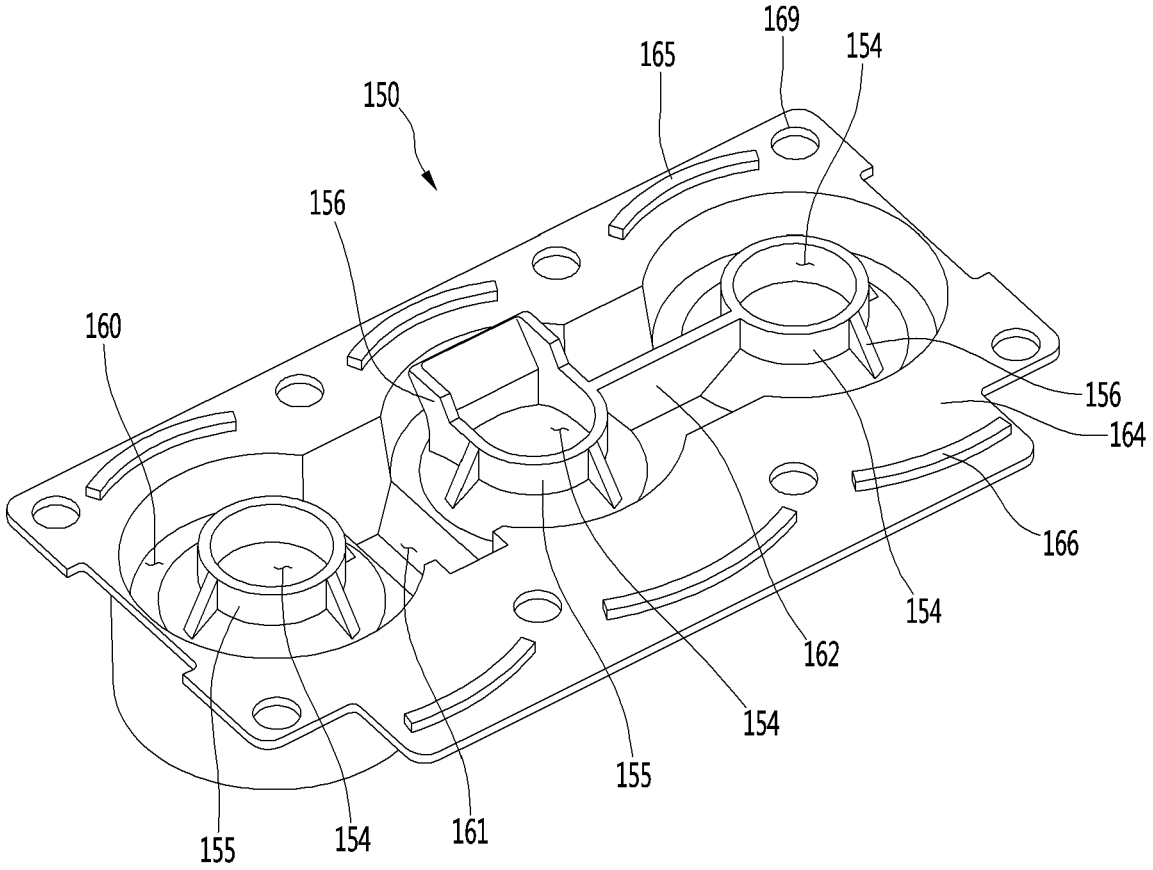
FIG. 7 is a top perspective view illustrating an upper tray according to one embodiment of the present disclosure.
Figure 8:
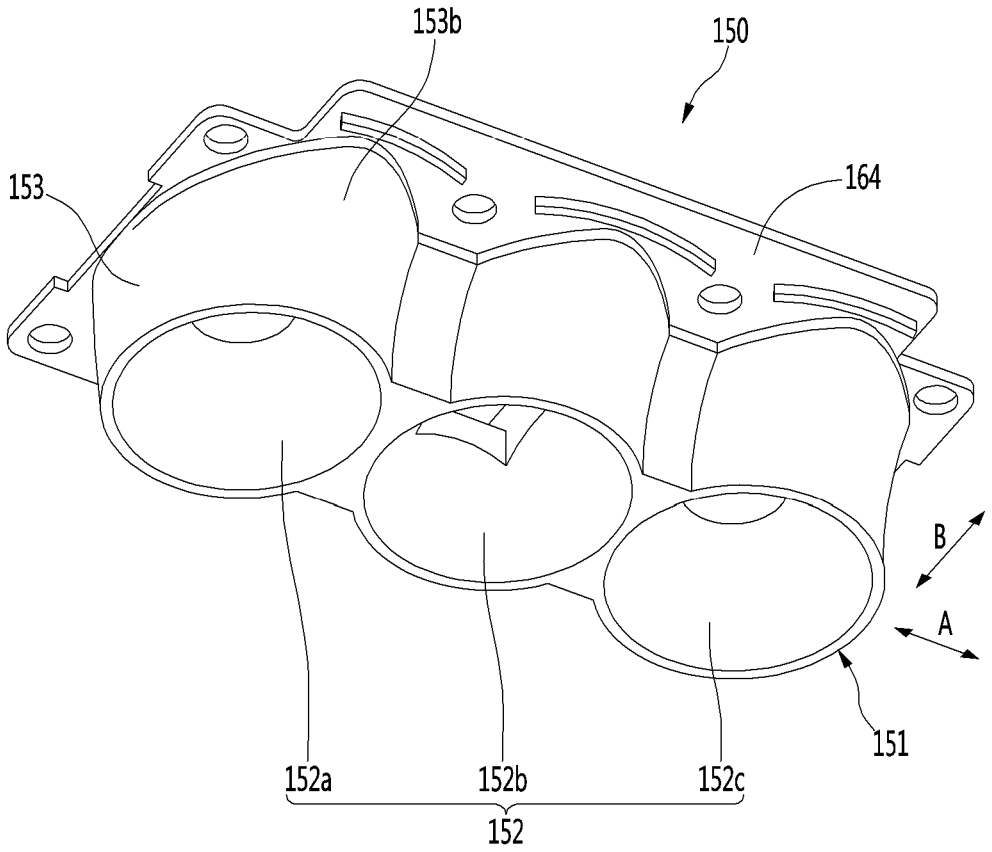
FIG. 8 is a bottom perspective view illustrating an upper tray according to one embodiment of the present disclosure.
Figure 9:
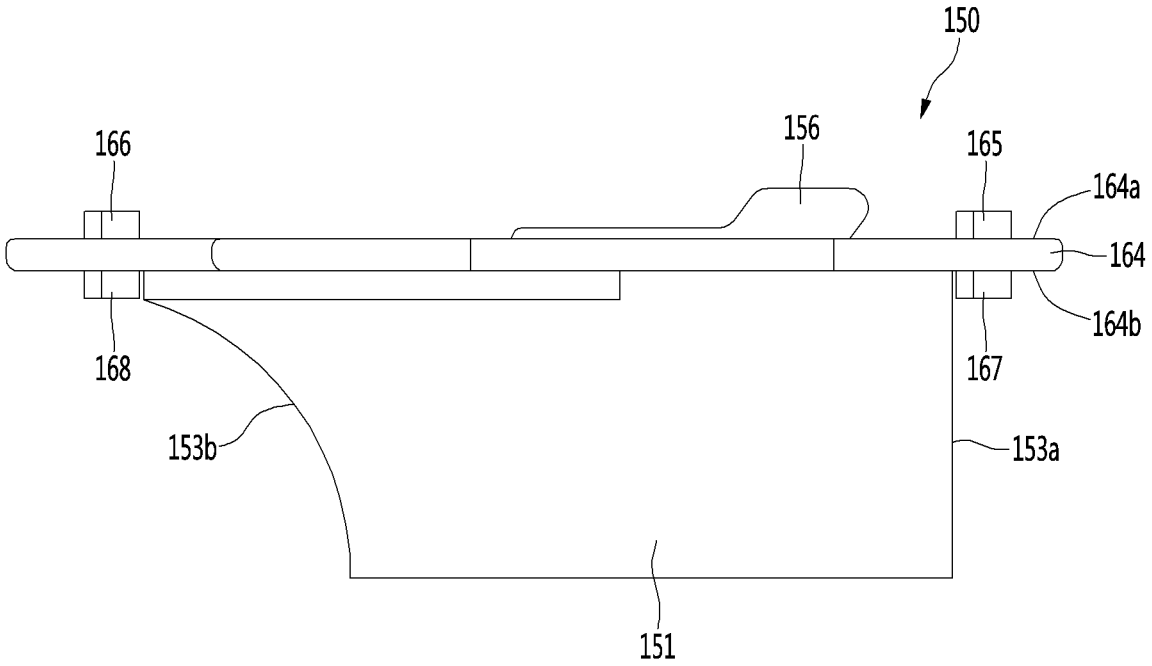
FIG. 9 is a side view illustrating an upper tray according to one embodiment of the present disclosure.

FIG. 7 is a top perspective view illustrating an upper tray according to one embodiment of the present disclosure, FIG. 8 is a bottom perspective view illustrating an upper tray according to one embodiment of the present disclosure, and FIG. 9 is a side view illustrating an upper tray according to one embodiment of the present disclosure.

Referring to FIGS. 7 to 9, the upper tray 150 may be made of a flexible material that is capable of being restored to its original shape after being deformed by an external force.

For example, the upper tray 150 may be made of a silicone material. Like this embodiment, when the upper tray 150 is made of the silicone material, even though external force is applied to deform the upper tray 150 during the ice-separation process, the upper tray 150 may be restored to its original shape. Thus, in spite of repetitive ice-making, spherical ice may be made.

If the upper tray 150 is made of a metal material, when the external force is applied to the upper tray 150 to deform the upper tray 150 itself, the upper tray 150 may not be restored to its original shape any more.

In this case, after the upper tray 150 is deformed in shape, the spherical ice may not be made. In other words, it is impossible to repeatedly make the spherical ice.

On the other hand, like this embodiment, when the upper tray 150 is made of the flexible material that is capable of being restored to its original shape, this limitation may be solved.

Also, when the upper tray 150 is made of the silicone material, the upper tray 150 may be prevented from being melted or thermally deformed by heat provided from an upper heater.

The upper tray 150 may include an upper tray body 151 defining an upper chamber 152 that is a portion of the ice chamber 111.

The upper tray body 151 may define a plurality of upper chambers 152.

For example, the plurality of upper chambers 152 may define a first upper chamber 152*a*, a second upper chamber 152*b*, and a third upper chamber 152*c*.

The upper tray body 151 may include three chamber walls 153 defining three independent upper chambers 152*a*, 152*b*, and 152*c*. The three chamber walls 153 may be connected to each other to form one body.

The first upper chamber 152*a*, the second upper chamber 152*b*, and the third upper chamber 152*c* may be arranged in a line. For example, the first upper chamber 152*a*, the second upper chamber 152*b*, and the third upper chamber 152*c* may be arranged in a direction of an arrow A with respect to FIG. 8. The direction of the arrow A of FIG. 8 may be the same direction as the direction of the arrow A of FIG. 6.

The upper chamber 152 may have a hemispherical shape. In other words, an upper portion of the spherical ice may be made by the upper chamber 152.

An inlet opening 154 through which water is introduced into the upper chamber may be defined in an upper side of the upper tray body 151. For example, three inlet openings 154 may be defined in the upper tray body 151. Cold air may be guided into the ice chamber 111 through the inlet opening 154.

In the ice-separation process, the upper ejector 300 may be inserted into the upper chamber 152 through the inlet opening 154.

While the upper ejector 300 is inserted through the inlet opening 154, an inlet wall 155 may be provided on the upper tray 150 to minimize deformation of the inlet opening 154 in the upper tray 150.

The inlet wall 155 may be disposed along a circumference of the inlet opening 154 and extend upward from the upper tray body 151.

The inlet wall 155 may have a cylindrical shape. Thus, the upper ejector 30 may pass through the inlet opening 154 via an inner space of the inlet wall 155.

One or more first connection ribs 155*a* may be provided along a circumference of the inlet wall 155 to prevent the inlet wall 155 from being deformed while the upper ejector 300 is inserted into the inlet opening 154.

The first connection rib 155*a* may connect the inlet wall 155 to the upper tray body 151. For example, the first connection rib 155*a* may be integrated with the circumference of the inlet wall 155 and an outer face of the upper tray body 151. Although not limited, the plurality of connection ribs 155*a* may be disposed along the circumference of the inlet wall 155.

The two inlet walls 155 corresponding to the second upper chamber 152*b* and the third upper chamber 152*c* may be connected to each other through the second connection rib 162. The second connection rib 162 may also prevent the inlet wall 155 from being deformed.

A water supply guide 156 may be provided in the inlet wall 155 corresponding to one of the three upper chambers 152*a*, 152*b*, and 152*c*.

Although not limited, the water supply guide 156 may be provided in the inlet wall corresponding to the second upper chamber 152*b*.

The water supply guide 156 may be inclined upward from the inlet wall 155 in a direction which is away from the second upper chamber 152*b*.

The upper tray 150 may further include a first receiving portion 160. The recessed portion 122 of the upper case 120 may be received in the first receiving portion 160.

A heater coupling portion 124 may be provided in the recessed portion 122, and an upper heater (see reference numeral 148 of FIG. 13) may be provided in the heater coupling portion 124. Thus, it may be understood that the upper heater (see reference numeral 148 of FIG. 13) is received in the first receiving portion 160.

The first receiving portion 160 may be disposed in a shape that surrounds the upper chambers 152*a*, 152*b*, and 152*c*. The first receiving portion 160 may be provided by recessing a top surface of the upper tray body 151 downward.

The heater coupling portion 124 to which the upper heater (see reference numeral 148 of FIG. 13) is coupled may be received in the first receiving portion 160.

The upper tray 150 may further include a second receiving portion 161 (or referred to as a sensor receiving portion) in which the temperature sensor 500 is received.

For example, the second receiving portion 161 may be provided in the upper tray body 151. Although not limited, the second receiving portion 161 may be provided by recessing a bottom surface of the first receiving portion 160 downward.

In addition, the second receiving portion 161 may be disposed between the two upper chambers adjacent to each other. For example, in FIG. 7, the second receiving portion 161 may be disposed between the first upper chamber 152*a* and the second upper chamber 152*b*.

Thus, an interference between the upper heater (see reference numeral 148 of FIG. 13) received in the first receiving portion 160 and the temperature sensor 500 may be prevented.

In the state where the temperature sensor 500 is received in the second receiving portion 161, the temperature sensor 500 may contact an outer face of the upper tray body 151.

The chamber wall 153 of the upper tray body 151 may include a vertical wall 153*a* and a curved wall 153*b*.

The curved wall 153*b* may be rounded upward in a direction that is away from the upper chamber 152.

The upper tray 150 may further include a horizontal extension portion 164 horizontally extending from the circumference of the upper tray body 151. For example, the horizontal extension portion 164 may extend along a circumference of an upper edge of the upper tray body 151.

The horizontal extension portion 164 may contact the upper case 120 and the upper supporter 170.

For example, a bottom surface 164*b* (or referred to as a "first surface") of the horizontal extension portion 164 may contact the upper supporter 170, and a top surface 164*a* (or referred to as a "second surface") of the horizontal extension portion 164 may contact the upper case 120.

At least a portion of the horizontal extension portion 164 may be disposed between the upper case 120 and the upper supporter 170.

The horizontal extension portion 164 may include a plurality of upper protrusions 165 and 166 respectively inserted into the plurality of upper slots 131 and 132.

The plurality of upper protrusions 165 and 166 may include a first upper protrusion 165 and a second upper protrusion 166 disposed at an opposite side of the first upper protrusion 165 with respect to the inlet opening 154.

The first upper protrusion 165 may be inserted into the first upper slot 131, and the second upper protrusion 166 may be inserted into the second upper slot 132.

The first upper protrusion 165 and the second upper protrusion 166 may protrude upward from the top surface 164*a* of the horizontal extension portion 164.

The first upper protrusion 165 and the second upper protrusion 166 may be spaced apart from each other in the direction of the arrow B of FIG. 8. The direction of the arrow B of FIG. 8 may be the same direction as the direction of the arrow B of FIG. 6.

Although not limited, the plurality of first upper protrusions 165 may be arranged to be spaced apart from each other in the direction of the arrow A.

In addition, the plurality of second upper protrusions 166 may be arranged to be spaced apart from each other in the direction of the arrow A.

For example, the first upper protrusion 165 may be provided in a curved shape. Also, for example, the second upper protrusion 166 may be provided in a curved shape.

In this embodiment, each of the upper protrusions 165 and 166 may be constructed so that the upper tray 150 and the upper case 120 are coupled to each other, and also, the horizontal extension portion is prevented from being deformed during the ice-making process or the ice-separation process.

Here, when each of the upper protrusions 165 and 166 is provided in the curved shape, distances between the upper protrusions 165 and 166 and the upper chamber 152 in a longitudinal direction of the upper protrusions 165 and 166 may be equal or similar to each other to effectively prevent the horizontal extension portions 264 from being deformed.

For example, the deformation in the horizontal direction of the horizontal extension portion 264 may be minimized to prevent the horizontal extension portion 264 from being plastic-deformed. If when the horizontal extension portion 264 is plastic-deformed, since the upper tray body is not positioned at the correct position during the ice-making, the shape of the ice may not close to the spherical shape.

The horizontal extension portion 164 may further include a plurality of lower protrusions 167 and 168. The plurality of lower protrusions 167 and 168 may be inserted into a lower slot of the upper supporter 170, which will be described below.

The plurality of lower protrusions 167 and 168 may include a first lower protrusion 167 and a second lower protrusion 168 disposed at an opposite side of the first lower protrusion 167 with respect to the upper chamber 152.

The first lower protrusion 167 and the second lower protrusion 168 may protrude upward from the bottom surface 164*b* of the horizontal extension portion 164.

The first lower protrusion 167 may be disposed at an opposite to the first upper protrusion 165 with respect to the horizontal extension portion 164. The second lower protrusion 168 may be disposed at an opposite side of the second upper protrusion 166 with respect to the horizontal extension portion 164.

The first lower protrusion 167 may be spaced apart from the vertical wall 153*a* of the upper tray body 151. The second lower protrusion 168 may be spaced apart from the curved wall 153*b* of the upper tray body 151.

Each of the plurality of lower protrusions 167 and 168 may also be provided in a curved shape. Since the protrusions 165, 166, 167, and 168 are disposed on each of the top and bottom surfaces 164*a* and 164*b* of the horizontal extension portion 164, the deformation in the horizontal direction of the horizontal extension portion 164 may be effectively prevented.

A through-hole 169 through which the fastening boss of the upper supporter 170, which will be described later, may be provided in the horizontal extension portion 164.

For example, a plurality of through-holes 169 may be provided in the horizontal extension portion 164.

A portion of the plurality of through-holes 169 may be disposed between the two first upper protrusions 165 adjacent to each other or the two first lower protrusions 167 adjacent to each other.

The other portion of the plurality of through-holes 169 may be disposed between the two second lower protrusions 168 adjacent to each other or be disposed to face a region between the two second lower protrusions 168.

<Upper Supporter>

Figure 10:
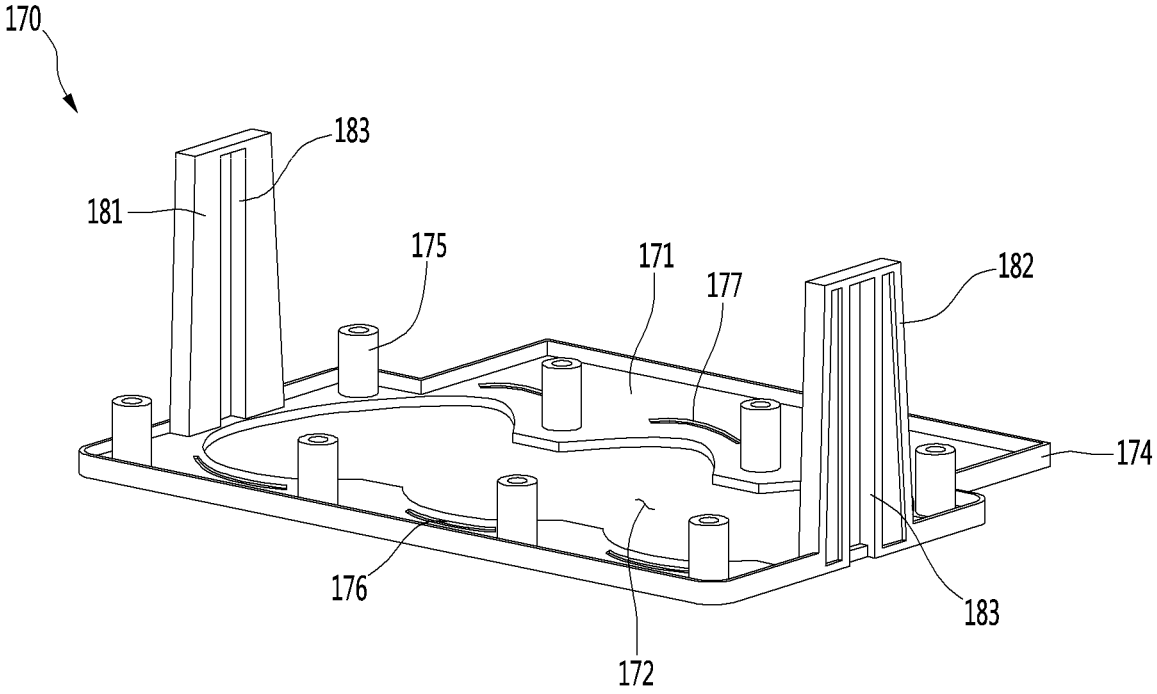
FIG. 10 is a top perspective view illustrating an upper supporter according to one embodiment of the present disclosure.
Figure 11:
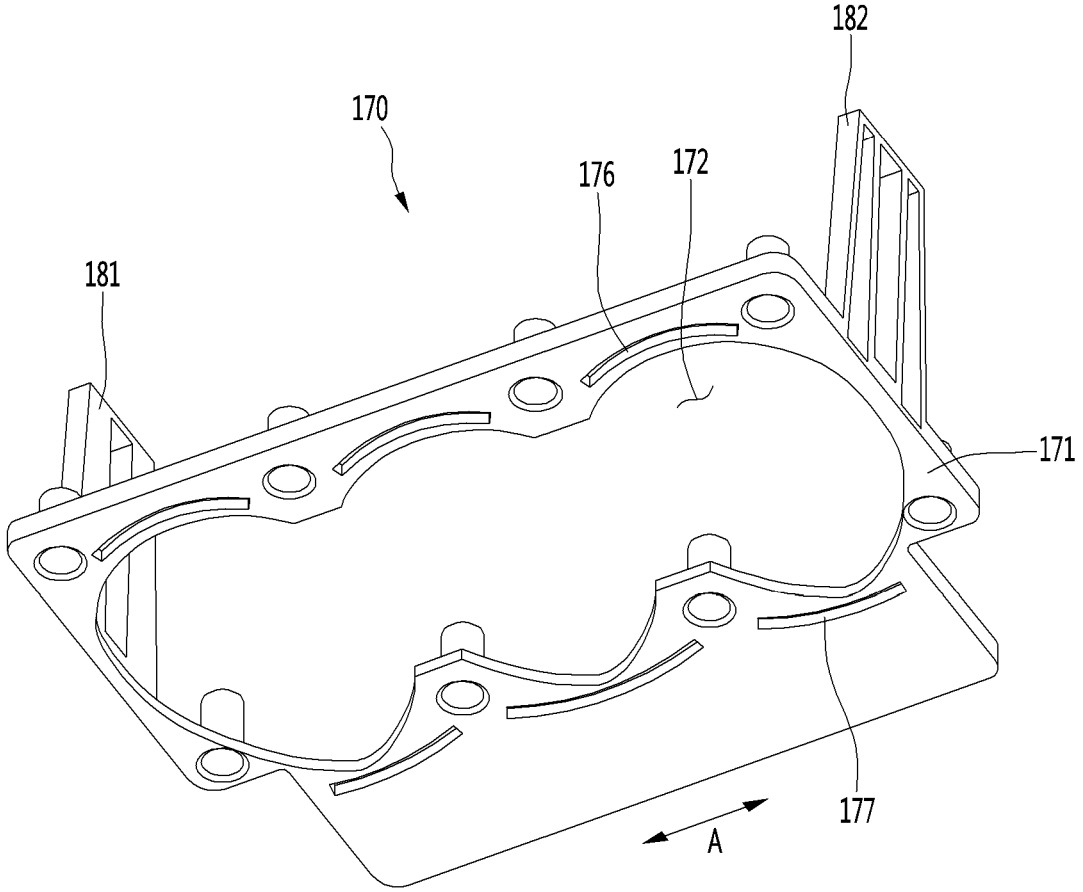
FIG. 11 is a bottom perspective view illustrating an upper supporter according to one embodiment of the present disclosure.

FIG. 10 is a top perspective view illustrating an upper supporter according to one embodiment of the present disclosure, and FIG. 11 is a bottom perspective view illustrating an upper supporter according to one embodiment of the present disclosure. Referring to FIGS. 10 and 11, the upper supporter 170 may include a supporter plate 171 contacting the upper tray 150.

For example, a top surface of the supporter plate 171 may contact the bottom surface 164*b* of the horizontal extension portion 164 of the upper tray 150.

A plate opening 172 through which the upper tray body 151 passes may be defined in the supporter plate 171.

A circumferential wall 174 that is bent upward may be provided on an edge of the supporter plate 171. For example, the circumferential wall 174 may contact at least a portion of a circumference of a side surface of the horizontal extension portion 164.

In addition, a top surface of the circumferential wall 174 may contact a bottom surface of the upper plate 121.

The supporter plate 171 may include a plurality of lower slots 176 and 177.

The plurality of lower slots 176 and 177 may include a first lower slot 176 into which the first lower protrusion 167 is inserted and a second lower slot 177 into which the second lower protrusion 168 is inserted.

The plurality of first lower slots 176 may be disposed to be spaced apart from each other in the direction of the arrow A on the supporter plate 171. Also, the plurality of second lower slots 177 may be disposed to be spaced apart from each other in the direction of the arrow A on the supporter plate 171.

The supporter plate 171 may further include a plurality of fastening bosses 175. The plurality of fastening bosses 175 may protrude upward from the top surface of the supporter plate 171.

Each of the fastening bosses 175 may pass through the through-hole 169 of the horizontal extension portion 164 and be inserted into the sleeve 133 of the upper case 120.

In the state where the fastening boss 175 is inserted into the sleeve 133, a top surface of the fastening boss 175 may be disposed at the same height as a top surface of the sleeve 133 or disposed at a height lower than that of the top surface of the sleeve 133.

A fastening member coupled to the fastening boss 175 may be, for example, a bolt (see reference symbol B1 of FIG. 3). The bolt B1 may include a body portion and a head portion having a diameter greater than that of the body portion. The bolt B1 may be coupled to the fastening boss 175 from an upper side of the fastening boss 175.

While the body portion of the bolt B1 is coupled to the fastening boss 175, when the head portion contacts the top surface of the sleeve 133, and the head portion contacts the top surface of the sleeve 133 and the top surface of the fastening boss 175, assembling of the upper assembly 110 may be completed.

The upper supporter 170 may further include a plurality of unit guides 181 and 182 for guiding the connection unit 350 connected to the upper ejector 300.

The plurality of unit guides 181 and 182 may be, for example, disposed to be spaced apart from each other in the direction of the arrow A with respect to FIG. 11.

The unit guides 181 and 182 may extend upward from the top surface of the supporter plate 171. In addition, each of the unit guides 181 and 182 may be connected to the circumferential wall 174.

Each of the unit guides 181 and 182 may include a guide slot 183 vertically extends.

In a state where both ends of the ejector body 310 of the upper ejector 300 pass through the guide slot 183, the connection unit 350 is connected to the ejector body 310.

Thus, when the rotation force is transmitted to the ejector body 310 by the connection unit 350 while the lower assembly 200 rotates, the ejector body 310 may vertically move along the guide slot 183.

<Upper Heater Coupling Structure>

Figure 12:
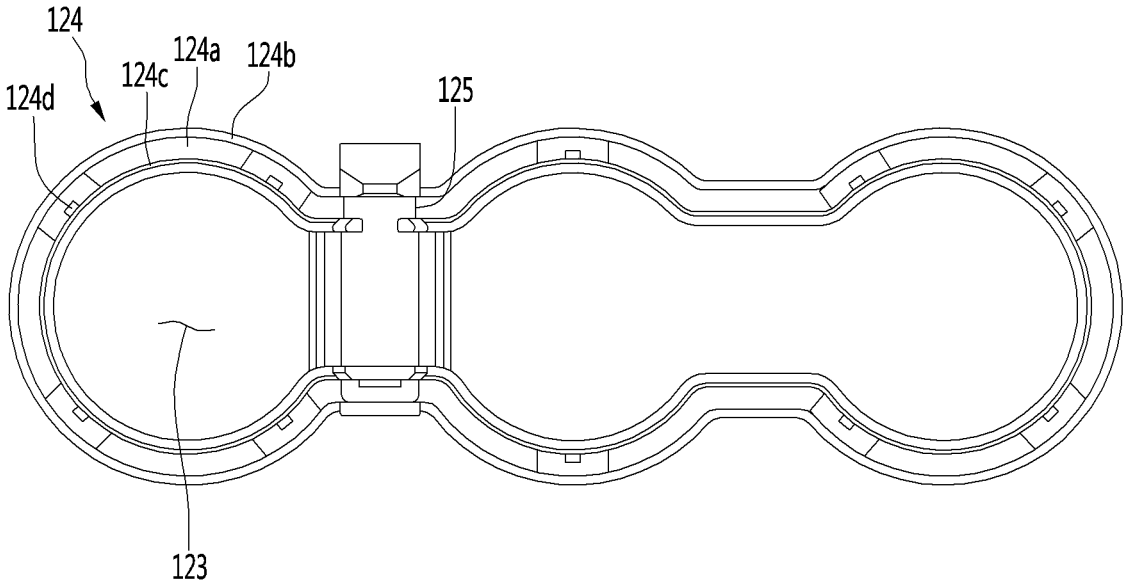
FIG. 12 is an enlarged view illustrating a heater coupling portion in the upper case of FIG. 5.
Figure 13:
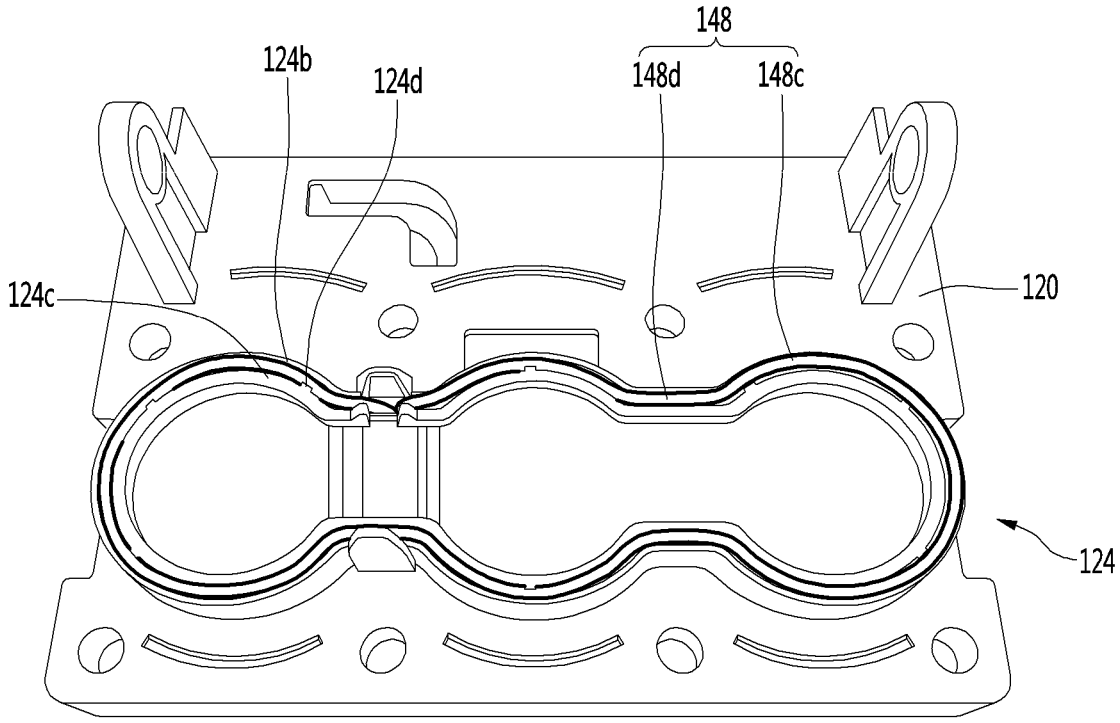
FIG. 13 is a view illustrating a state where a heater is coupled to the upper case of FIG. 5.
Figure 14:
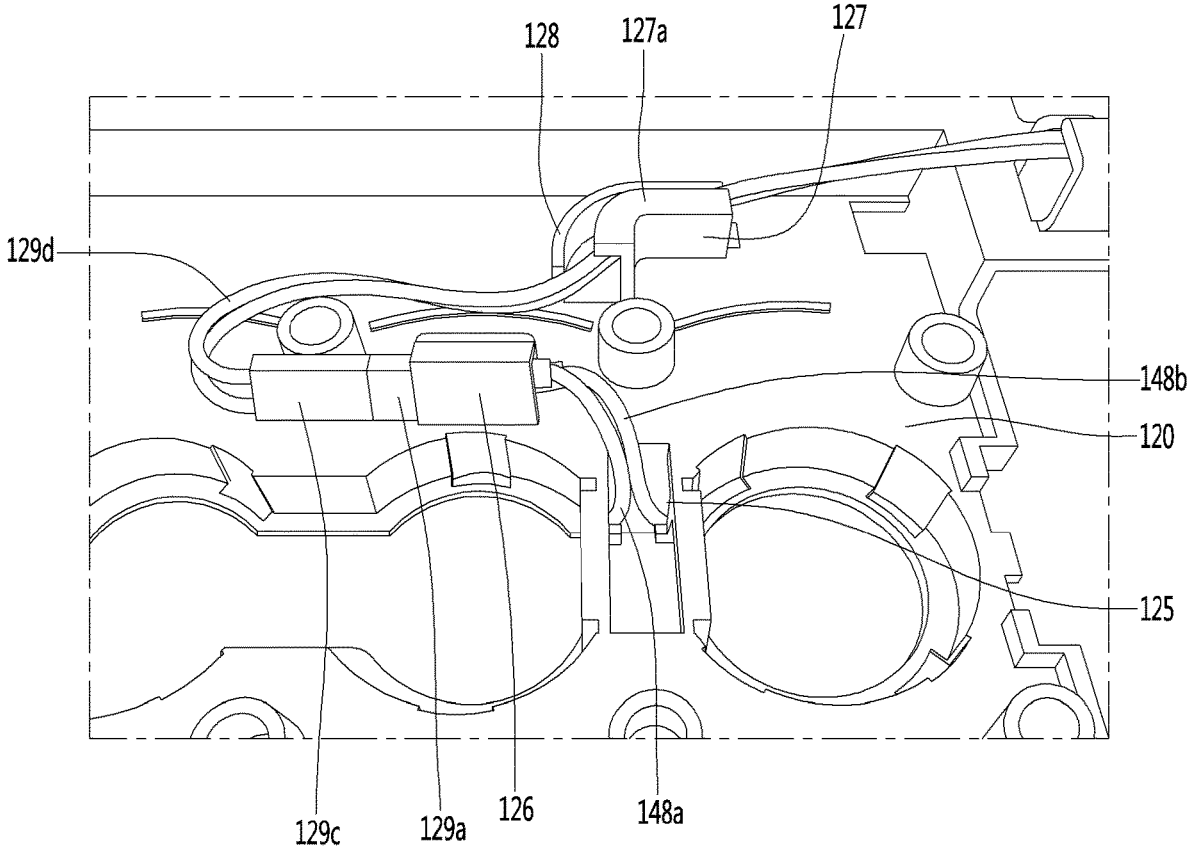
FIG. 14 is a view illustrating a layout of an electric wire connected to the heater in the upper case.

FIG. 12 is an enlarged view illustrating a heater coupling portion in the upper case of FIG. 5, FIG. 13 is a view illustrating a state where a heater is coupled to the upper case of FIG. 5, and FIG. 14 is a view illustrating a layout of an electric wire connected to the heater in the upper case.

Referring to FIGS. 12 to 14, the heater coupling portion 124 may include a heater receiving groove 124*a* accommodating the upper heater 148.

For example, the heater receiving groove 124*a* may be defined by recessing a portion of a bottom surface of the recessed portion 122 of the upper case 120 upward.

The heater receiving groove 124*a* may extend along a circumference of the opening 123 of the upper case 120.

For example, the upper heater 148 may be a wire-type heater. Thus, the upper heater 148 may be bendable. The upper heater 148 may be bent to correspond to a shape of the heater receiving groove 124*a* so as to accommodate the upper heater 148 in the heater receiving groove 124*a*.

The upper heater 148 may be a DC heater receiving DC power. The upper heater 148 may be turned on to separate ice. When the heat of the upper heater 148 is transferred to the upper tray 150, ice may be separated from the surface (which is an inner surface) of the upper tray 150. At this time, as the heat of the upper heater 148 is stronger, the portion of the spherical ice facing the upper heater 148 becomes opaque than other portions. In other words, an opaque band of a shape corresponding to the upper heater is formed around the ice.

However, in a case of the present embodiment, by using a DC heater having a low output itself, it is possible to reduce the amount of heat transferred to the upper tray 150 and to prevent the formation of an opaque band around the ice.

The upper heater 148 may be disposed to surround the circumference of each of the plurality of upper chambers 152 so that the heat of the upper heater 148 is uniformly transferred to the plurality of upper chambers 152 of the upper tray 150.

In addition, the upper heater 148 may contact the circumference of each of the chamber walls 153 respectively defining the plurality of upper chambers 152. Here, the upper heater 148 may be disposed at a position that is lower than that of the inlet opening 154.

Since the heater receiving groove 124*a* is recessed from the recessed portion 122, the heater receiving groove 124*a* may be defined by an outer wall 124*b* and an inner wall 124*c*.

The upper heater 148 may have a diameter greater than that of the heater receiving groove 124*a* so that the upper heater 148 protrudes to the outside of the heater coupling portion 124 in the state where the upper heater 148 is received in the heater receiving groove 124*a*.

Since a portion of the upper heater 148 protrudes to the outside of the heater receiving groove 124*a* in the state where the upper heater 148 is received in the heater receiving groove 124*a*, the upper heater 148 may contact the upper tray 150.

A separation prevention protrusion 124*d* may be provided on one of the outer wall 124*b* and the inner wall 124*c* to prevent the upper heater 148 received in the heater receiving groove 124*a* from being separated from the heater receiving groove 124*a*.

In FIG. 12, for example, a plurality of separation prevention protrusions 124*d* are provided on the inner wall 124*c*.

The separation prevention protrusion 124*d* may protrude from an end of the inner wall 124*c* toward the outer wall 124*b*.

Here, a protruding length of the separation prevention protrusion 124*d* may be less than about ½ of a distance between the outer wall 124*b* and the inner wall 124*c* to prevent the upper heater 148 from being easily separated from the heater receiving groove 124*a* without interfering with the insertion of the upper heater 148 by the separation prevention protrusion 124*d*.

As illustrated in FIG. 13, in the state where the upper heater 148 is received in the heater receiving groove 124*a*, the upper heater 148 may be divided into a rounded portion 148*c* and a linear portion 148*d*.

In other words, the heater receiving groove 124*a* may include a rounded portion and a linear portion. Thus, the upper heater 148 may be divided into the rounded portion 148*c* and the linear portion 148*d* to correspond to the rounded portion and the linear portion of the heater receiving groove 124*a*.

The rounded portion 148*c* may be a portion disposed along the circumference of the upper chamber 152 and also a portion that is bent to be rounded in a horizontal direction.

The liner portion 148*d* may be a portion connecting the rounded portions 148*c* corresponding to the upper chambers 152 to each other.

Since the heater 148 is disposed at a position lower than that of the inlet opening 154, a line connecting two points of the upper rounded portions, which are spaced apart from each other, to each other may pass through upper chamber 152.

Since the rounded portion 148*c* of the upper heater 148 may be separated from the heater receiving groove 124*a*, the separation prevention protrusion 124*d* may be disposed to contact the rounded portion 148*c*.

A through-opening 124*e* may be defined in a bottom surface of the heater receiving groove 124*a*. When the upper heater 148 is received in the heater receiving groove 124*a*, a portion of the upper heater 148 may be disposed in the through-opening 124*e*. For example, the through-opening 124*e* may be defined in a portion of the upper heater 148 facing the separation prevention protrusion 124*d*.

When the upper heater 148 is bent to be horizontally rounded, tension of the upper heater 148 may increase to cause disconnection, and also, the upper heater 148 may be separated from the heater receiving groove 124*a*.

However, when the through-opening 124*e* is defined in the heater receiving groove 124*a* like this embodiment, a portion of the upper heater 148 may be disposed in the through-opening 124*e* to reduce the tension of the upper heater 148, thereby preventing the heater receiving groove 124*a* from being separated from the upper heater 148.

As illustrated in FIG. 14, in a state where a power input terminal 148*a* and a power output terminal 148*b* of the upper heater 148 are disposed in parallel to each other, the upper heater 148 may pass through a heater through-hole 125 defined in the upper case 120.

Since the upper heater 148 is received from a lower side of the upper case 120, the power input terminal 148*a* and the power output terminal 148*b* of the upper heater 148 may extend upward to pass through the heater through-hole 125.

The power input terminal 148*a* and the power output terminal 148*b* passing through the heater through-hole 125 may be connected to one first connector 129*a*.

In addition, a second connector 129*c* to which two wires 129*d* connected to correspond to the power input terminal 148*a* and the power output terminal 148*b* are connected may be connected to the first connector 129*a*.

A first guide portion 126 guiding the upper heater 148, the first connector 129*a*, the second connector 129*c*, and the wire 129*d* may be provided on the upper plate 121 of the upper case 120.

In FIG. 14, for example, a structure in which the first guide portion 126 guides the first connector 129*a* is illustrated.

The first guide portion 126 may extend upward from the top surface of the upper plate 121 and have an upper end that is bent in the horizontal direction.

Thus, the upper bent portion of the first guide portion 126 may limit upward movement of the first connector 126.

The electric wire 129*d* may be led out to the outside of the upper case 120 after being bent in an approximately "U" shape to prevent interference with the surrounding structure.

Since the electric wire 129*d* is bent at least once, the upper case 120 may further include electric wire guides 127 and 128 for fixing a position of the wire 129*d*.

The electric wire guides 127 and 128 may include a first guide 127 and a second guide 128, which are disposed to be spaced apart from each other in the horizontal direction. The first guide 127 and the second guide 128 may be bent in a direction corresponding to the bending direction of the wire 129*d* to minimize damage of the wire 129*d* to be bent. In other words, each of the first guide 127 and the second guide 128 may include a curved portion.

To limit upward movement of the wire 129*d* disposed between the first guide 127 and the second guide 128, at least one of the first guide 127 and the second guide 128 may include an upper guide 127*a* extending toward the other guide.

Figure 15:
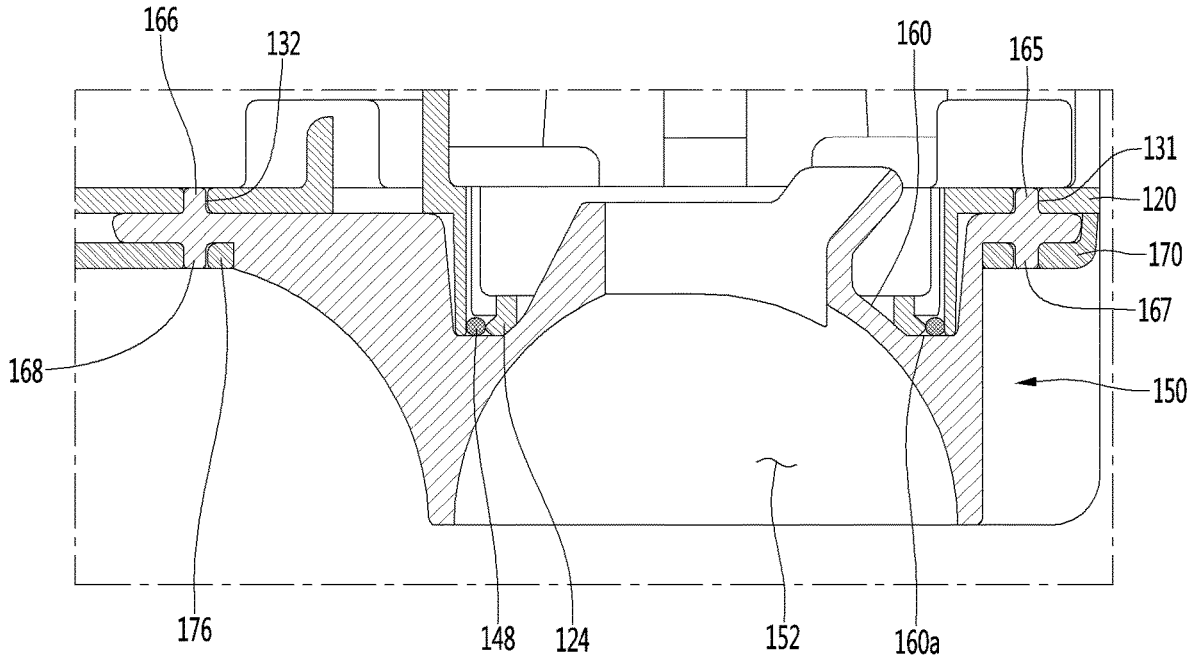
FIG. 15 is a sectional view illustrating a state where the upper assembly has been assembled.

FIG. 15 is a sectional view illustrating a state where the upper assembly has been assembled.

Referring to FIG. 15, in the state where the upper heater 148 is coupled to the heater coupling portion 124 of the upper case 120, the upper case 120, the upper tray 150, and the upper supporter 170 may be coupled to each other.

The first upper protrusion 165 of the upper tray 150 may be inserted into the first upper slot 131 of the upper case 120. Also, the second upper protrusion 166 of the upper tray 150 may be inserted into the second upper slot 132 of the upper case 120.

Then, the first lower protrusion 167 of the upper tray 150 may be inserted into the first lower slot 176 of the upper supporter 170, and the second lower protrusion 168 of the upper tray 150 may be inserted into the second lower slot 177 of the upper supporter 170.

Thus, the fastening boss 175 of the upper supporter 170 may pass through the through-hole of the upper tray 150 and then be received in the sleeve 133 of the upper case 120. In this state, the bolt B1 may be coupled to the fastening boss 175 from an upper side of the fastening boss 175.

In the state where the bolt B1 is coupled to the fastening boss 175, the head portion of the bolt B1 may be disposed at a position higher than that of the upper plate 121.

On the other hand, since the hinge supporters 135 and 136 are disposed lower than the upper plate 121, while the lower assembly 200 rotates, the upper assembly 110 or the connection unit 350 may be prevented from interfering with the head portion of the bolt B1.

While the upper assembly 110 is assembled, a plurality of unit guides 181 and 182 of the upper supporter 170 may protrude upward from the upper plate 121 through the through-opening (see reference numerals 139*a* and 139*b* of FIG. 5) defined in both sides of the upper plate 121.

As described above, the upper ejector 300 passes through the guide slots 183 of the unit guides 181 and 182 protruding upward from the upper plate 121.

Thus, the upper ejector 300 may descend in the state of being disposed above the upper plate 121 and be inserted into the upper chamber 152 to separate ice of the upper chamber 152 from the upper tray 150.

When the upper assembly 110 is assembled, the heater coupling portion 124 to which the upper heater 148 is coupled may be received in the first receiving portion 160 of the upper tray 150.

In the state where the heater coupling portion 124 is received in the first receiving portion 160, the upper heater 148 may contact the bottom surface 160*a* of the first receiving portion 160.

Like this embodiment, when the upper heater 148 is received in the heater coupling portion 124 having the recessed shape to contact the upper tray body 151, heat of the upper heater 148 may be minimally transferred to other portion except for the upper tray body 151.

At least a portion of the upper heater 148 may be disposed to vertically overlap the upper chamber 152 so that the heat of the upper heater 148 is smoothly transferred to the upper chamber 152.

In this embodiment, the rounded portion 148*c* of the upper heater 148 may vertically overlap the upper chamber 152.

In other words, a maximum distance between two points of the rounded portion 148*c*, which are disposed at opposite sides with respect to the upper chamber 152 may be less than a diameter of the upper chamber 152.

<Lower Case>

Figure 16:
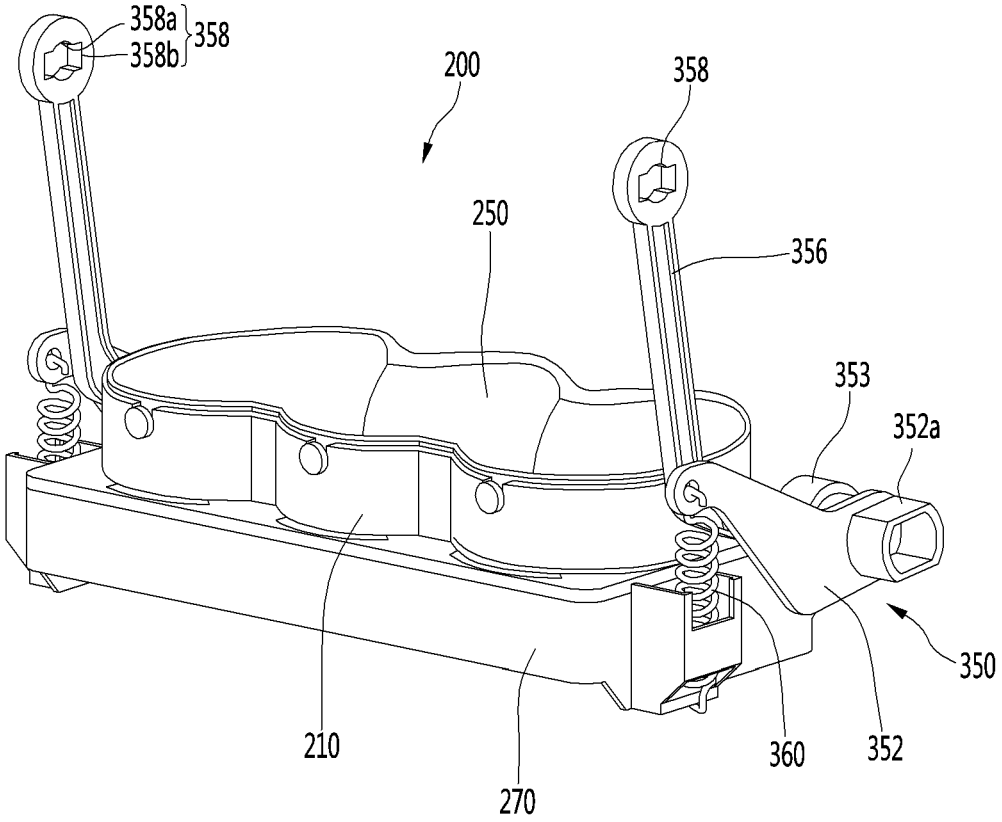
FIG. 16 is a perspective view illustrating the lower assembly according to an embodiment of the present disclosure.
Figure 17:
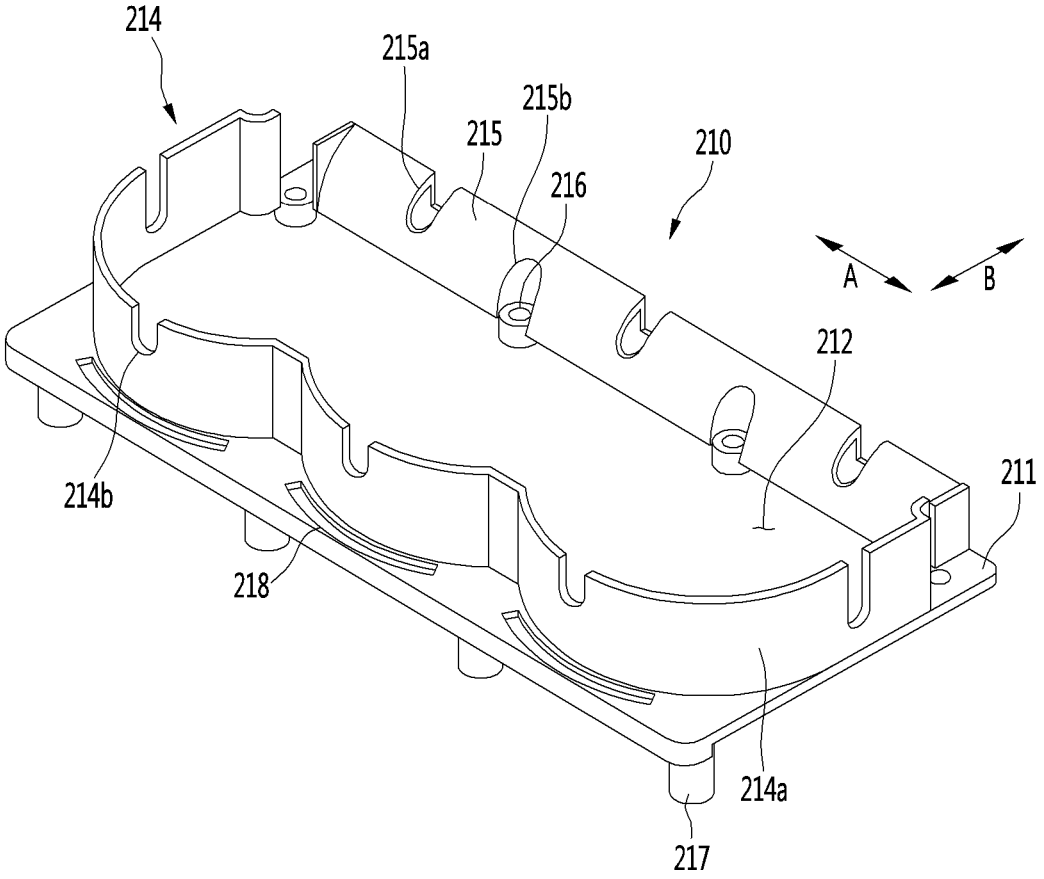
FIG. 17 is a top perspective view illustrating a lower case according to one embodiment of the present disclosure.
Figure 18:
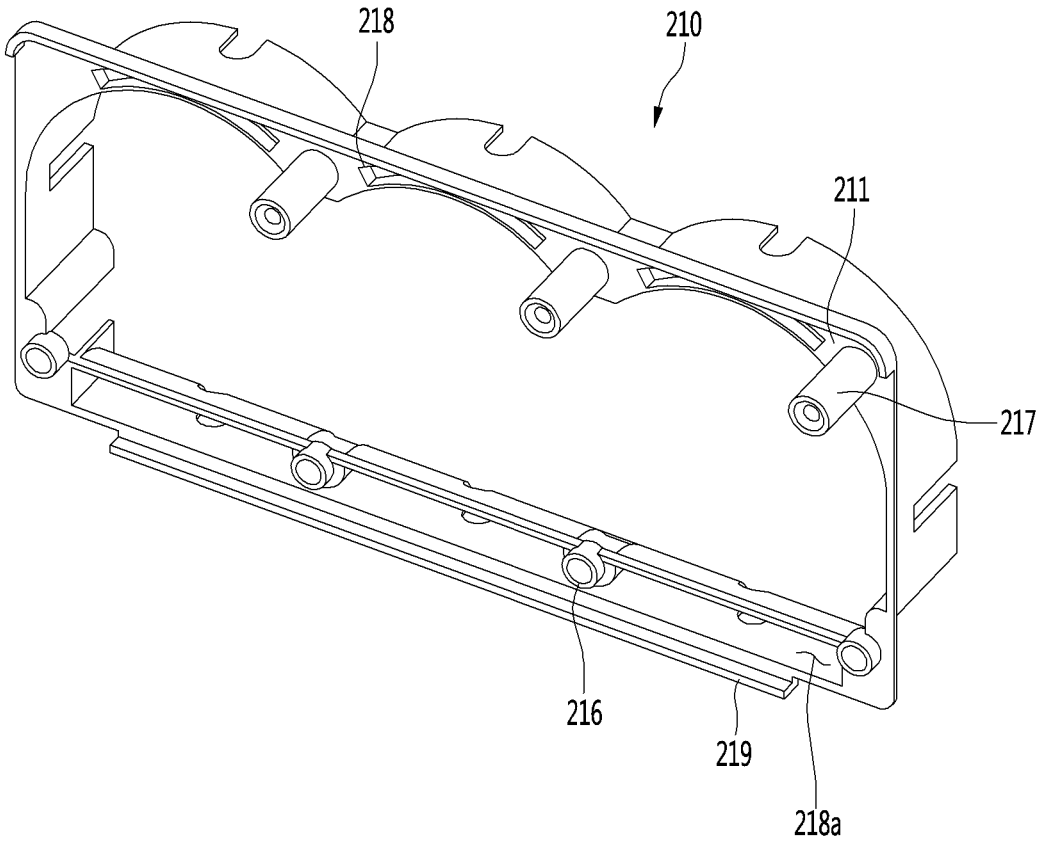
FIG. 18 is a bottom perspective view illustrating a lower case according to one embodiment of the present disclosure.

FIG. 16 is a perspective view illustrating the lower assembly according to an embodiment of the present disclosure, FIG. 17 is a top perspective view illustrating a lower case according to one embodiment of the present disclosure, and FIG. 18 is a bottom perspective view illustrating a lower case according to one embodiment of the present disclosure.

Referring to FIGS. 16 to 18, the lower assembly 200 may include a lower tray 250, a lower supporter 270, and a lower case 210.

The lower case 210 may surround the circumference of the lower tray 250, and the lower supporter 270 may support the lower tray 250.

In addition, the connection unit 350 may be coupled to the lower supporter 270.

The connection unit 350 may include a first link 352 that receives power of the driving unit 180 to allow the lower supporter 270 to rotate and a second link 356 connected to the lower supporter 270 to transmit rotation force of the lower supporter 270 to the upper ejector 300 when the lower supporter 270 rotates.

In addition, the first link 352 and the lower supporter 270 may be connected to each other by an elastic member 360. For example, the elastic member 360 may be a coil spring. As another example, the elastic member 360 may be a tension spring.

The elastic member 360 may have one end connected to the first link 362 and the other end connected to the lower supporter 270.

The elastic member 360 provides elastic force to the lower supporter 270 so that contact between the upper tray 150 and the lower tray 250 is maintained.

In this embodiment, the first link 352 and the second link 356 may be disposed on both sides of the lower supporter 270, respectively.

In addition, one of the two first links may be connected to the driving unit 180 to receive the rotation force from the driving unit 180.

The two first links 352 may be connected to each other by a connection shaft (see reference numeral 370 of FIG. 4).

A hole 358 through which the upper ejector body 310 of the upper ejector 300 passes may be defined in an upper end of the second link 356.

In detail, a separation prevention hole 358 through which the separation prevention protrusion 312 penetrates is formed at an upper end portion of the second link 356.

The separation prevention hole 358 may be formed with a circular central portion 358*a* so as to correspond to the separation prevention protrusion 312 and a pair of groove portions 356*b* formed so as to be recessed in the radial direction toward the outside from both sides of the central portion 358*a* so as to communicate with the central portion 358*a*. Therefore, the separation prevention hole 358 can be inserted into the separation prevention projection 312 in a method in which the central portion 312*a* and the projection portion 312*b* of the separation prevention protrusion 312 are into the central portion 358*a* and the groove portion 358*b* of the separation prevention hole 358. In addition, in a state where the separation prevention protrusion 312 is inserted into the separation prevention hole 358, while the groove portion 358*b* and the protrusion portion 312*b* are shifted, the separation prevention protrusion 312 can be not separated from the separation prevention hole 358 and maintain a state of being inserted.

The lower case 210 may include a lower plate 211 for fixing the lower tray 250.

A portion of the lower tray 250 may be fixed to contact a bottom surface of the lower plate 211.

An opening 212 through which a portion of the lower tray 250 passes may be defined in the lower plate 211.

For example, when the lower tray 250 is fixed to the lower plate 211 in a state where the lower tray 250 is disposed below the lower plate 211, a portion of the lower tray 250 may protrude upward from the lower plate 211 through the opening 212. The lower case 210 may further include a circumferential wall 214 (or a cover wall) surrounding the lower tray 250 passing through the lower plate 211.

The circumferential wall 214 may include a vertical wall 214*a* and a curved wall 215.

The vertical wall 214*a* is a wall vertically extending upward from the lower plate 211. The curved wall 215 is a wall that is rounded in a direction that is away from the opening 212 upward from the lower plate 211.

The vertical wall 214*a* may include a first coupling slit 214*b* coupled to the lower tray 250. The first coupling slit 214*b* may be defined by recessing an upper end of the vertical wall downward.

The curved wall 215 may include a second coupling slit 215*a* to couple to the lower tray 250.

The second coupling slit 215*a* may be defined by recessing an upper end of the curved wall 215 downward.

The lower case 210 may further include a first fastening boss 216 and a second fastening boss 217.

The first fastening boss 216 may protrude downward from the bottom surface of the lower plate 211. For example, the plurality of first fastening bosses 216 may protrude downward from the lower plate 211.

The plurality of first fastening bosses 216 may be arranged to be spaced apart from each other in the direction of the arrow A with respect to FIG. 17.

The second fastening boss 217 may protrude downward from the bottom surface of the lower plate 211. For example, the plurality of second fastening bosses 217 may protrude from the lower plate 211. The plurality of first fastening bosses 217 may be arranged to be spaced apart from each other in the direction of the arrow A with respect to FIG. 17.

The first fastening boss 216 and the second fastening boss 217 may be disposed to be spaced apart from each other in the direction of the arrow B.

In this embodiment, a length of the first fastening boss 216 and a length of the second fastening boss 217 may be different from each other. For example, the first fastening boss 216 may have a length less than that of the second fastening boss 217.

The first fastening member may be coupled to the first fastening boss 216 at an upper portion of the first fastening boss 216. On the other hand, the second fastening member may be coupled to the second fastening boss 217 at a lower portion of the second fastening boss 217.

A groove 215*b* for movement of the fastening member may be defined in the curved wall 215 to prevent the first fastening member from interfering with the curved wall 215 while the first fastening member is coupled to the first fastening boss 216.

The lower case 210 may further include a slot 218 coupled to the lower tray 250.

A portion of the lower tray 250 may be inserted into the slot 218. The slot 218 may be disposed adjacent to the vertical wall 214*a*.

For example, a plurality of slots 218 may be defined to be spaced apart from each other in the direction of the arrow A of FIG. 17. Each of the slots 218 may have a curved shape.

The lower case 210 may further include an receiving groove 218*a* into which a portion of the lower tray 250 is inserted. The receiving groove 218*a* may be defined by recessing a portion of the lower tray 211 toward the curved wall 215.

The lower case 210 may further include an extension wall 219 contacting a portion of the circumference of the side surface of the lower plate 212 in the state of being coupled to the lower tray 250. The extension wall 219 may linearly extend in the direction of the arrow A.

<Lower Tray>

Figure 19:
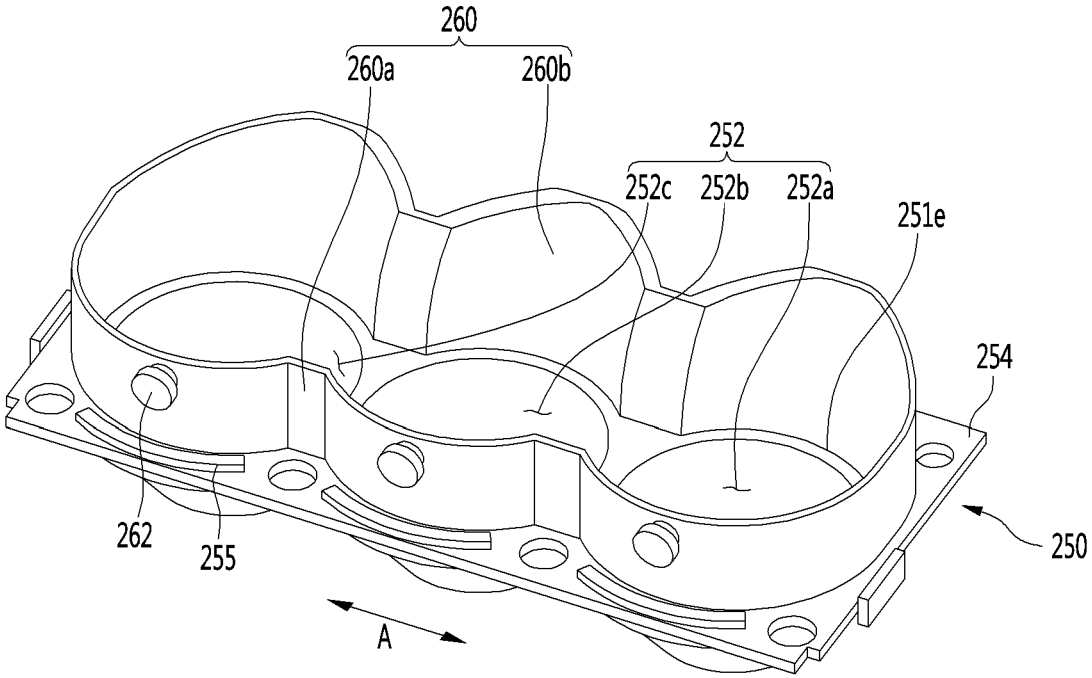
FIG. 19 is a top perspective view illustrating a lower tray according to an embodiment of the present disclosure.
Figure 20:
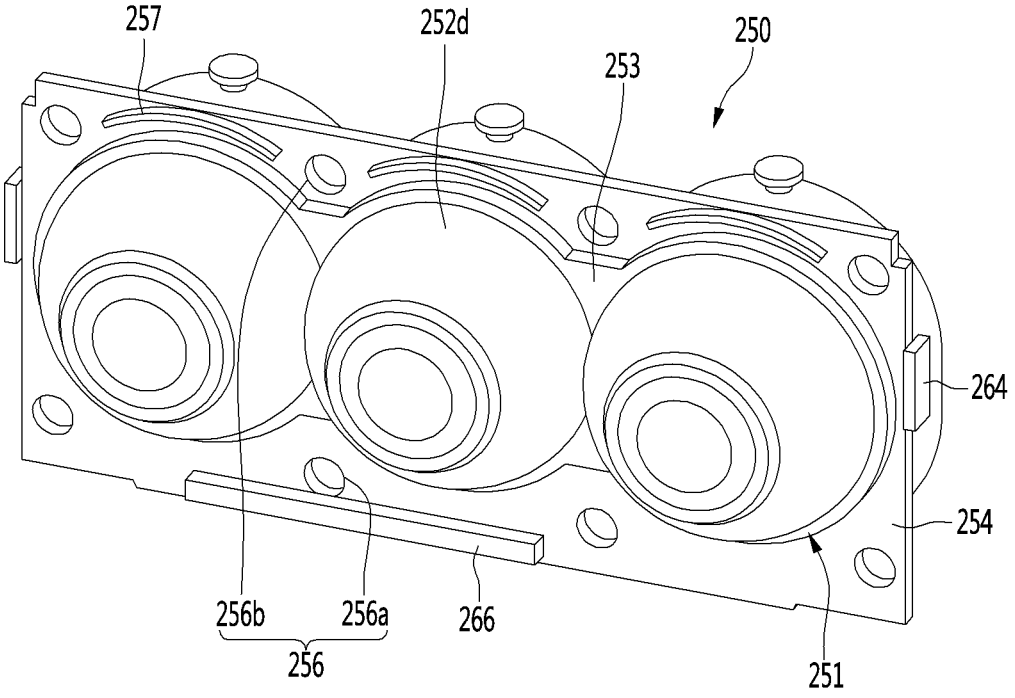
FIGS. 20 and 21 are bottom perspective views illustrating a lower tray according to an embodiment of the present disclosure.
Figure 21:
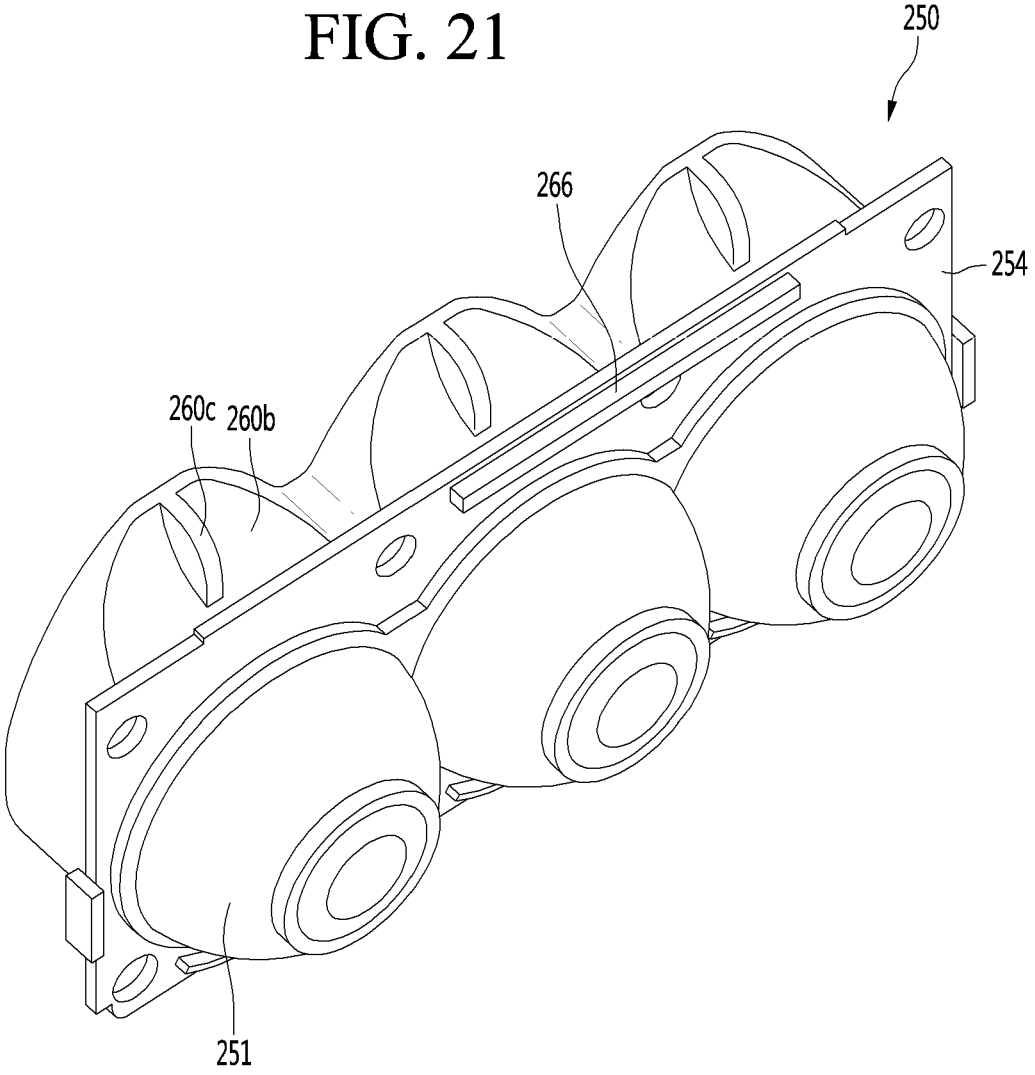
Figure 22:
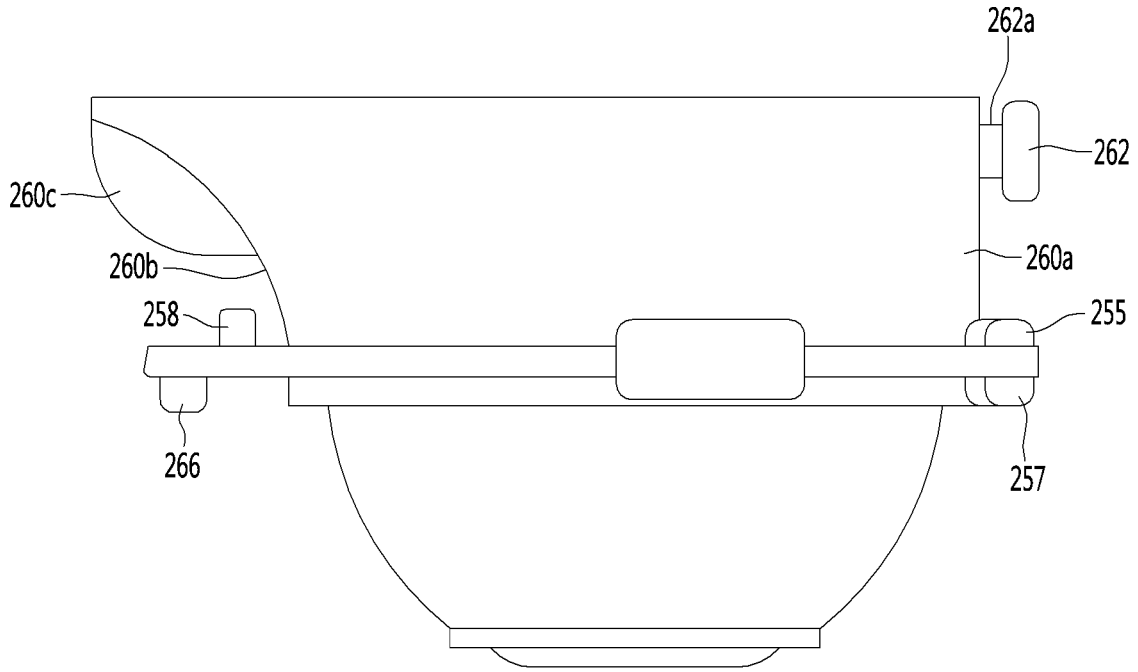
FIG. 22 is a side view illustrating a lower tray according to one embodiment of the present disclosure.

FIG. 19 is a top perspective view illustrating a lower tray according to an embodiment of the present disclosure, FIGS. 20 and 21 are bottom perspective views illustrating a lower tray according to an embodiment of the present disclosure, and FIG. 22 is a side view illustrating a lower tray according to one embodiment of the present disclosure.

Referring to FIGS. 19 to 22, the lower tray 250 may be made of a flexible material that is capable of being restored to its original shape after being deformed by an external force.

For example, the lower tray 250 may be made of a silicone material. Like this embodiment, when the lower tray 250 is made of a silicone material, the lower tray 250 may be restored to its original shape even through external force is applied to deform the lower tray 250 during the ice-separation process. Thus, in spite of repetitive ice-making, spherical ice may be made.

If the lower tray 250 is made of a metal material, when the external force is applied to the lower tray 250 to deform the lower tray 250 itself, the lower tray 250 may not be restored to its original shape any more.

In this case, after the lower tray 250 is deformed in shape, the spherical ice may not be made. In other words, it is impossible to repeatedly make the spherical ice.

On the other hand, like this embodiment, when the lower tray 250 is made of the flexible material that is capable of being restored to its original shape, this limitation may be solved.

Also, when the lower tray 250 is made of the silicone material, the lower tray 250 may be prevented from being melted or thermally deformed by heat provided from an upper heater that will be described later.

The lower tray 250 may include a lower tray body 251 defining a lower chamber 252 that is a portion of the ice chamber 111.

The lower tray body 251 may define a plurality of lower chambers 252.

For example, the plurality of lower chambers 252 may include a first lower chamber 252*a*, a second lower chamber 252*b*, and a third lower chamber 252*c*.

The lower tray body 251 may include three chamber walls 252*d* defining three independent lower chambers 252*a*, 252*b*, and 252*c*. The three chamber walls 252*d* may be integrated in one body to form the lower tray body 251.

The first lower chamber 252*a*, the second lower chamber 252*b*, and the third lower chamber 252*c* may be arranged in a line. For example, the first lower chamber 252*a*, the second lower chamber 252*b*, and the third lower chamber 252*c* may be arranged in a direction of an arrow A with respect to FIG. 19.

The lower chamber 252 may have a hemispherical shape or a shape similar to the hemispherical shape. In other words, a lower portion of the spherical ice may be made by the lower chamber 252.

In the present specification, the shape similar to hemisphere means a shape that is not a perfect hemisphere but is close to the hemisphere.

The lower tray 250 may further include a first extension portion 253 horizontally extending from an edge of an upper end of the lower tray body 251. The first extension portion 253 may be continuously formed along the circumference of the lower tray body 251.

The lower tray 250 may further include a circumferential wall 260 extending upward from an upper surface of the first extension portion 253.

The lower surface of the upper tray body 151 may be in contact with the upper surface 251*e* of the lower tray body 251.

The circumferential wall 260 may surround the upper tray body 251 seated on the top surface 251*e* of the lower tray body 251.

The circumferential wall 260 may include a first wall 260*a* surrounding the vertical wall 153*a* of the upper tray body 151 and a second wall 260*b* surrounding the curved wall 153*b* of the upper tray body 151.

The first wall 260*a* is a vertical wall vertically extending from the top surface of the first extension portion 253. The second wall 260*b* is a curved wall having a shape corresponding to that of the upper tray body 151. In other words, the second wall 260*b* may be rounded upward from the first extension portion 253 in a direction that is away from the lower chamber 252.

The lower tray 250 may further include a second extension portion 254 horizontally extending from the circumferential wall 250.

The second extension portion 254 may be disposed higher than the first extension portion 253. Thus, the first extension portion 253 and the second extension portion 254 may be stepped with respect to each other.

The second extension portion 254 may include a first upper protrusion 255 inserted into the slot 218 of the lower case 210. The first upper protrusion 255 may be disposed to be horizontally spaced apart from the circumferential wall 260.

For example, the first upper protrusion 255 may protrude upward from a top surface of the second extension portion 254 at a position adjacent to the first wall 260*a*.

Although not limited, a plurality of first upper protrusions 255 may be arranged to be spaced apart from each other in the direction of the arrow A with respect to FIG. 19. The first upper protrusion 255 may extend, for example, in a curved shape.

The second extension portion 254 may include a first lower protrusion 257 inserted into a protrusion groove of the lower case 270, which will be described later. The first lower protrusion 257 may protrude downward from a bottom surface of the second extension portion 254.

Although not limited, the plurality of first lower protrusions 257 may be arranged to be spaced apart from each other in the direction of arrow A.

The first upper protrusion 255 and the first lower protrusion 257 may be disposed at opposite sides with respect to a vertical direction of the second extension portion 254. At least a portion of the first upper protrusion 255 may vertically overlap the second lower protrusion 257.

A plurality of through-holes may be defined in the second extension portion 254.

The plurality of through-holes 256 may include a first through-hole 256*a* through which the first fastening boss 216 of the lower case 210 passes and a second through-hole 256*b* through which the second fastening boss 217 of the lower case 210 passes. For example, the plurality of through-holes 256*a* may be defined to be spaced apart from each other in the direction of the arrow A of FIG. 19.

Also, the plurality of second through-holes 256*b* may be disposed to be spaced apart from each other in the direction of the arrow A of FIG. 19.

The plurality of first through-holes 256*a* and the plurality of second through-holes 256*b* may be disposed at opposite sides with respect to the lower chamber 252.

A portion of the plurality of second through-holes 256*b* may be defined between the two first upper protrusions 255. Also, a portion of the plurality of second through-holes 256*b* may be defined between the two first lower protrusions 257.

The second extension portion 254 may further a second upper protrusion 258. The second upper protrusion 258 may be disposed at an opposite side of the first upper protrusion 255 with respect to the lower chamber 252.

The second upper protrusion 258 may be disposed to be horizontally spaced apart from the circumferential wall 260. For example, the second upper protrusion 258 may protrude upward from a top surface of the second extension portion 254 at a position adjacent to the second wall 260*b*.

Although not limited, the plurality of second upper protrusions 258 may be arranged to be spaced apart from each other in the direction of the arrow A of FIG. 19.

The second upper protrusion 258 may be received in the receiving groove 218*a* of the lower case 210. In the state where the second upper protrusion 258 is received in the receiving groove 218*a*, the second upper protrusion 258 may contact the curved wall 215 of the lower case 210.

The circumferential wall 260 of the lower tray 250 may include a first coupling protrusion 262 coupled to the lower case 210.

The first coupling protrusion 262 may horizontally protrude from the first wall 260*a* of the circumferential wall 260. The first coupling protrusion 262 may be disposed on an upper portion of a side surface of the first wall 260*a*.

The first coupling protrusion 262 may include a neck portion 262*a* having a relatively less diameter when compared to those of other portions. The neck portion 262*a* may be inserted into a first coupling slit 214*b* defined in the circumferential wall 214 of the lower case 210.

The circumferential wall 260 of the lower tray 250 may further include a second coupling protrusion 262*c* coupled to the lower case 210.

The second coupling protrusion 262*c* may horizontally protrude from the second wall 260*a* of the circumferential wall 260. The second coupling protrusion 260*c* may be inserted into a second coupling slit 215*a* defined in the circumferential wall 214 of the lower case 210.

The second extension portion 254 may include a second lower protrusion 266. The second lower protrusion 266 may be disposed at an opposite side of the second lower protrusion 257 with respect to the lower chamber 252.

The second lower protrusion 266 may protrude downward from a bottom surface of the second extension portion 254. For example, the second lower protrusion 266 may linearly extend.

A portion of the plurality of first through-holes 256*a* may be defined between the second lower protrusion 266 and the lower chamber 252.

The second lower protrusion 266 may be received in a guide groove defined in the lower supporter 270, which will be described later.

The second extension portion 254 may further a side restriction portion 264. The side restriction portion 264 restricts horizontal movement of the lower tray 250 in the state where the lower tray 250 is coupled to the lower case 210 and the lower supporter 270.

The side restriction portion 264 laterally protrudes from the second extension portion 254 and has a vertical length greater than a thickness of the second extension portion 254. For example, one portion of the side restriction portion 264 may be disposed higher than the top surface of the second extension portion 254, and the other portion of the side restriction portion 264 may be disposed lower than the bottom surface of the second extension portion 254.

Thus, the one portion of the side restriction portion 264 may contact a side surface of the lower case 210, and the other portion may contact a side surface of the lower supporter 270.

<Lower Supporter>

Figure 23:
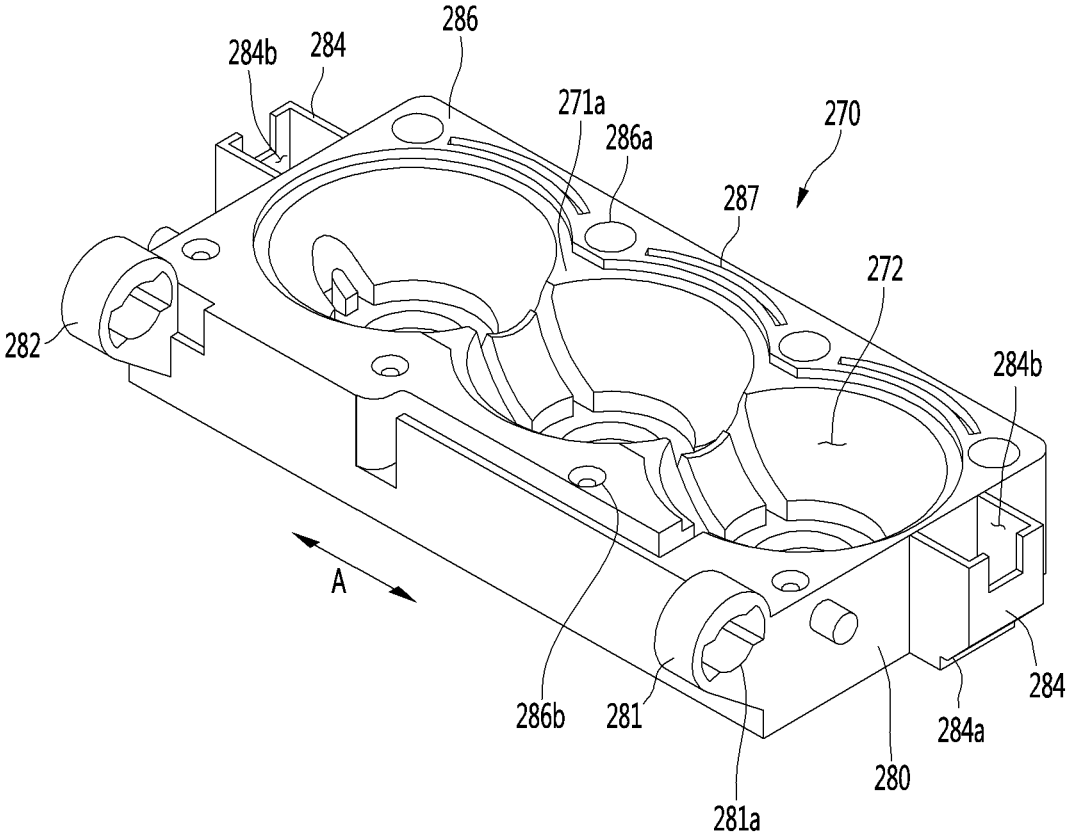
FIG. 23 is a top perspective view illustrating a lower supporter according to one embodiment of the present disclosure.
Figure 24:
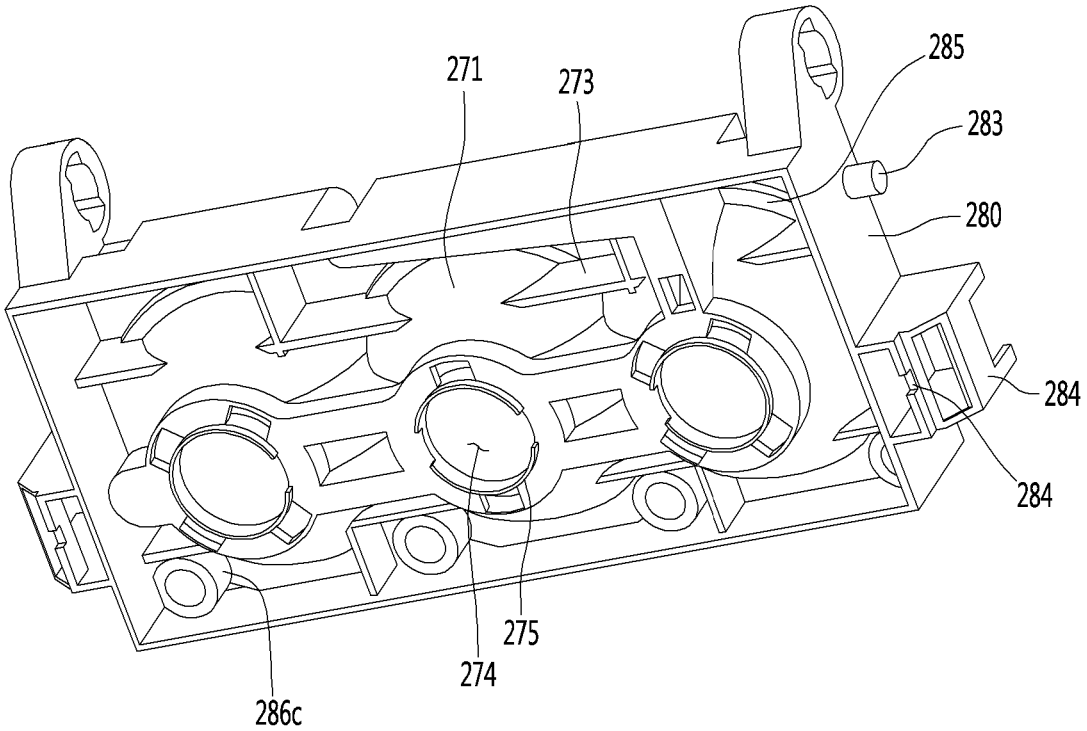
FIG. 24 is a bottom perspective view illustrating the lower supporter according to an embodiment of the present disclosure.
Figure 25:
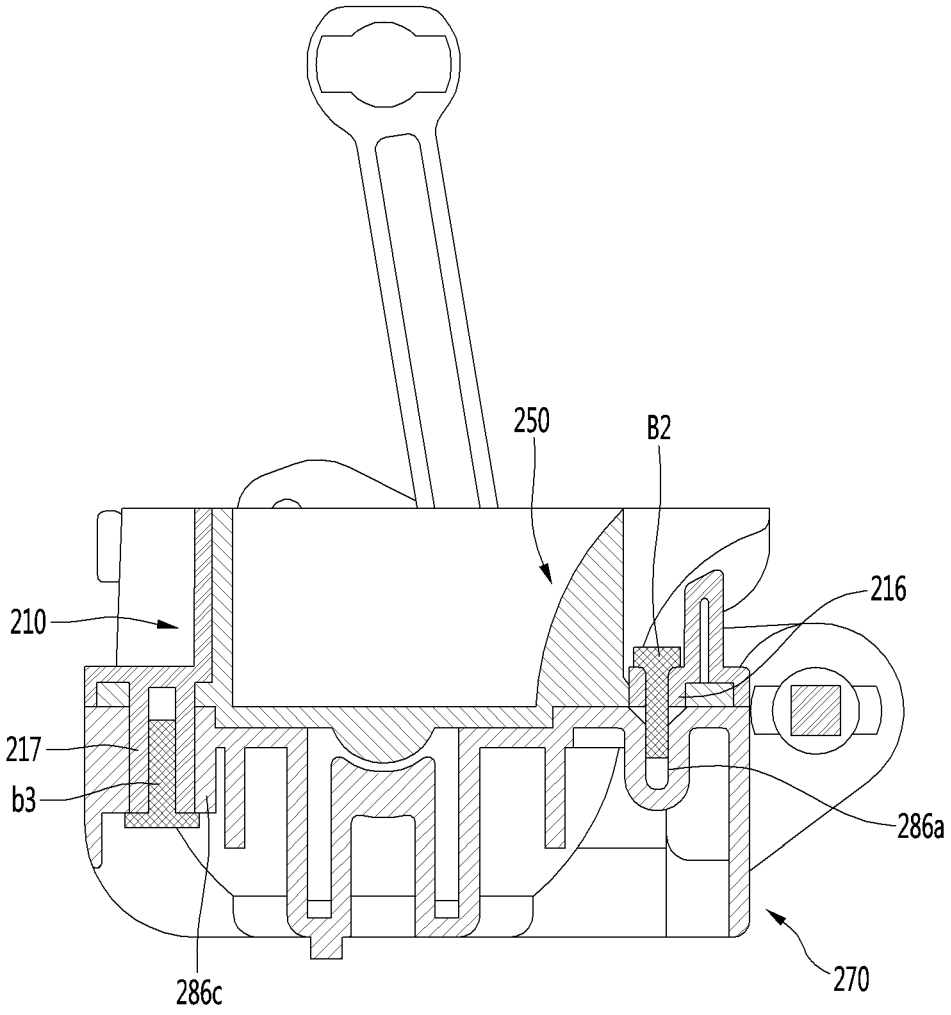
FIG. 25 is a sectional view illustrating a state where the lower assembly is assembled.

FIG. 23 is a top perspective view illustrating a lower supporter according to one embodiment of the present disclosure, FIG. 24 is a bottom perspective view illustrating the lower supporter according to an embodiment of the present disclosure, and FIG. 25 is a sectional view illustrating a state where the lower assembly is assembled.

Referring to FIGS. 23 to 25, the lower supporter 270 may cover more than half of the lower chamber 272 so that the shape of the lower chamber 272 may be maintained in the ice-making process.

The supporter body 271 may include three chamber receiving portions 272 accommodating the three chamber walls 252*d* of the lower tray 250. The chamber receiving portion 272 may have a hemispherical shape.

The supporter body 271 may have a lower opening 274 through which the lower ejector 400 passes during the ice-separation process. For example, three lower openings 274 may be defined to correspond to the three chamber receiving portions 272 in the supporter body 271.

A reinforcement rib 275 reinforcing strength may be disposed along a circumference of the lower opening 274.

Also, the adjacent two chamber walls 252*d* of the three chamber walls 252*d* may be connected to each other by a connection rib 273. The connection rib 273 may reinforce strength of chamber walls 252*d*.

The lower supporter 270 may further include a first extension wall 285 horizontally extending from an upper end of the supporter body 271.

The lower supporter 270 may further include a second extension wall 286 that is formed to be stepped with respect to the first extension wall 285 on an edge of the first extension wall 285.

A top surface of the second extension wall 286 may be disposed higher than the first extension wall 285.

The first extension portion 253 of the lower tray 250 may be seated on a top surface 271*a* of the supporter body 271, and the second extension portion 285 may surround side surface of the first extension portion 253 of the lower tray 250. Here, the second extension wall 286 may contact the side surface of the first extension portion 253 of the lower tray 250.

The lower supporter 270 may further include a first protrusion groove 287 accommodating the first lower protrusion 257 of the lower tray 250.

The first protrusion groove 287 may extend in a curved shape. The first protrusion groove 287 may be defined, for example, in a second extension wall 286.

The lower supporter 270 may further include a first fastening groove 286*a* to which a first fastening member B2 passing through the first fastening boss 216 of the upper case 210 is coupled.

The first fastening groove 286*a* may be provided, for example, in the second extension wall 286.

The plurality of first coupling grooves 286*a* may be disposed to be spaced apart from each other in the direction of the arrow A in the second extension wall 286. A portion of the plurality of first coupling grooves 286*a* may be positioned between the adjacent two first protrusion grooves 287.

The lower supporter 270 may further include a boss through-hole 286*b* through which the second fastening boss 217 of the upper case 210 passes.

The boss through-hole 286*b* may be provided, for example, in the second extension wall 286. A sleeve 286*c* surrounding the second fastening boss 217 passing through the boss through-hole 286*b* may be disposed on the second extension wall 286. The sleeve 286*c* may have a cylindrical shape with an opened lower portion.

The first fastening member B2 may be fastened to the first fastening groove 286*a* after passing through the first fastening boss 216 from an upper side of the lower case 210.

The second fastening member B3 may be fastened to the second fastening boss 217 from a lower side of the lower supporter 270.

The sleeve 286*c* may have a lower end that is disposed at the same height as a lower end of the second fastening boss 217 or disposed at a height lower than that of the lower end of the second fastening boss 217.

Thus, while the second fastening member B3 is coupled, the head portion of the second fastening member B3 may contact bottom surfaces of the second fastening boss 217 and the sleeve 286*c* or may contact a bottom surface of the sleeve 286*c*. The lower supporter 270 may further include an outer wall 280 disposed to surround the lower tray body 251 in a state of being spaced outward from the outside of the lower tray body 251.

The outer wall 280 may, for example, extend downward along an edge of the second extension wall 286.

The lower supporter 270 may further include a plurality of hinge bodies 281 and 282 respectively connected to hinge supporters 135 and 136 of the upper case 210.

The plurality of hinge bodies 281 and 282 may be disposed to be spaced apart from each other in a direction of an arrow A of FIG. 23. Each of the hinge bodies 281 and 282 may further include a second hinge hole 281*a*.

The shaft connection portion 353 of the first link 352 may pass through the second hinge hole 281. The connection shaft 370 may be connected to the shaft connection portion 353.

In addition, the shaft connection portion 353 may be provided with a groove of the polygon on the opposite surface, and the shaft connection portion 353 may be connected by a connection shaft 370 having a polygonal cross-section in which both ends thereof are inserted into the groove.

For example, the shaft connection portion 353 has a groove having a square cross-section on the opposite surface, and the cross-section of the connection shaft 370 may have a square cross-section.

In addition, the first link 352 may be formed so that the shaft coupling portion 352*a* connected to the rotation shaft of the drive unit 180 protrudes on the surface facing the drive unit 180.

The shaft coupling portion 352*a* may form a hollow. In addition, a plurality of reinforcing ribs may be formed around the shaft coupling portion 352*a*.

Therefore, when the drive unit 180 rotates, while the shaft coupling portion 352*a* rotates, the first link 352 rotates. At this time, the first links 352 on both sides may rotate at the same time by the connection shaft 370.

A distance between the plurality of hinge bodies 281 and 282 may be less than that between the plurality of hinge supporters 135 and 136. Thus, the plurality of hinge bodies 281 and 282 may be disposed between the plurality of hinge supporters 135 and 136.

The lower supporter 270 may further include a coupling shaft 283 to which the second link 356 is rotatably coupled. The coupling shaft 283 may be disposed on each of both surfaces of the outer wall 280.

In addition, the lower supporter 270 may further include an elastic member coupling portion 284 to which the elastic member 360 is coupled. The elastic member coupling portion 284 may define a space 284*b* in which a portion of the elastic member 360 is received. Since the elastic member 360 is received in the elastic member coupling portion 284 to prevent the elastic member 360 from interfering with the surrounding structure.

In addition, the elastic member coupling portion 284 may include a hook portion 284*a* on which a lower end of the elastic member 370 is hooked.

<Coupling Structure of Lower Heater>

Figure 26:
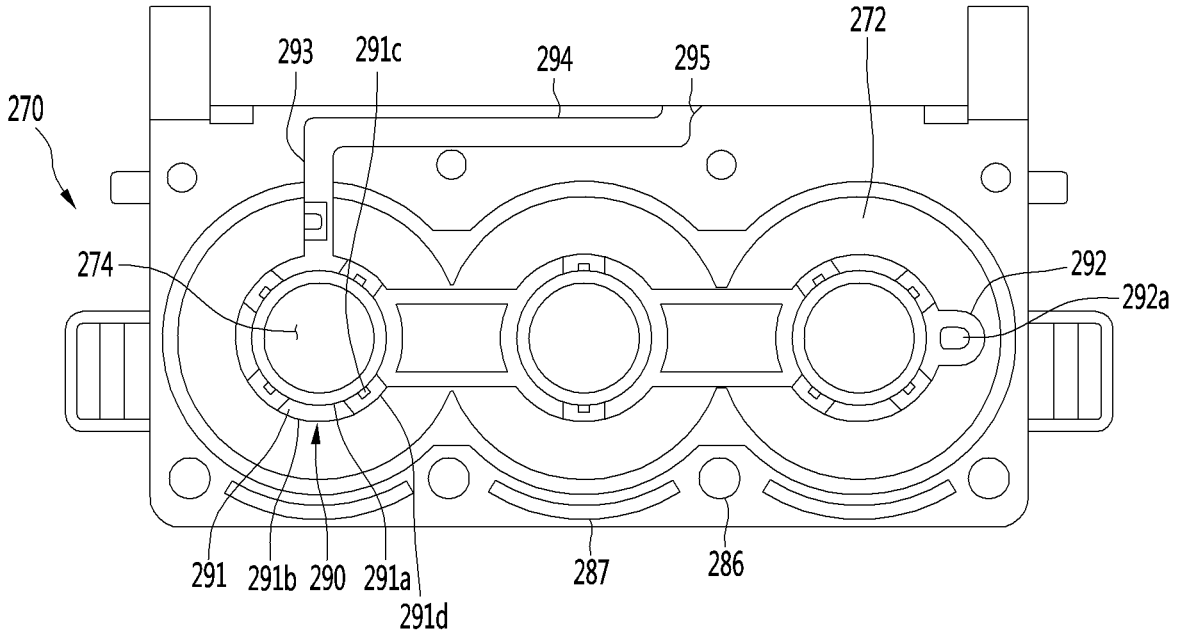
FIG. 26 is a plan view illustrating a lower supporter according to one embodiment of the present disclosure.
Figure 27:
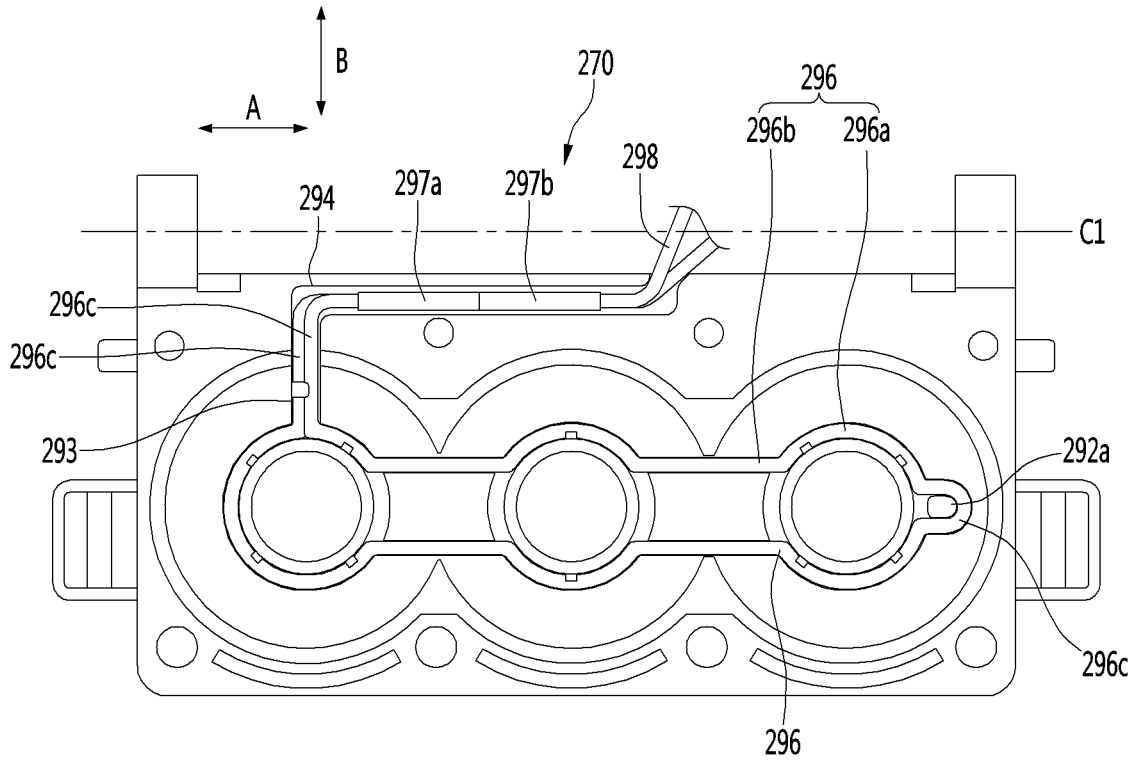
FIG. 27 is a perspective view illustrating a state where a lower heater is coupled to a lower supporter of FIG. 26.
Figure 28:
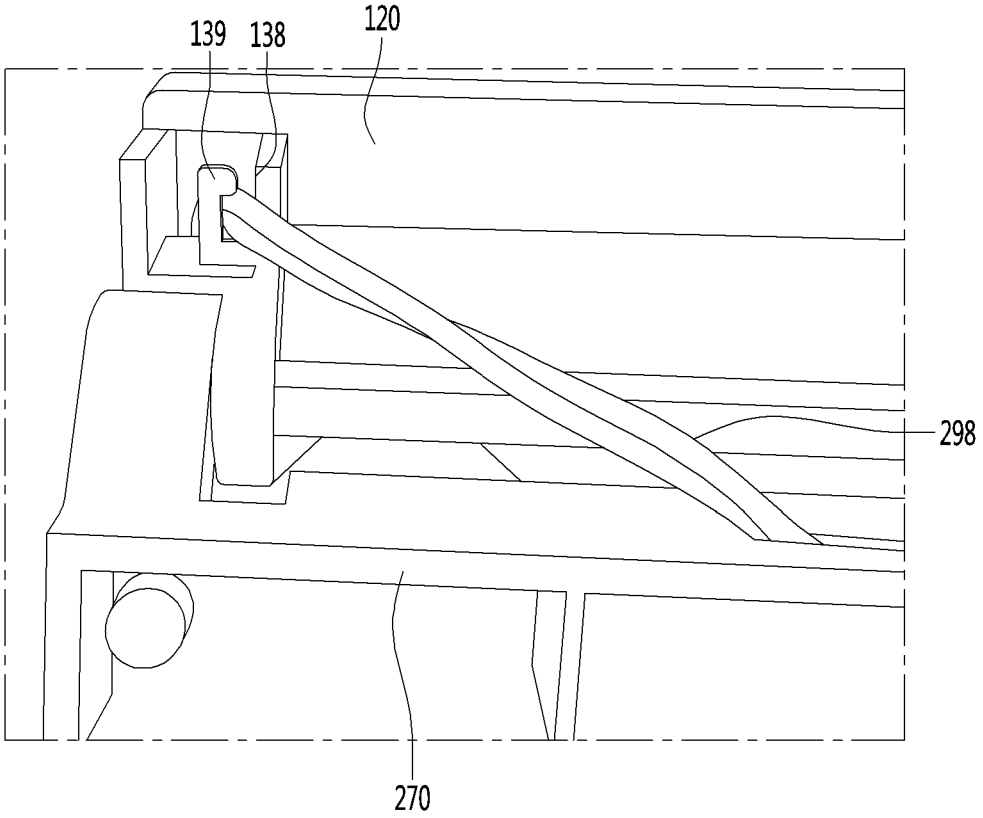
FIG. 28 is a view illustrating a state where a lower assembly is coupled to an upper assembly and, at the same time, an electric wire connected to a lower heater penetrates an upper case.

FIG. 26 is a plan view illustrating a lower supporter according to one embodiment of the present disclosure, FIG. 27 is a perspective view illustrating a state where a lower heater is coupled to a lower supporter of FIG. 26, and FIG. 28 is a view illustrating a state where a lower assembly is coupled to an upper assembly and, at the same time, an electric wire connected to a lower heater penetrates an upper case.

Referring to FIGS. 26 to 28, the ice maker 100 according to this embodiment may further include a lower heater 296 for applying heat to the lower tray 250 during the ice-making process.

The lower heater 297 may provide the heat to the lower chamber 252 during the ice-making process so that ice within the ice chamber 111 is frozen from an upper side.

Also, since lower heater 296 generates heat in the ice-making process, bubbles within the ice chamber 111 may move downward during the ice-making process. When the ice is completely made, a remaining portion of the spherical ice except for the lowermost portion of the ice may be transparent. According to this embodiment, the spherical ice that is substantially transparent may be made.

For example, the lower heater 296 may be a wire-type heater.

The lower heater 296 may be installed on the lower supporter 270. Also, the lower heater 296 may contact the lower tray 250 to provide heat to the lower chamber 252.

For example, the lower heater 296 may contact the lower tray body 251. Also, the lower heater 296 may be disposed to surround the three chamber walls 252*d* of the lower tray body 251.

The lower supporter 270 may further include a heater coupling portion 290 to which the lower heater 296 is coupled.

The heater coupling portion 290 may include a heater receiving groove 291 that is recessed downward from the chamber receiving portion 272 of the lower tray body 251.

Since the heater receiving groove 291 is recessed, the heater coupling portion 290 may include an inner wall 291*a* and an outer wall 291*b*.

The inner wall 291*a* may have, for example, a ring shape, and the outer wall 291*b* may be disposed to surround the inner wall 291*a*.

When the lower heater 296 is received in the heater receiving groove 291, the lower heater 296 may surround at least a portion of the inner wall 291*a*.

The lower opening 274 may be defined in a region defined by the inner wall 291*a*. Thus, when the chamber wall 252*d* of the lower tray 250 is received in the chamber receiving portion 272, the chamber wall 252*d* may contact a top surface of the inner wall 291*a*. The top surface of the inner wall 291*a* may be a rounded surface corresponding to the chamber wall 252*d* having the hemispherical shape.

The lower heater may have a diameter greater than a recessed depth of the heater receiving groove 291 so that a portion of the lower heater 296 protrudes to the outside of the heater receiving groove 291 in the state where the lower heater 296 is received in the heater receiving groove 291.

A separation prevention protrusion 291*c* may be provided on one of the outer wall 291*b* and the inner wall 291*a* to prevent the lower heater 296 received in the heater receiving groove 291 from being separated from the heater receiving groove 291.

In FIG. 26, the separation prevention protrusions 291*c* is provided on the inner wall 291*a*.

Since the inner wall 291*a* has a diameter less than that of the chamber receiving portion 272, the lower heater 196 may move along a surface of the chamber receiving portion 272 and then be received in the heater receiving groove 291 in a process of assembling the lower heater 196.

In other words, the lower heater 196 is received in the heater receiving groove 291 from an upper side of the outer wall 291*a* toward the inner wall 291*a*. Thus, the separation prevention protrusion 291*c* may be disposed on the inner wall 291*a* to prevent the lower heater 196 from interfering with the separation prevention protrusion 291*c* while the lower heater 196 is received in the heater receiving groove 291.

The separation prevention protrusion 291*c* may protrude from an upper end of the inner wall 291*a* toward the outer wall 291*b*. A protruding length of the separation prevention protrusion 291*c* may be about ½ of a distance between the outer wall 291*b* and the inner wall 291*a*.

As illustrated in FIG. 27, in the state where the lower heater 296 is received in the heater receiving groove 291, the lower heater 296 may be divided into a lower rounded portion 296*a* and a linear portion 296*b*.

The rounded portion 296*a* may be a portion disposed along the circumference of the lower chamber 252 and also a portion that is bent to be rounded in a horizontal direction.

The liner portion 296*b* may be a portion connecting the rounded portions 296*a* corresponding to the lower chambers 252 to each other.

Since the rounded portion 296*a* of the lower heater 296 may be separated from the heater receiving groove 291, the separation prevention protrusion 291*c* may be disposed to contact the rounded portion 296*a*.

A through-opening 291*d* may be defined in a bottom surface of the heater receiving groove 291. When the lower heater 296 is received in the heater receiving groove 291, a portion of the upper heater 296 may be disposed in the through-opening 291*d*. For example, the through-opening 291*d* may be defined in a portion of the lower heater 296 facing the separation prevention protrusion 291*c*.

When the lower heater 296 is bent to be horizontally rounded, tension of the lower heater 296 may increase to cause disconnection, and also, the lower heater 296 may be separated from the heater receiving groove 291.

However, when the through-opening 291*d* is defined in the heater receiving groove 291 like this embodiment, a portion of the lower heater 296 may be disposed in the through-opening 291*d* to reduce the tension of the lower heater 296, thereby preventing the heater receiving groove 291 from being separated from the lower heater 296.

The lower supporter 270 may include a first guide groove 293 guiding a power input terminal 296*c* and a power output terminal of the lower heater 296 received in the heater receiving groove 291 and a second guide groove 294 extending in a direction crossing the first guide groove 293.

For example, the first guide groove 293 may extend in a direction of an arrow B in the heater receiving portion 291.

In addition, the second guide groove 294 may extend from an end of the first guide groove 293 in a direction of an arrow A. In this embodiment, the direction of the arrow A may be a direction that is parallel to the extension direction of a rotational central axis C1 of the lower assembly.

Referring to FIG. 27, the first guide groove 293 may extend from one of the left and right chamber receiving portions except for the intermediate chamber receiving portion of the three chamber receiving portions.

For example, in FIG. 27, the first guide groove 293 extends from the chamber receiving portion, which is disposed at the left side, of the three chamber receiving portions.

As illustrated in FIG. 27, in a state where the power input terminal 296*c* and the power output terminal 296*d* of the lower heater 296 are disposed in parallel to each other, the lower heater 296 may be received in the first guide groove 293.

The power output terminal 296*c* and the power output terminal 296*d* of the lower heater 296 may be connected to one first connector 297*a*.

In addition, a second connector 297*b* to which two wires 298 connected to correspond to the power input terminal 296*a* and the power output terminal 296*b* are connected may be connected to the first connector 297*a*.

In this embodiment, in the state where the first connector 297*a* and the second connector 297*b* are connected to each other, the first connector 297*a* and the second connector 297*b* are received in the second guide groove 294.

In addition, the electric wire 298 connected to the second connector 297*b* is led out from the end of the second guide groove 294 to the outside of the lower supporter 270 through an lead-out slot 295 defined in the lower supporter 270.

According to this embodiment, since the first connector 297*a* and the second connector 297*b* are received in the second guide groove 294, the first connector 297*a* and the second connector 297*b* are not exposed to the outside when the lower assembly 200 is completely assembled.

As described above, the first connector 297*a* and the second connector 297*b* may not be exposed to the outside to prevent the first connector 297*a* and the second connector 297*b* from interfering with the surrounding structure while the lower assembly 200 rotates and prevent the first connector 297*a* and the second connector 297*b* from being separated.

In addition, since the first connector 297*a* and the second connector 297*b* are received in the second guide groove 294, one portion of the electric wire 298 may be disposed in the second guide groove 294, and the other portion may be disposed outside the lower supporter 270 by the lead-out slot 295.

Here, since the second guide groove 294 extends in a direction parallel to the rotational central axis C1 of the lower assembly 200, one portion of the electric wire 298 may extend in the direction parallel to the rotational central axis C1.

The other portion of the electric wire 298 may extend from the outside of the lower supporter 270 in a direction crossing the rotational central axis C1.

According to the arrangement of the electric wires 298, tensile force may not merely act on the wires 298, but torsion force may act on the electric wires 298 during the rotation of the lower assembly 200.

When compared that the tensile force acts on the electric wire 298, if the torsion acts on the electric wire 298, possibility of disconnection of the electric wire 298 may be very little.

According to this embodiment, while the lower assembly 200 rotates, the lower heater 296 may be maintained at a fixed position, and twisting force may act on the electric wire 298 to prevent the lower heater 296 from being damaged and disconnected.

The power input terminal 296*c* and the power output terminal 296*d* of the lower heater 296 are disposed in the first guide groove 293. Here, since heat is also generated in the power input terminal 296*c* and the power output terminal 296*d*, heat provided to the left chamber receiving portion to which the first guide groove 293 extends may be greater than that provided to other chamber receiving portions.

In this case, if magnitude of the heat provided to each chamber receiving portion is different, transparency of the made spherical ice after the ice-making process and the ice-separation process may be changed for each ice.

Thus, a detour receiving groove 292 may be further provided in the chamber receiving portion (for example, the right chamber receiving portion), which is disposed farthest from the first guide groove 292, of the three chamber receiving portions to minimize a difference in transparency for each ice.

For example, the detour receiving groove 292 may extend outward from the heater receiving groove 291 and then be bent so as to be disposed in a shape that is connected to the heater receiving groove 291.

When a portion 296*e* of the lower heater 291 is additionally received in the detour receiving groove 292, a contact area between the chamber wall received in the right chamber receiving portion 272 and the lower heater 296 may increase.

Thus, a protrusion 292*a* for fixing a position of the lower heater received in the detour receiving groove 292 may be additionally provided in the right chamber receiving portion 272. Referring to FIG. 28, in the state where the lower assembly 200 is coupled to the upper case 120 of the upper assembly 110, the wire 298 led out to the outside of the lower supporter 270 may pass through a wire through-slot 138 defined in the upper case 120 to extend upward from the upper case 120.

A restriction guide 139 for restricting the movement of the electric wire 298 passing through the electric wire through-slot 138 may be provided in the electric wire through-slot 138. The restriction guide 139 may have a shape that is bent several times, and the electric wire 298 may be disposed in a region defined by the restriction guide 139.

Figure 29:
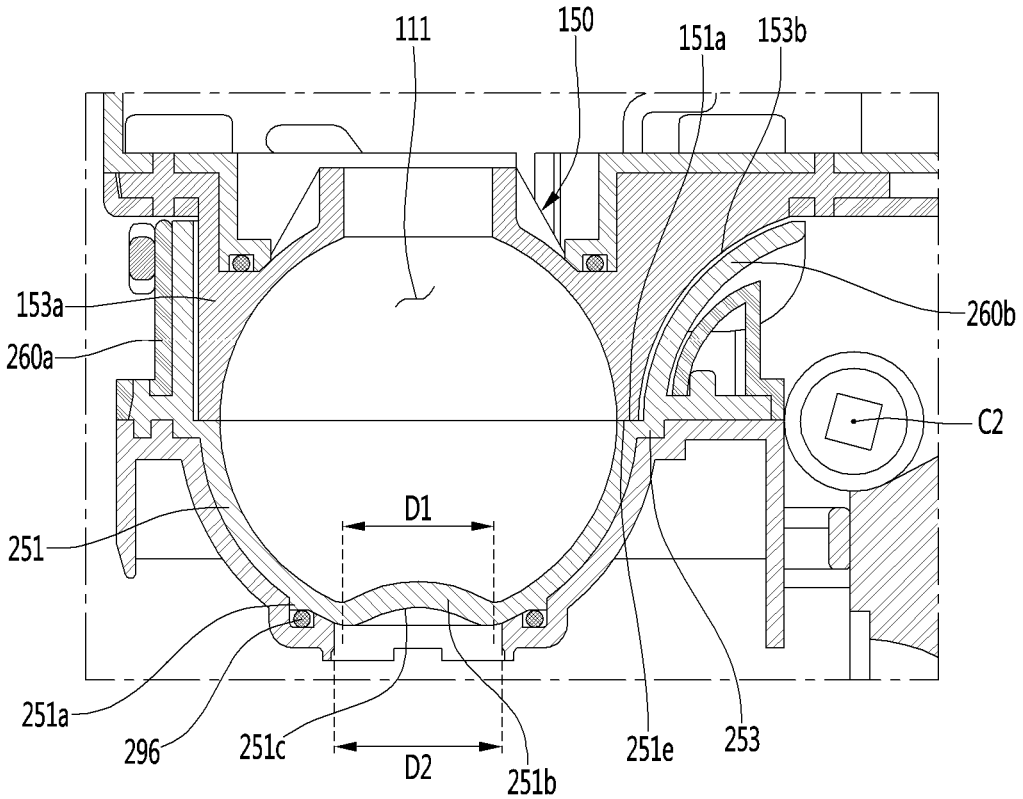
FIG. 29 is a cross-sectional view taken along line A-A of FIG. 3A.
Figure 30:
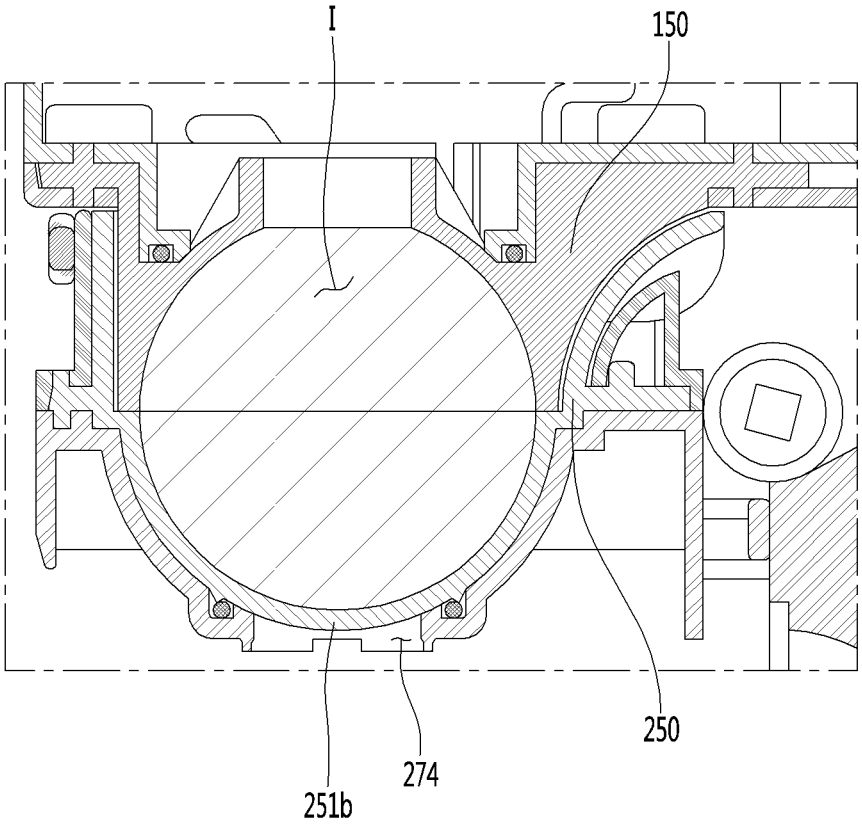
FIG. 30 is a view illustrating a state where ice generation is completed in FIG. 29.

FIG. 29 is a cross-sectional view taken along line A-A of FIG. 3A, and FIG. 30 is a view illustrating a state where ice generation is completed in FIG. 29.

In FIG. 29, a state where the upper tray and the lower tray contact each other is illustrated.

Firstly, referring to FIG. 29, the upper tray 150 and the lower tray 250 vertically contact each other to complete the ice chamber 111.

The bottom surface 151*a* of the upper tray body 151 contacts the top surface 251*e* of the lower tray body 251.

Here, in the state where the top surface 251*e* of the lower tray body 251 contacts the bottom surface 151*a* of the upper tray body 151, the elastic force of the elastic member 360 is applied to the lower supporter 270.

The elastic force of the elastic member 360 may be applied to the lower tray 250 by the lower supporter 270, and thus, the top surface 251*e* of the lower tray body 251 may press the bottom surface 151*a* of the upper tray body 151.

Thus, in the state where the top surface 251*e* of the lower tray body 251 contacts the bottom surface 151*a* of the upper tray body 151, the surfaces may be pressed with respect to each other to improve the adhesion.

As described above, when the adhesion between the top surface 251*e* of the lower tray body 251 and the bottom surface 151*a* of the upper tray increases, a gap between the two surfaces may not occur to prevent ice having a thin band shape along a circumference of the spherical ice from being made after the ice-making is completed.

The first extension portion 253 of the lower tray 250 is seated on the top surface 271*a* of the supporter body 271 of the lower supporter 270. In addition, the second extension wall 286 of the lower supporter 270 contacts a side surface of the first extension portion 253 of the lower tray 250.

The second extension portion 254 of the lower tray 250 may be seated on the second extension wall 286 of the lower supporter 270.

In the state where the bottom surface 151*a* of the upper tray body 151 is seated on the top surface 251*e* of the lower tray body 251, the upper tray body 151 may be received in an inner space of the circumferential wall 260 of the lower tray 250.

Here, the vertical wall 153*a* of the upper tray body 151 may be disposed to face the vertical wall 260*a* of the lower tray 250, and the curved wall 153*b* of the upper tray body 151 may be disposed to face the curved wall 260*b* of the lower tray 250.

An outer face of the chamber wall 153 of the upper tray body 151 is spaced apart from an inner face of the circumferential wall 260 of the lower tray 250. In other words, a space may be defined between the outer face of the chamber wall 153 of the upper tray body 151 and the inner face of the circumferential wall 260 of the lower tray 250.

Water supplied through the water supply portion 180 is received in the ice chamber 111. When a relatively large amount of water than a volume of the ice chamber 111 is supplied, water that is not received in the ice chamber 111 may flow into the space between the outer face of the chamber wall 153 of the upper tray body 151 and the inner face of the circumferential wall 260 of the lower tray 250.

Thus, according to this embodiment, even though a relatively large amount of water than the volume of the ice chamber 111 is supplied, the water may be prevented from overflowing from the ice maker 100.

Meanwhile, a heater contact portion 251*a* for allowing the contact area with the lower heater 296 to increase may be further provided on the lower tray body 251.

The heater contact portion 251*a* may protrude from the bottom face of the lower tray body 251. For example, the heater contact portion 251*a* may be formed in a ring shape on a lower surface of the lower tray body 251. In addition, the bottom surface of the heater contact portion 251*a* may be a flat surface.

The lower tray body 251 may further include a convex portion 251*b* in which a portion of the lower portion of the lower tray body 251 is convex upward. In other words, the convex portion 251*b* may be disposed to be convex toward the inside of the ice chamber 111.

A recessed portion 251*c* may be defined below the convex portion 251*b* so that the convex portion 251*b* has substantially the same thickness as the other portion of the lower tray body 251.

In this specification, the "substantially the same" is a concept that includes completely the same shape and a shape that is not similar but there is little difference.

The convex portion 251*b* may be disposed to vertically face the lower opening 274 of the lower supporter 270.

In addition, the lower opening 274 may be defined just below the lower chamber 252. In other words, the lower opening 274 may be defined just below the convex portion 251*b*.

The convex portion 251*b* may have a diameter D1 less than that D2 of the lower opening 274.

When cold air is supplied to the ice chamber 111 in the state where the water is supplied to the ice chamber 111, the liquid water is phase-changed into solid ice. Here, the water may be expanded while the water is changed in phase. The expansive force of the water may be transmitted to each of the upper tray body 151 and the lower tray body 251.

In a case of this embodiment, although other portions of the lower tray body 251 are surrounded by the supporter body 271, a portion (hereinafter, referred to as a "corresponding portion") corresponding to the lower opening 274 of the supporter body 271 is not surrounded.

If the lower tray body 251 has a complete hemispherical shape, when the expansive force of the water is applied to the corresponding portion of the lower tray body 251 corresponding to the lower opening 274, the corresponding portion of the lower tray body 251 is deformed toward the lower opening 274.

In this case, although the water supplied to the ice chamber 111 exists in the spherical shape before the ice is made, the corresponding portion of the lower tray body 251 is deformed after the ice is made. Thus, additional ice having a projection shape may be made from the spherical ice by a space occurring by the deformation of the corresponding portion.

Thus, in this embodiment, the convex portion 251*b* may be disposed on the lower tray body 251 in consideration of the deformation of the lower tray body 251 so that the ice has the completely spherical shape.

In this embodiment, the water supplied to the ice chamber 111 may not have a spherical shape before the ice is made. However, after the ice is completely made, the convex portion 251*b* of the lower tray body 251 may move toward the lower opening 274, and thus, the spherical ice may be made.

In the present embodiment, since the diameter D1 of the convex portion 251*b* is smaller than the diameter D2 of the lower opening 274, the convex portion 251*b* may be deformed to be located inside of the lower opening 274.

<Upper Ejector>

Hereinafter, with reference to the drawings, the structure of the upper ejector and the interlocking structure of the upper assembly and the lower assembly will be described in more detail.

Figure 31:
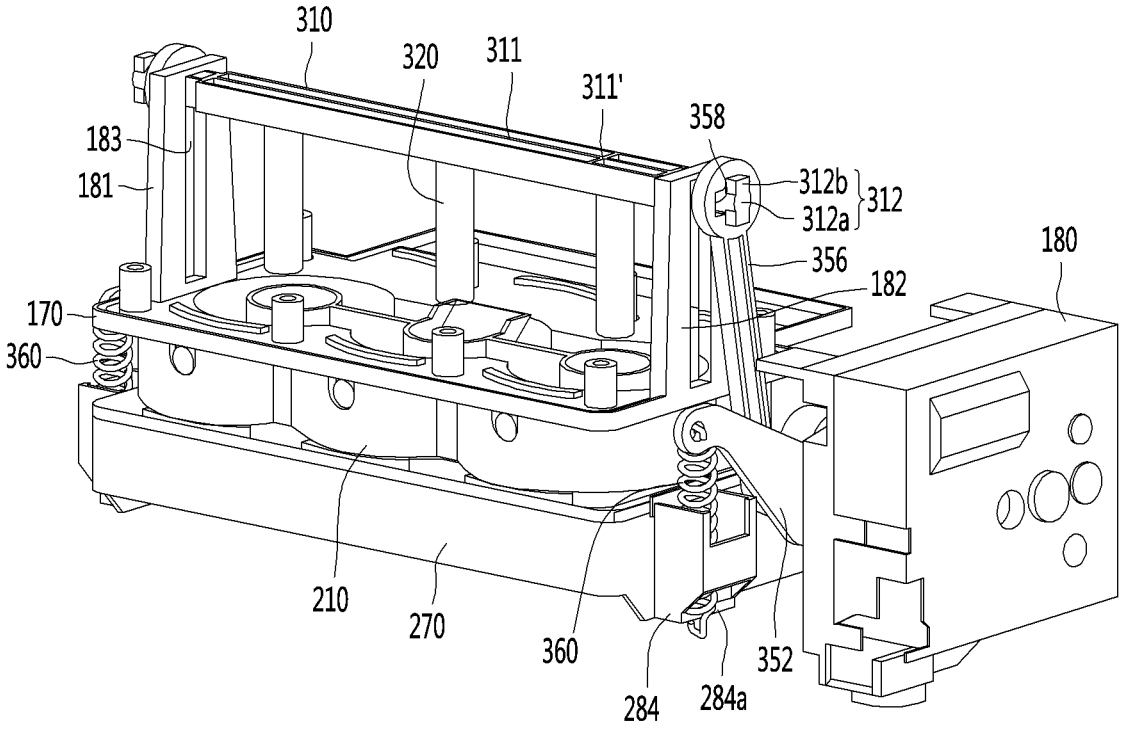
FIG. 31 is a perspective view illustrating the ice maker from which the upper case is removed as viewed from a side.
Figure 32:
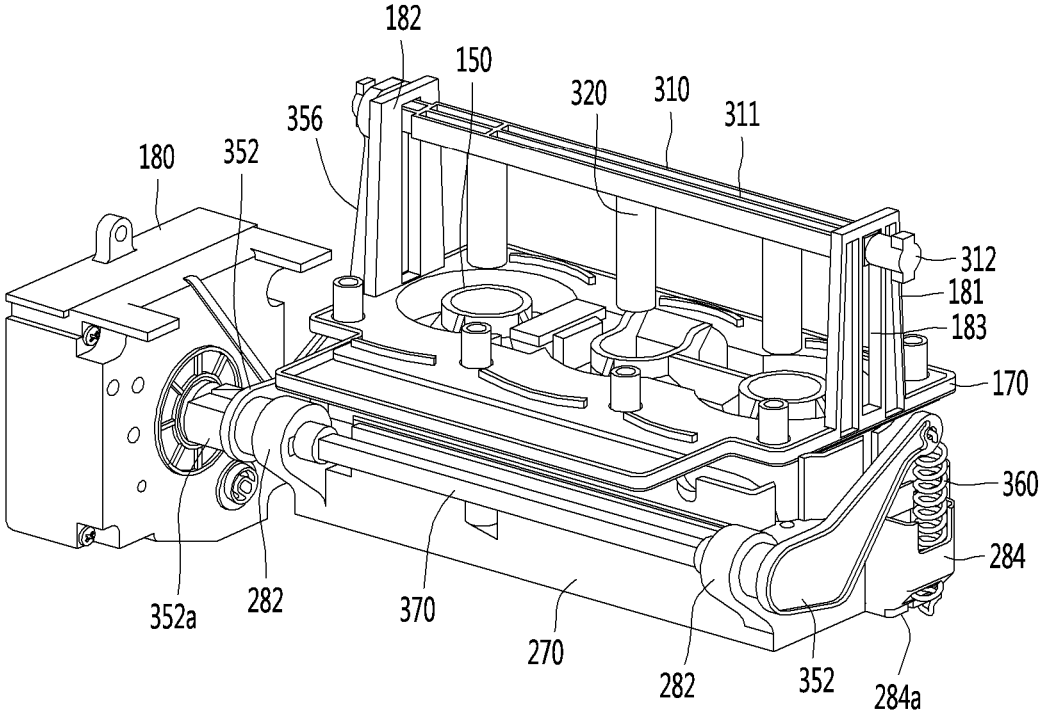
FIG. 32 is a perspective view illustrating the ice maker from which the upper case is removed as viewed from the other side.

FIG. 31 is a perspective view illustrating the ice maker from which the upper case is removed as viewed from a side, and FIG. 32 is a perspective view illustrating the ice maker from which the upper case is removed as viewed from the other side.

Figure 33:
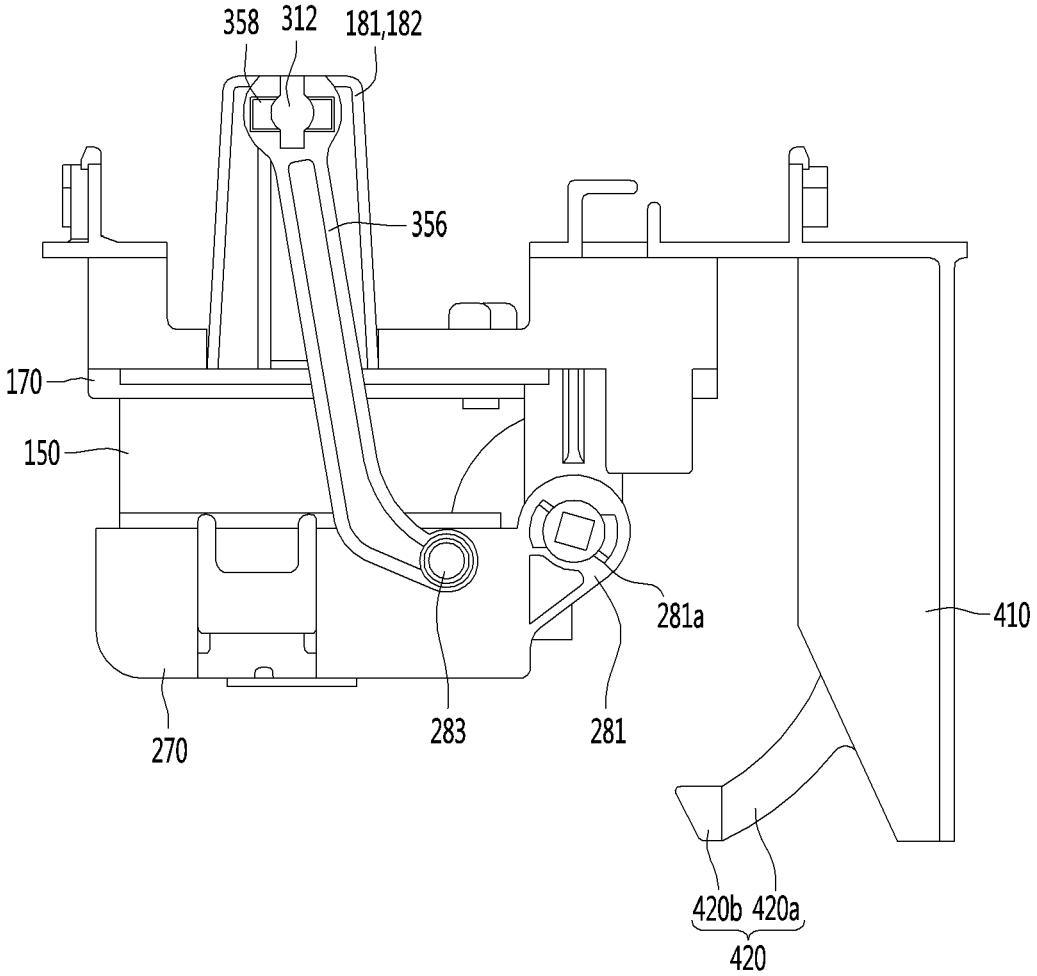
FIG. 33 is a side view illustrating a state of the lower tray and the upper ejector.
Figure 34:
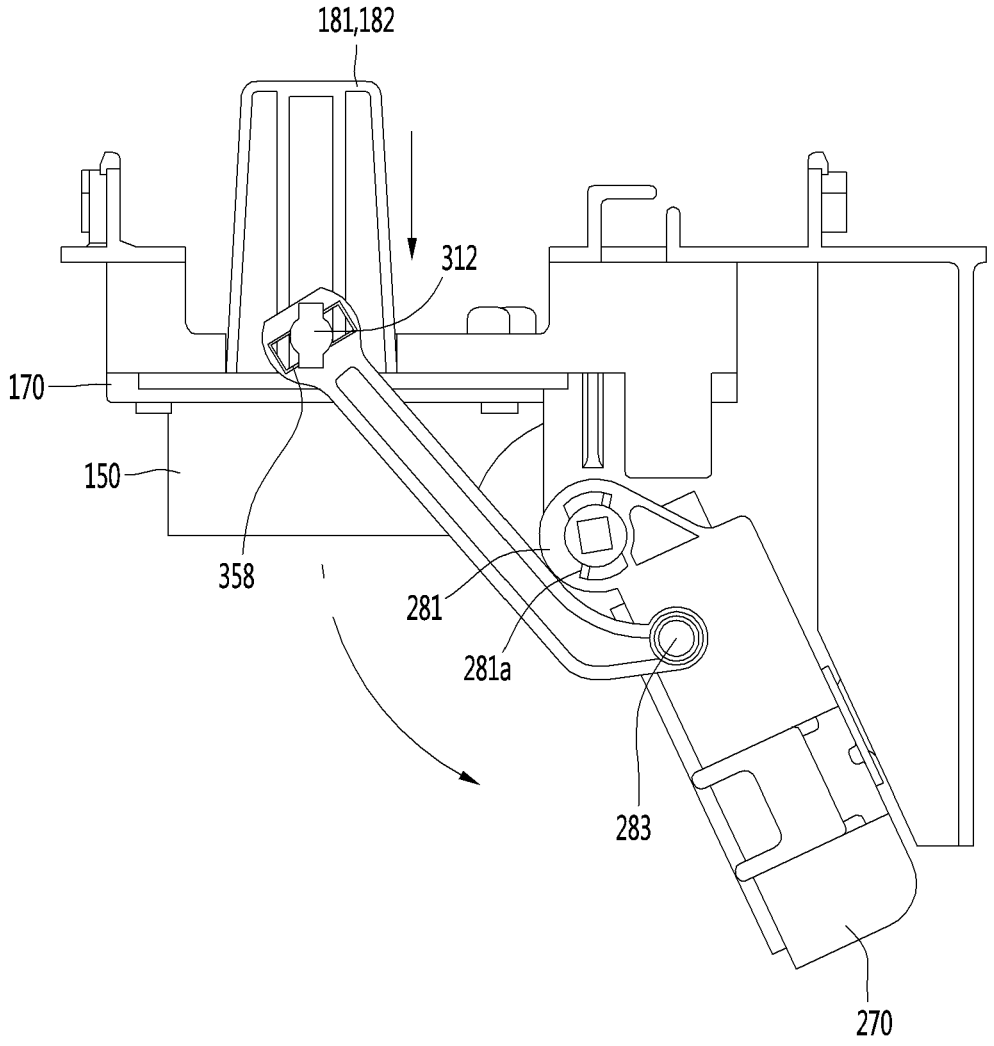
FIG. 34 is a side view illustrating a state where the lower tray is rotated and the upper ejector is lowered in the state of FIG. 33.
Figure 35A:
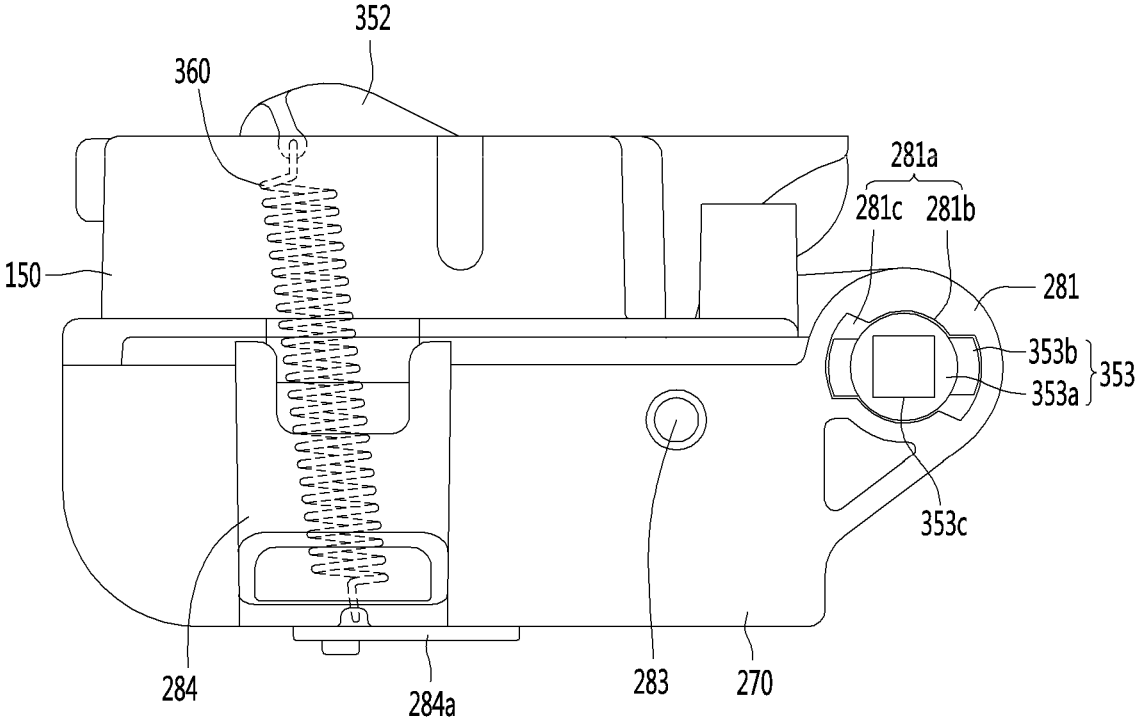
FIGS. 35A to 35B are side views illustrating a state of the additional rotation operation of the lower tray.
Figure 35B:
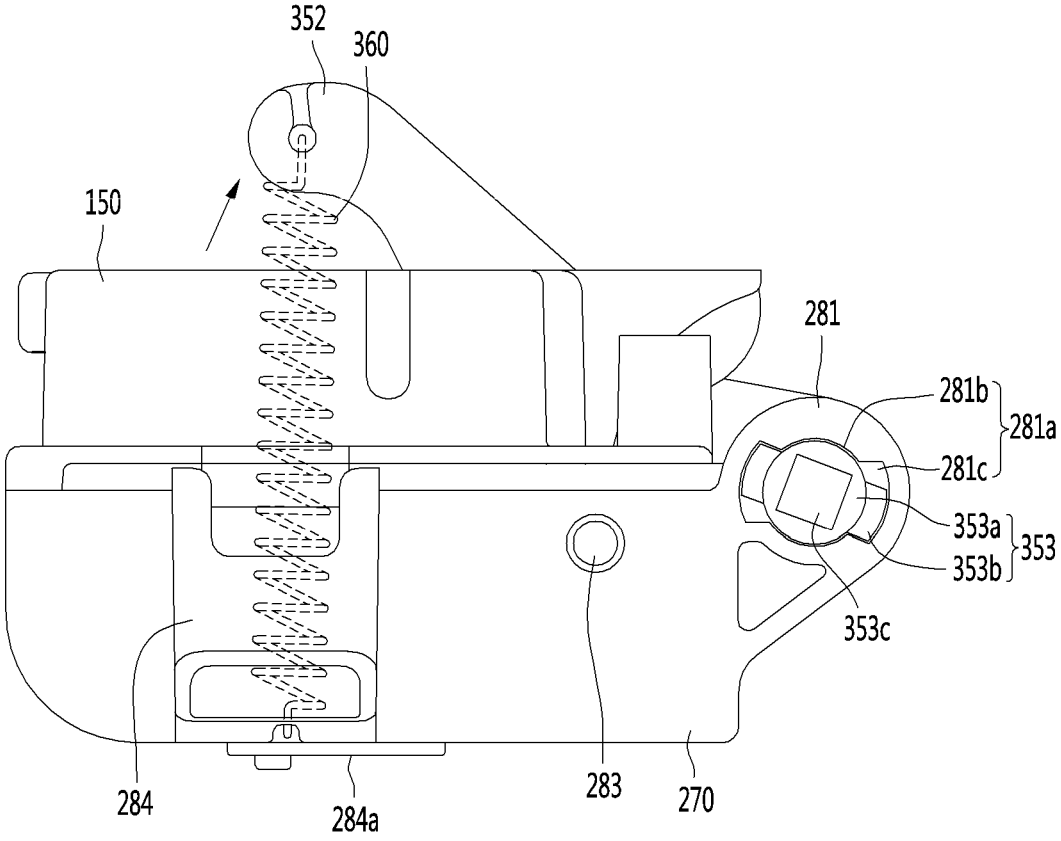
Figure 36A:
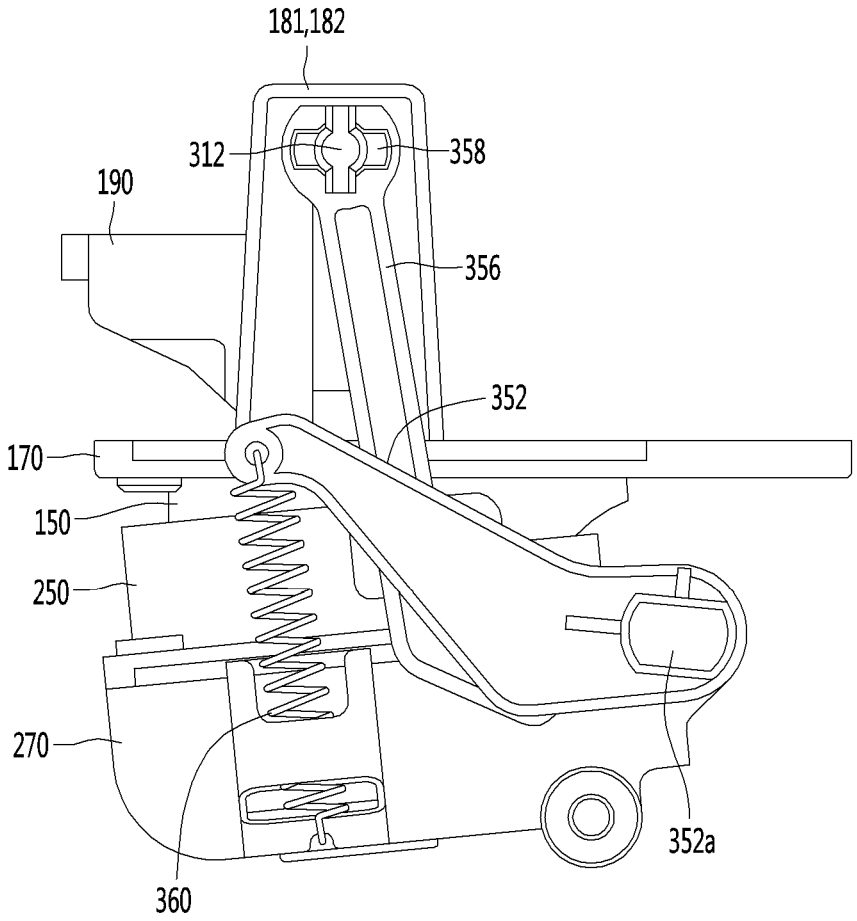
FIG. 36A to 36C is a side view illustrating the position of the lower tray according to the rotation angle of the first link.
Figure 36B:
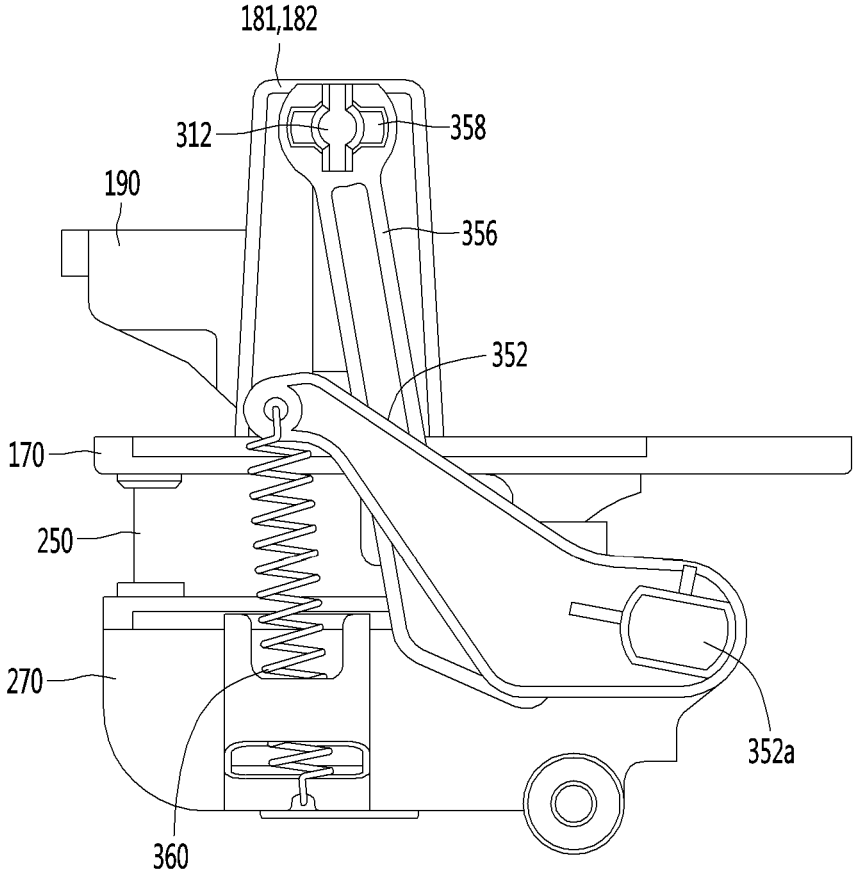
Figure 36C:
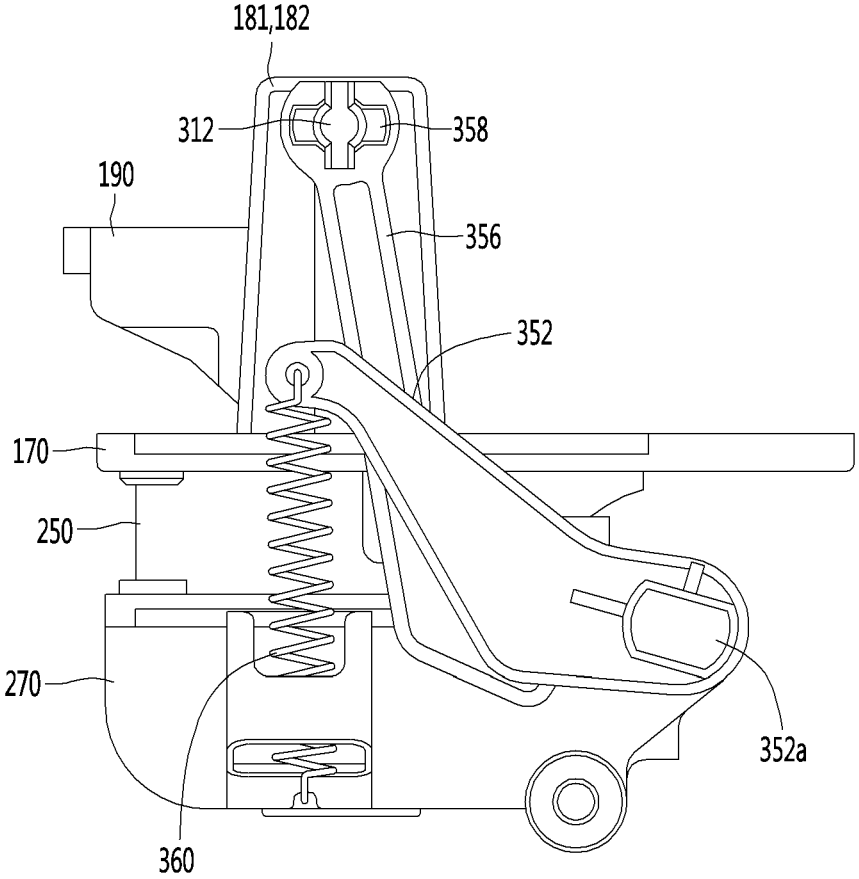
Figure 37:
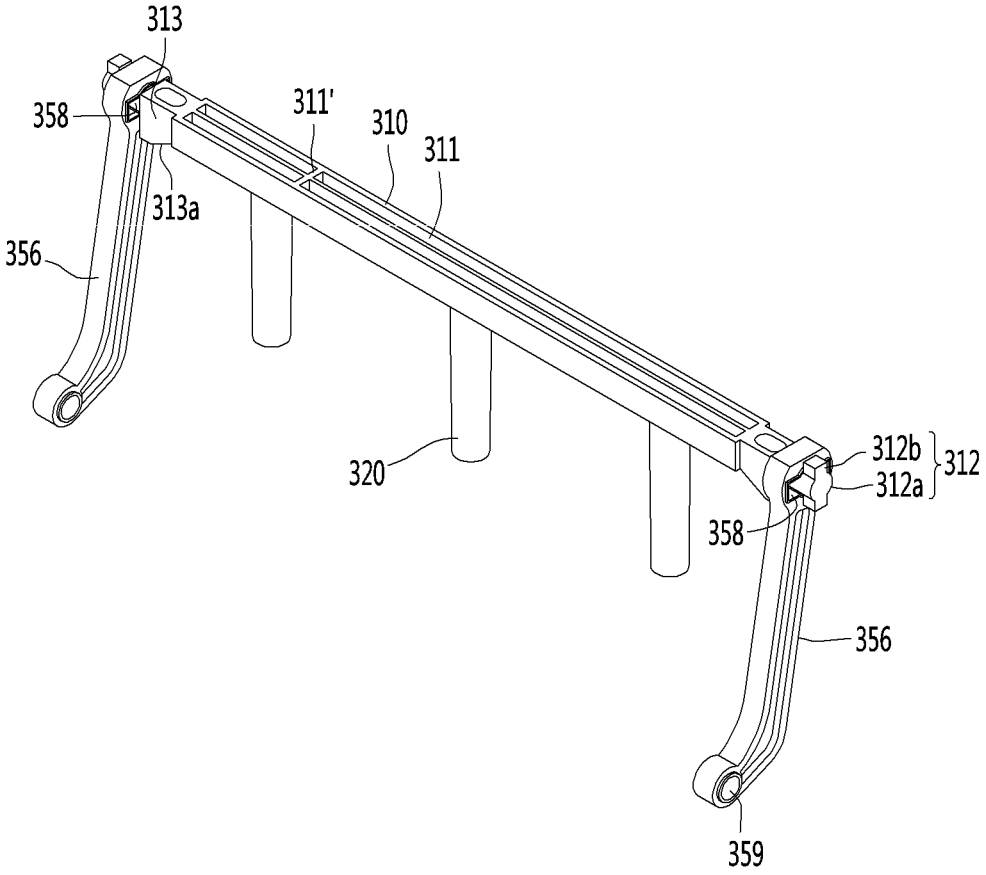
FIG. 37 is a perspective view illustrating a coupling state of the upper ejector and the second link.
Figure 38:
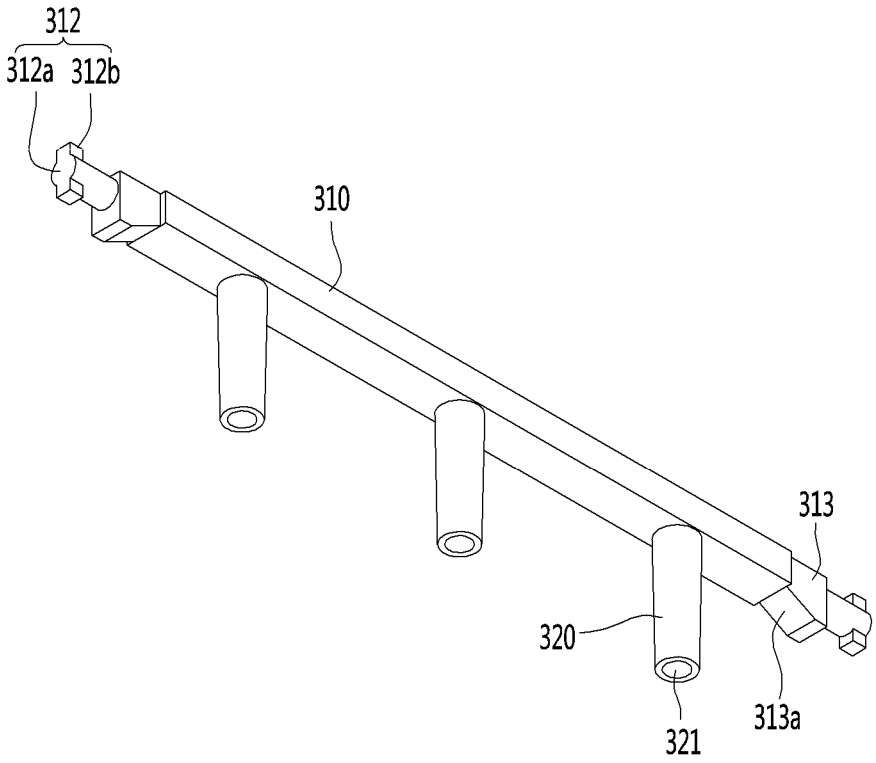
FIG. 38 is a bottom perspective view illustrating the upper ejector.
Figure 39:
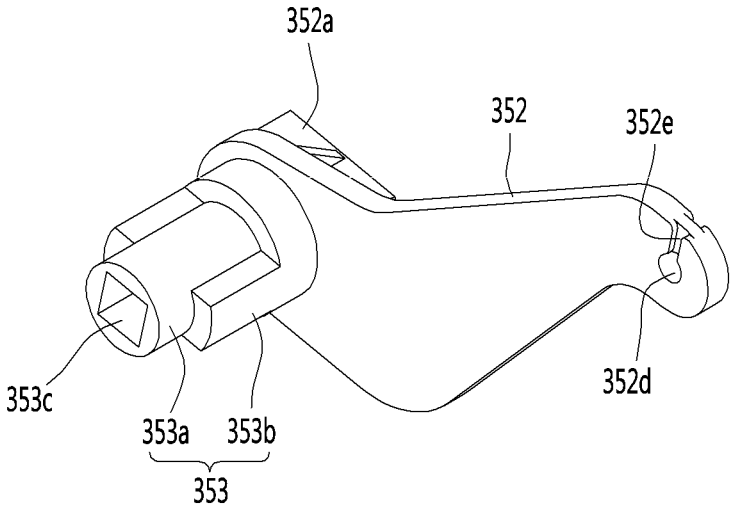
FIG. 39 is a perspective view illustrating the first link viewed from one side.
Figure 40:
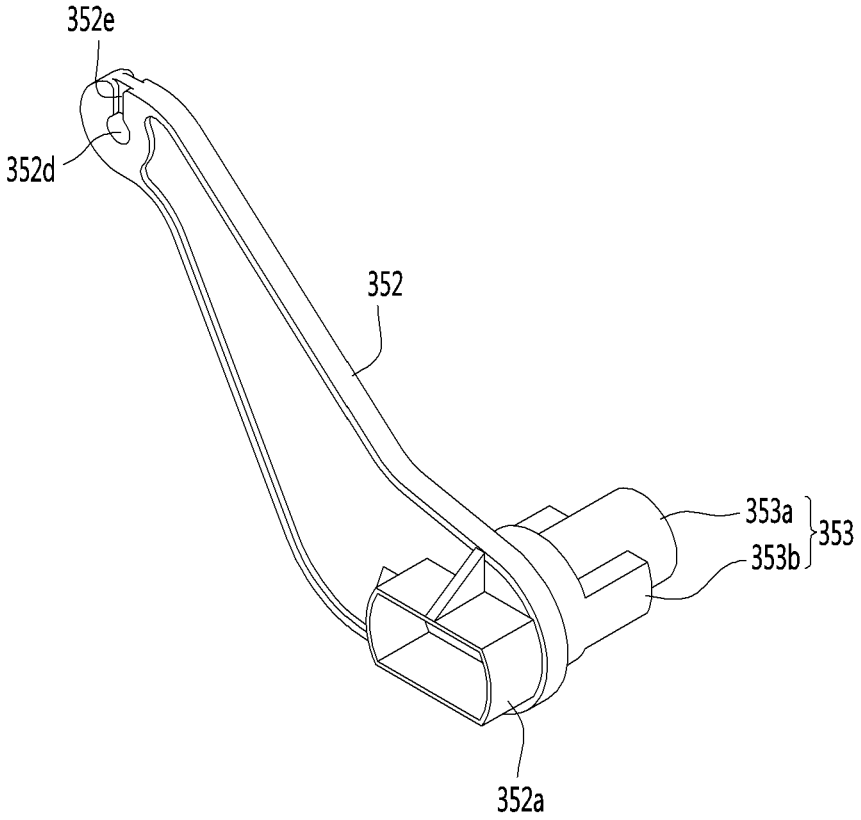
FIG. 40 is a perspective view illustrating the second link as viewed from the other side.

FIG. 33 is a side view illustrating a state of the lower tray and the upper ejector, FIG. 34 is a side view illustrating a state where the lower tray is rotated and the upper ejector is lowered in the state of FIG. 33, FIGS. 35*a* to 35*b* are side views illustrating a state of the additional rotation operation of the lower tray, FIG. 36A to 36*c* is a side view illustrating the position of the lower tray according to the rotation angle of the first link, FIG. 36A to 36C is a side view illustrating a state where the lower tray is further rotated by the elastic member, FIG. 37 is a perspective view illustrating a coupling state of the upper ejector and the second link, FIG. 38 is a bottom perspective view illustrating the upper ejector, FIG. 39 is a perspective view illustrating the first link viewed from one side, and FIG. 40 is a perspective view illustrating the second link as viewed from the other side.

As illustrated, the ice maker 100 according to the present disclosure may further include an upper ejector 300 so that the ice can be separated from the upper assembly 110.

The upper ejector 300 may include an ejector body 310 and a plurality of upper ejecting pins 320 extending in a direction intersecting the ejector body 310.

For example, the upper ejector body 310 may be formed in a horizontal direction, and the upper ejecting pin 320 may be formed to extend in a vertical direction from the lower side of the ejector body 310.

A plurality of grooves may be formed in the upper ejector body 310 along the longitudinal direction. A plurality of reinforcing ribs 311 may be formed in the groove. The reinforcing rib 311 may be formed to be parallel to the longitudinal direction of the upper ejector body 310. In addition, the reinforcing rib 311 may be formed in a direction intersecting the longitudinal direction of the upper ejector body 310.

In addition, a hollow 321 may be formed in the upper ejecting pin 320. Thus, the strength of the upper ejecting pin 320 can be improved.

In addition, for the ice-separation, when the lower end of the upper ejecting pin 320 presses the spherical upper tray 150, that is, the upper side of the ice chamber 111, the stable contact is possible by the hollow 321.

Both ends of the upper ejector body 310 may be provided with a separation prevention protrusion 312 for preventing the upper ejector body 310 from being separated from the connection unit 350 in a state of being coupled to the connection unit 350. For example, a pair of separation prevention protrusions 312 may protrude in opposite directions to each other from the upper ejector body 310.

In detail, at both ends of the upper ejector body 310, a separation prevention protrusion 312 protruding in a direction intersecting the upper ejector body 310 may be formed.

The separation prevention protrusion 312 may include a circular central portion 312*a* and a pair of protrusion portions 312*b* protruding in the radial direction of the central portion 312*a* from both sides of the central portion 312*a*.

In addition, the upper and lower guide 313 to guide the vertical movement of the upper ejector body 310 may be provided adjacent to the separation preventing projection 312.

As an example, a pair of upper and lower guide 313 may be provided in parallel with the separation prevention protrusion 312 at both ends of the upper ejector body 310, and the separation prevention protrusion 312 may be further provided outside.

In detail, the upper and lower guide 313 may be inserted into the guide slots 183 corresponding to the width of the guide slots 183, and guide the movement of the upper ejector 300 along the guide slots 183 in the vertical direction.

In addition, the upper and lower guide 313 may have a vertical cross-section formed in a rectangular shape to limit the rotation of the upper ejector 300. This is to allow the upper ejecting pin 320 to flow into the inlet opening 154 of the upper tray 150 in the correct position.

When the upper and lower guide 313 moves up and down along the guide slots 183 in order to allow the upper ejecting pins 320 to be inserted into the inlet openings 154 of the upper tray 150 in the correct position, the flow in the front and rear direction or in the left and right direction should be minimum, and for this purpose, the vertical length, that is, the height of the upper and lower guide 313 may be increased.

In other words, it is possible to prevent the flow of the upper ejector body 310 by increasing the contact area between the upper and lower guide 313 and the guide slot 183.

For example, the vertical length of the upper and lower guide 313 may be formed to be larger than the diameter of the central portion 312*a* of the separation prevention protrusion 312 to be adjacently coupled.

In addition, the upper and lower guides 313 may extend toward the lower portion of the upper ejector 300 so that interference does not occur when the upper ejector 300 moves up and down. The lower end portion of the upper and lower guides 313 may be located lower than the bottom surface of the upper ejector body 310.

At this time, a portion of the upper and lower guide 313 may be inserted into the interference prevention grooves 126*a* and 126*b* of the upper case 120 in order to prevent interference between the lower end portion of the upper and lower guides 313 and the upper case 120. Therefore, the vertical movement distance of the upper ejector 300 may be prevented from decreasing.

The upper and lower guide 313 may further include an inclined portion 313*a* to guide the insertion of a portion of the upper and lower guide 313 into the interference prevention grooves 126*a* and 126*b* of the upper case 120.

As an example, in the inclined portion 313*a*, a surface toward the center of the upper ejector body 310 of the lower end portion of the pair of upper and lower guides 313 may be inclined in a direction toward the outside.

In addition, the pair of upper and lower guide 313 including the inclined portion 313*a* may be formed in a symmetrical shape with respect to the center of the upper ejector body 310.

The upper ejector 300 is connected to the lower assembly 200 to be interlocked with each other when the lower assembly 200 is rotated, the upper ejector 300 can be lifted and lowered.

For example, after the ice-making is completed, if the lower assembly 200 is rotated downward to be spaced apart from the upper assembly 110 for the ice-separation, the upper ejector 300 may be lowered.

In addition, after the ice-separation is completed, when the lower assembly 200 is rotated upward to be coupled with the upper assembly 110 for water-supply, the upper ejector 300 may be lifted.

At the time of the ice-separation, when the upper ejector 300 is lowered, the ice that is in close contact with the upper assembly 110 may be separated from the upper assembly 110.

The upper ejector 300 is connected to the lower assembly 200 by the connection unit 350.

The connection unit 350 includes a first link 352 for rotating the lower supporter 270 by receiving power from the driving unit 180. Therefore, when the driving unit 180 is operated, the first link 352 and the lower supporter 270 rotate at the same time.

The lower supporter 270 forms hinge bodies 281 and 282 on both sides, and the second hinge holes 281*a* are formed in the hinge bodies 281 and 282, respectively.

The shaft connection portion 353 of the first link 352 can pass through the second hinge hole 281.

In addition, the connection shaft 370 may be connected to the shaft connection portion 353.

The shaft connection portion 353 has a polygonal shaft connection groove 353*c* on the opposite surface, and the shaft connection portion 353 may be connected by a connection shaft 370 having a polygonal cross-section with both ends inserted into the shaft connection groove 353*c*.

For example, the shaft connection portion 353 may include a shaft connection groove 353*c* having a square cross-section on an opposing surface, and the cross-section of the connection shaft 370 may have a square cross-section.

The second hinge hole 281*a* may have a free space in the rotation direction of the shaft connection portion 353 in a state where the shaft connection portion 353 is coupled to the second hinge hole 281*a*.

Referring to the drawings, the shaft connection portion 353 may include a first circular central portion 353*a* and a first engaging portion 353*b* protruding in the radial direction from both sides of the first central portion 353*a*, and the second hinge hole 281*a* may include a second circular central portion 281*b* and a second engaging groove 281*c* which communicates with the second central portion 281*b* and is formed to be recessed outward in a radial direction from both sides of the second central portion 281*b*.

In addition, the width of the second locking groove 281*c* may be larger than the width of the first locking portion 353*b*. In a state where the first engaging portion 353*b* is inserted into the second engaging groove 281*c*, the second engaging groove 281*c* may have a free space in the rotation direction of the first engaging portion 353*b*.

In addition, the first link 352 and the lower supporter 270 may be connected by the elastic member 360. The elastic member 360 provides a tension force between the first link 352 and the lower supporter 270. For example, the elastic member 360 may be a coil spring. As another example, the elastic member 360 may be a tension spring.

One end of the elastic member 360 is connected to the first link 352, and the other end thereof is connected to the lower supporter 270.

The elastic member 360 provides an elastic force for pulling the lower supporter 270 toward the upper tray 150 so that a state where the elastic member is in contact with the upper tray 150 and the lower tray 250 is maintained.

The first link 352 may have a coupling hole 352*d* at which one end portion of the elastic member 360 is coupled to one end portion thereof. In addition, the first link 352 may be formed with a coupling groove 352*d* to which the end portion of the elastic member 360 is coupled at one end portion.

Referring to FIGS. 35*a* to 36*c*, after the ice-separation is completed, while the driving unit 180 is operated, the shaft connection portion 353 rotates, and the first link 352 rotates together with the shaft connection portion 353. In addition, while the first link 352 rotates, the lower supporter 270 also rotates upward by the elastic member 360 to reach the position of FIG. 36A. In detail, when the first link 352 connected to the driving unit 180 rotates in the clockwise direction (see FIG. 36A), the upper end of the first link 352 also rotates in the clockwise direction, and the lower supporter 270 also rotates in the clockwise direction by the elastic member 360 connecting the upper end of the first link 352 and the lower end of the lower supporter 270 to each other.

In addition, when the lower supporter 270 reaches the position of FIG. 36A, the drive unit 180 stops the operation, and the water-supply proceeds.

As illustrated, when the water-supply is in progress, the upper end of the lower supporter 270 and the lower end of the upper supporter 170 may be in a state of being spaced apart from each other.

In the water-supply position as described above, the upper surface of the lower tray 250 is also spaced apart from the lower surface of the upper tray 150.

Although not limited, the angle formed by the upper surface of the lower tray 250 and the lower surface of the upper tray 150 at the water-supply standby position of the lower assembly 200 may be about 8 degrees.

After that, when the water-supply is completed, the driving unit 180 is re-operated.

Then, the shaft connection portion 353 rotates in a clockwise direction together with the driving unit 180, and the first link 352 rotates together with the shaft connection portion 353. In addition, while the first link 352 rotates, the lower supporter 270 also rotates upward by the elastic member 360 to reach the positions of FIGS. 35*a* and 36*b*.

At this time, the upper surface of the lower tray 250 and the lower surface of the upper tray 150 is in contact with each other. Although not limited, in the states of FIGS. 35*a* and 36*b*, the lower end of the upper tray 150 and the upper end of the lower tray 250 may be in a state of being horizontal.

Meanwhile, in the states of FIGS. 35*a* and 36*b*, although the upper tray 150 and the lower tray 250 are in contact with each other, there is a concern that the upper tray 150 and the lower tray 250 may not be completely in contact with each other. In addition, there is a fear that the coupling force is weakened.

Thus, as illustrated in FIGS. 35*b* and 36*c*, the drive unit 180 is additionally operated, the shaft connection portion 353 rotates in a clockwise direction together with the drive unit 180, and the first link 352 rotates together with the shaft connection portion 353.

At this time, since the lower tray 250 is in a state of being contact with the upper tray 150, the lower tray 250 does not rotate any more, and only the elastic member 360 is extended. In addition, the elastic restoring force of the elastic member 360 is increased, and the lower tray 250 may maintain a state of being in contact with the upper tray 150 by the elastic restoring force of the elastic member 360.

Referring to FIGS. 35*a* to 35*b*, the width of the first engaging groove 281*c* formed in the second hinge hole 281*a* is greater than the width of the first engaging portion 353*b* formed in the shaft connection portion 353. In addition, the shaft connection portion 353 may be independently rotated in the counterclockwise direction in a state of being inserted into the second hinge hole 281*a*.

Therefore, while the lower tray 250 is in contact with the upper tray 150, in a state where further rotation of the lower tray 250 is difficult (FIG. 35A state), when the driving unit 180 is additionally operated, as illustrated in FIG. 35B, only the shaft connection portion 353 can rotate in the clockwise direction while the shaft connection portion 353 is inserted into the second hinge hole 281*a*, and as a result, the first link 352 can rotate together with the shaft connection portion 353.

In addition, as the elastic member 360 is stretched, the elastic restoring force of the elastic member 360 increases and the lower tray 250 maintains a state of being in contact with the upper tray 150 by the elastic restoring force of the elastic member 360.

In addition, in the ice-making process, a state where the upper tray 150 and the lower tray 250 is in contact with each other may be maintained.

After that, in a state of FIGS. 35*b* and 36*c*, when ice-making is completed, the driving unit 180 operates for ice-separation. At this time, the first link 352 is rotated in the counterclockwise direction (with respect to FIGS. 35*b* and 36*c*). In addition, the upper end of the first link 352 rotates in the counterclockwise direction, and in this state, the upper tray 150 and the lower tray 250 remain in contact with each other by the elastic restoring force of the elastic member 360. At this time, the shaft connection portion 353 rotates independently in the counterclockwise direction in a state of being inserted into the second hinge hole 281*a*.

After that, when the state of FIGS. 35*a* and 36*b* is formed, the lower end of the first engaging portion 353*b* formed on the left side of the shaft connection portion 353 is in contact with the first engaging groove 281*c*.

And, if the drive unit 180 continues to operate, while the shaft connection portion 353 rotates in the counterclockwise direction, the lower end of the first engaging portion 353*b* can rotate the first engaging groove 281*c* in the counterclockwise direction, and as a result, the lower supporter 270 and the lower assembly 200 can rotate in the counterclockwise direction.

Subsequently, when the ice-separation is completed, while the driving unit 180 operates, the first link 352 and the lower supporter 270 rotate in the clockwise direction, sequentially performing the processes of FIGS. 36*a*, 36*b*, and 36*c*.

Meanwhile, the connection unit 350 includes a second link 356 which is connected to the lower supporter 270 to transfer the rotational force of the lower supporter 270 to the upper ejector 300 when the lower supporter 270 rotates.

In other words, the upper ejector 300 may be connected to the lower supporter 270 by the second link 356.

Thus, the rotational force of the lower assembly 200 may be transmitted to the upper ejector 300 by the second link 356.

In addition, the upper ejector 300 may be lifted and lowered n a straight line by the unit guides 181 and 182.

As an example, after the ice-making is completed, if the lower assembly 200 rotates downwardly to be spaced apart from the upper assembly 110, the upper ejector 300 may be lowered. In addition, after the ice-separation is completed, when the lower assembly 200 is rotated upward to be coupled to the upper assembly 110 for water-supply, the upper ejector 300 may be lifted.

At the time of the ice-separation, when the upper ejector 300 is lowered, the upper ejecting pin 320 is inserted into the upper chamber 152 through the inlet opening 154. In addition, the ice in close contact with the upper tray 150 may be separated from the upper tray 150.

For reference, the ejector body 310 of the upper ejector 300 may be lifted and lowered in the guide slot 183 formed in the unit guides 181 and 182.

The upper ejector 300 reaches the highest position in the ice-making state, that is, in the state of FIGS. 35*b* and 36*c*.

In addition, when the lower assembly 200 rotates in the counterclockwise direction (with respect to FIG. 35A to 36*c*) for the ice-separation, the upper ejector 300 is lowered corresponding to the rotation angle of the lower assembly 200.

For example, when the lower tray 250 is in contact with the lower ejector 400, the upper ejector 300 may reach the lowest position.

On the other hand, after the ice-separation is completed, when the lower assembly 200 rotates in the clockwise direction (with respect to FIG. 35A to 36*c*) for the water-supply and the ice-making, corresponding to the rotation angle of the lower assembly 200, the upper ejector 300 is lifted.

For example, when the lower tray 250 is in contact with the upper tray 150 while forming a state of being horizontal, the upper ejector 300 may reach the highest position.

<Lower Ejector>

Figure 41:
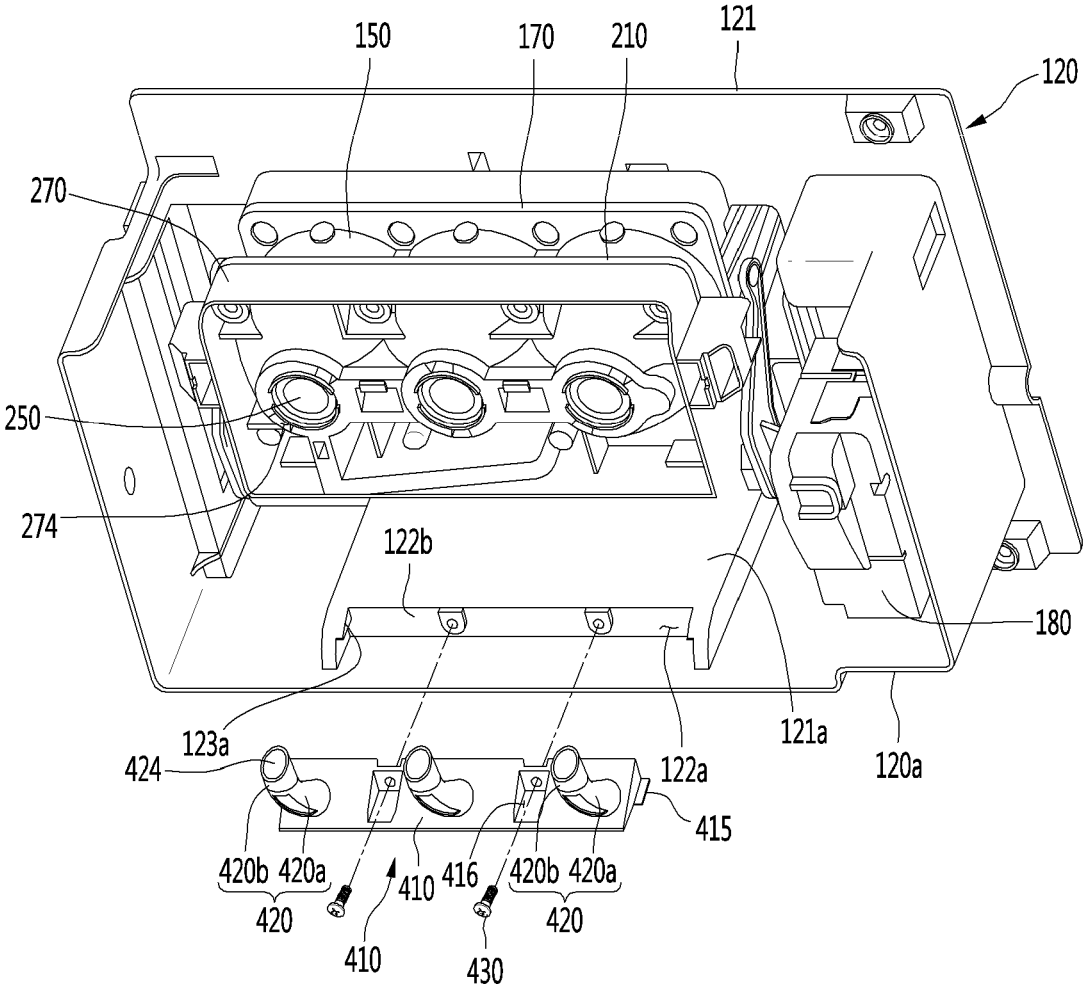
FIG. 41 is a bottom perspective view illustrating a state where the ice maker and the lower ejector are separated according to an embodiment of the present disclosure.
Figure 42:
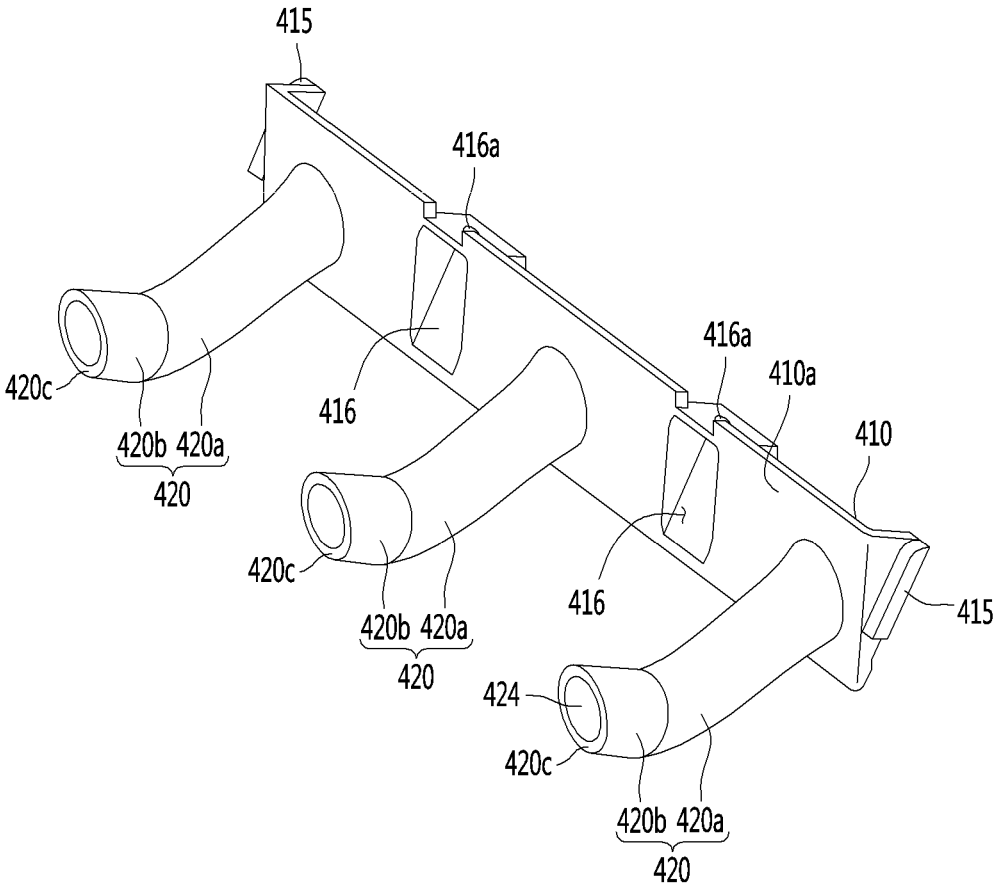
FIGS. 42 to 43 are perspective views of the lower ejector illustrated in FIG. 41 as viewed from various directions.
Figure 43:
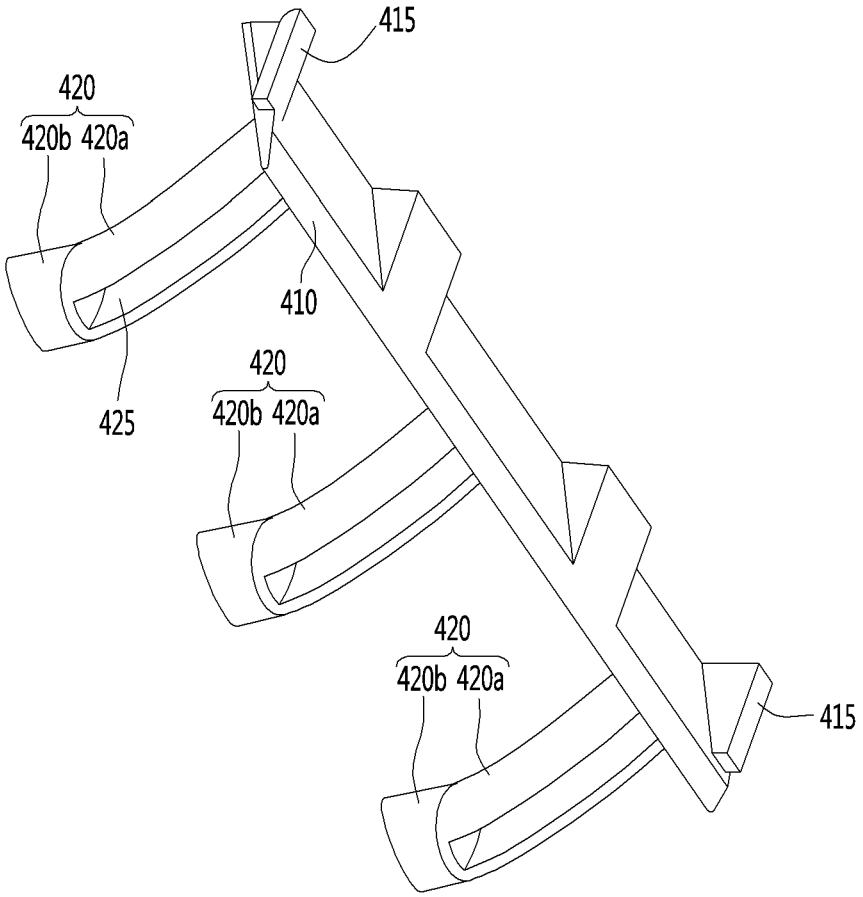
Figure 44:
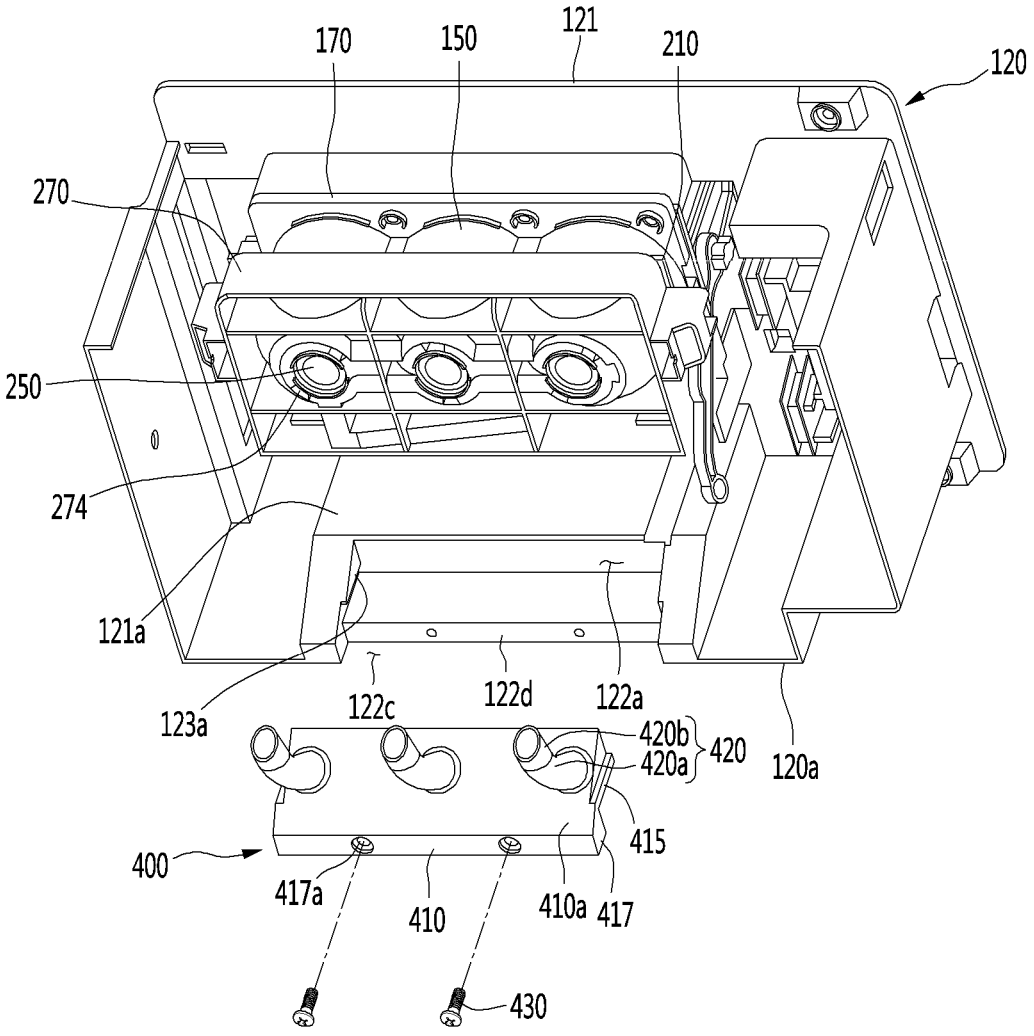
FIG. 44 is a bottom perspective view illustrating a state where the ice maker and the lower ejector are separated according to another embodiment of the present disclosure.
Figure 45:
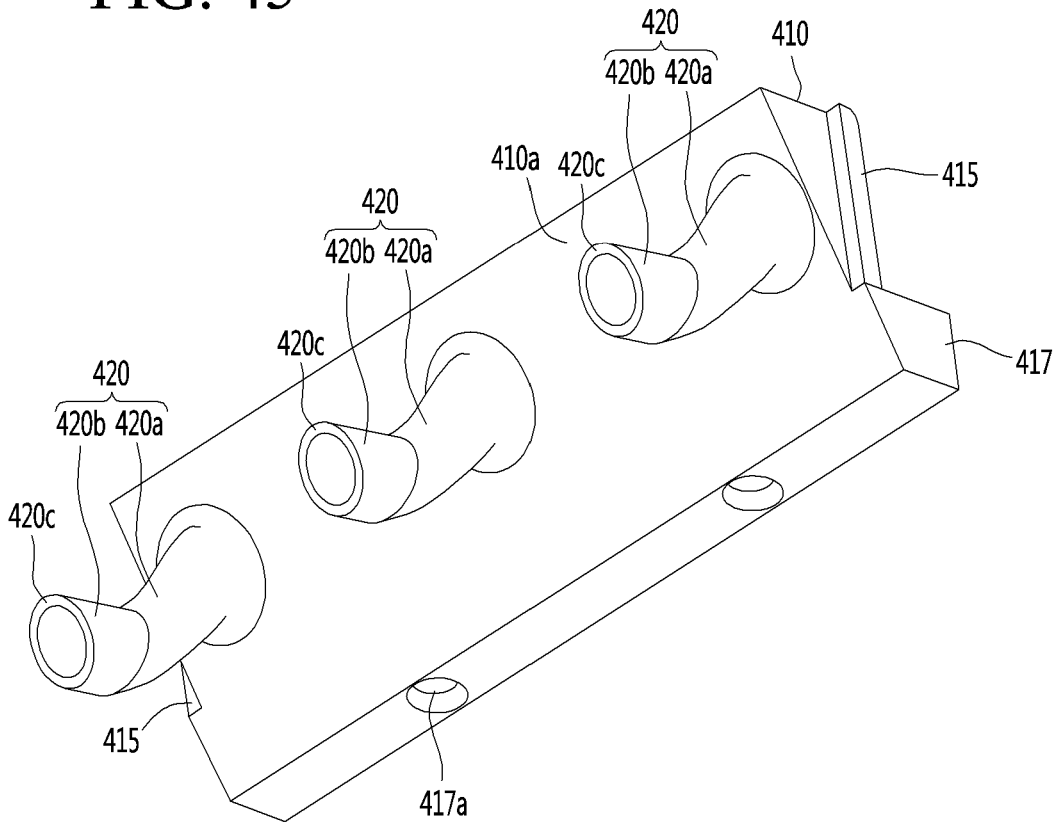
FIGS. 45 to 46 are perspective views of the lower ejector illustrated in FIG. 44 as viewed from various directions.
Figure 46:
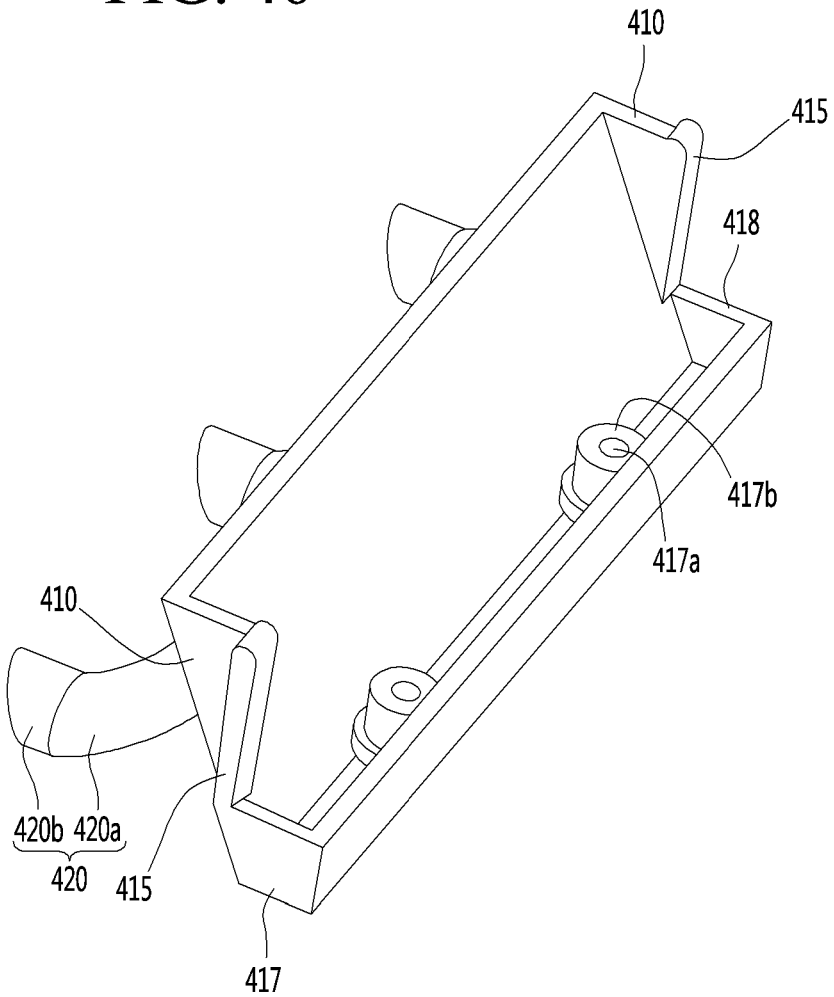
Figure 47:
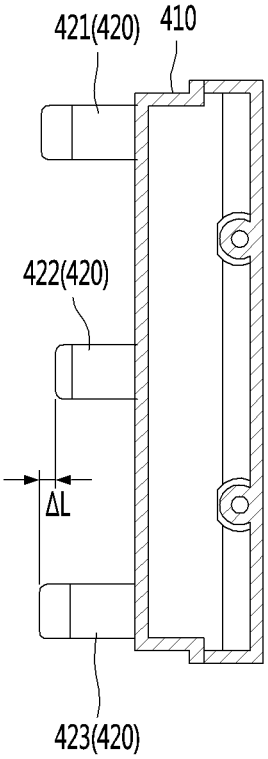
FIG. 47 is a view illustrating the lower ejector according to another embodiment of the present disclosure as viewed from the bottom surface.

FIG. 41 is a bottom perspective view illustrating a state where the ice maker and the lower ejector are separated according to an embodiment of the present disclosure, FIGS. 42 to 43 are perspective views of the lower ejector illustrated in FIG. 41 as viewed from various directions, FIG. 44 is a bottom perspective view illustrating a state where the ice maker and the lower ejector are separated according to another embodiment of the present disclosure, and FIGS. 45 to 46 are perspective views of the lower ejector illustrated in FIG. 44 as viewed from various directions. In addition, FIG. 47 is a view illustrating the lower ejector according to another embodiment of the present disclosure as viewed from the bottom surface.

As described above, the ice maker 100 may further include a lower ejector 400 so that ice which is in close contact with the lower assembly 200 can be separated.

In detail, after the ice-making is completed, when the lower assembly 200 rotates while being spaced apart from the upper assembly 110, the lower ejector 400 presses the lower assembly 200 so that the ice which is in close contact with the lower assembly 200 can be separated from the lower assembly 200. At this time, the lower ejector 400 can press the lower tray 250.

The lower ejector 400 may be fixed to the upper assembly 110 as an example.

The lower ejector 400 may include a lower ejector body 410 and a plurality of lower ejecting pins 420 protruding from the lower ejector body 410. The lower ejecting pins 420 may be provided in the same number as the ice chamber 111.

The lower ejector body 410 may be coupled to a vertical wall 120*a* extending in the vertical direction from the upper tray 120. The vertical wall 120*a* forms a rear wall of the ice maker. The lower ejector body 410 may be assembled detachably to the vertical wall 120*a*.

In addition, the lower ejector body 410 may be formed in parallel with the vertical wall 120*a*. In addition, the lower ejector body 410 may form an inclined surface 410*a* that is inclined with respect to the vertical wall 120*a* on one side facing the lower tray 250.

Meanwhile, the inclined surface 410*a* may be inclined by an angle corresponding to the inclined angle of the lower assembly 200 in a state where the lower assembly 200 is rotated to a side of the lower ejector 400 for the ice-separation.

In other words, in a state where the rotation of the lower assembly 200 is completed, the inclined surface 410*a* and the lower end of the lower assembly 200 may be formed side by side. Meanwhile, the vertical wall 120*a* may be formed integrally with the upper case 120 and may be provided separately from the upper case 120.

In addition, the supporter body 271 may include a lower opening 274 for passing through by the lower ejector 400 in the ice-separation process. The lower opening 274 may be formed in each chamber receiving portion 272.

In addition, the lower ejecting pin 420 may be formed equal to the number of a lower chamber 252 which is formed in the lower tray 250, a chamber receiving portion 272 in which the lower chamber is received, and a lower opening 274 which is formed in the chamber receiving portion 272.

For example, three lower chambers 252 may be formed in the lower tray 250. In addition, the supporter body 271 is formed with three chamber receiving portion 272 so that three lower chambers 272 are received in the three chamber receiving portion, respectively, and the lower opening 274 may be provided in each chamber receiving portion 272. In addition, three lower ejecting pins 420 may be provided to press the three lower chambers 252 through each of the lower openings 274.

Thus, in a state where the lower ejector 400 is fixed, when the lower assembly 200 rotates toward the lower ejector 400, the lower ejecting pin 420 can pass through the lower opening 274 and press the lower tray 250. In addition, the lower tray 250 may be deformed by the pressing force of the lower ejecting pin 420, and the ice of the lower chamber 252 may be separated from the lower tray 250.

Meanwhile, the lower ejecting pin 420 may be formed to have at least one short length.

For example, three lower ejecting pins 420 may be provided in total. The length of the lower ejecting pins 422 (see FIG. 47) disposed in the center may be shorter than the lower ejecting pins 421 and 423 (see FIG. 47) disposed on both sides.

As described above, if the length of any one of the plurality of lower ejecting pins 421, 422, and 423 is short, the load applied to the motor may be reduced during the ice-separation.

In detail, when the length of any one of the plurality of lower ejecting pins 421, 422, and 423 has a short length, the lower tray 250 first is in contact with two lower ejecting pin 421 and 423 and later is in contact with the other lower ejecting pin 422 in a process in which the lower assembly 200 rotates.

In addition, when the lower assembly 200 is continuously rotated, the two lower ejecting pins 421, 423 press the lower tray 250, and the other lower ejecting pin 422 later presses the lower tray 250.

In addition, the ice of the lower tray 250 which is first pressed by the two lower ejecting pins 421 and 423 may be separated from the surface of the lower tray 250, and then by the middle lower ejecting pin 422, the ice in the lower tray 250 which is later pressed may be separated from the surface of the lower tray 250.

In other words, the ice of the lower tray 250 may be sequentially separated from the surface of the lower tray 250.

Therefore, while the load applied to the motor included in the drive unit 180 providing the rotational power to the lower assembly 200 is distributed with a time difference, the load applied to the motor can be reduced instantaneously.

On the other hand, if the three lower ejecting pins 421, 422, and 423 have the same length, the lower tray 250 is in contact with the three lower ejecting pin 421, 422, and 423 at the same time in a process in which the lower assembly 200 is rotated.

In addition, when the lower assembly 200 is continuously rotated, the three lower ejecting pins 421, 422, and 423 simultaneously press the lower tray 250 to deform the lower tray 250, and the pressing force of the three lower ejecting pins 421, 422, and 423 are transferred to the ice so that three pieces of ice can be separated from the surface of the lower tray 250 almost at the same time.

At this time, the load applied to the motor included in the drive unit 180 has to be increased.

In addition, the lower ejecting pin 420 may include a pin body 420*a* protruding from the lower ejector body 410 and a pressing portion 420*b* extending from the pin body 420*a*.

For example, the pin body 420*a* and the pressing portion 420*b* may be bent to form a predetermined angle, and the pressing portion 420*b* can extend from the pin body 420*a* so as to press the center of the lower tray 250.

In detail, the pin body 420*a* may be formed in a curved shape and may be inclined downward from one side connected to the lower ejector body 410 to the other side.

As another example, the pin body 420*a* may be inclined downward from one side connected to the lower ejector body 410 to the other side, and at least a portion thereof may be rounded in a curved shape.

As another example, the pin body 420*a* is inclined downward from one side connected to the lower ejector body 410 to the other side, and at least a portion of the pin body 420*a* may be rounded in a curved shape so as to position on the extension line of the rotation trajectory of the lower assembly 200.

The pressing portion 420*b* may extend from the pin body 420*a* and be formed to be in contact with the center of the lower tray 250 and rotate when the lower assembly 200 rotates for the ice-separation.

In detail, the pressing portion 420*b* may be connected to form a predetermined angle with the pin body 420*a* so that the area in contact with the center of the lower tray 250 is widened.

In addition, the pressing portion 420*b* may include a pressing inclined portion 420*c* in contact with the lower tray 250.

For example, as the length of the upper end portion of the pressing portion 420*b* is formed longer than the length of the lower end portion, the pressing inclined portion 420*c* may be formed.

The pressing inclined portion 420*c* may be formed such that an upper end portion of the pressing inclined portion 420*c* is in contact with the lower tray 250 first during the ice-separation process.

If the lower tray 250 is rotated in a state where the pressing inclined portion 420*c* is not formed in the pressing portion 420*b*, the lower end portion of the pressing portion 420*b* is in contact with the lower tray 250 first. In this case, only a portion of the pressing portion 420*b* presses the lower tray 250 or deformation of the lower tray 250 occurs at a position spaced apart from the central portion of the lower tray 250, and thus the ice-separation performance can be deteriorated.

However, when the pressing inclined portion 420*c* is formed in the pressing portion 420*b* as in the present embodiment, during the rotation of the lower tray 250, the upper end portion of the pressing inclined portion 420*c* may be first in contact with the lower tray 250, or the upper end portion and the lower end portion of the pressing inclined portion may be simultaneously in contact with the lower tray.

For example, the pressing inclined portion 420*c* is in contact with the lower tray 250 and when the pressing inclined portion reaches the lower limit value (about, 112 degrees) of the rotation angle of the lower assembly 200, the pressing inclined portion 420*c* may be formed to coincide with the centerline of the lower tray 250.

In a case where the pressing inclined portion 420*c* is formed as described above, when the upper end portion of the pressing inclined portion 420*c* is first contacted or the upper portion and the lower portion thereof are simultaneously contacted, the pressing portion 420*b* can press the central portion of the lower tray and thus the ice-separation performance is improved.

In addition, as described above, in a state where the pressing portion 420*b* is in contact with the center of the lower tray 250 when the lower assembly 200 further rotates, the pressing force is continuously applied to the center of the lower tray 250 and thus there is a beneficial advantage to the ice-separation.

In addition, the pressing portion 420*b* may form a recessed groove portion 424 at an end portion contacting the lower tray 250.

Thus, the strength of the lower ejecting pin 420 can be improved. In addition, for the ice-separation, when the pressing portion 420*b* presses the spherical lower tray 250, that is, the convex lower side of the lower chamber 111, stable contact is possible by the groove portion 424 and a problem that a force is concentrated on one place and thus ice breaks can be prevented.

There is a fear that if the end portion of the pressing portion 420*b* is a flat surface, the lower ejecting pin 420 is in point contact with the spherical lower chamber 111, and while the contact area is reduced, the pressing force may not be properly transmitted. Alternatively, there is a fear that while the force is concentrated in one place, the ice breaks.

On the other hand, in a case of the present disclosure, there are advantages that while the recessed groove portion 424 is formed in the pressing portion 420*b*, the lower ejecting pin 420 may be in line contact or surface contact with the spherical lower chamber 111 and while the contact area increases, the pressing force is properly transmitted. In addition, as the force is dispersed, there is an advantage that can prevent the problem of breaking the ice.

In addition, at least one reinforcing long hole 425 may be provided on a bottom surface of the pin body 420*a* of the lower ejecting pin 420.

In addition, when the lower assembly 200 rotates for the ice-separation by extending the length of the lower ejecting pin 420, the sufficient pressing force can be transmitted to the lower chamber 111 even if the lower assembly 200 does not reach the maximum ice-separation position (about 115 degrees) by the tolerance of the motor gear included in the drive unit 180.

Meanwhile, the lower ejector 400 may be coupled with the vertical wall 120*a* in various ways.

Referring to FIGS. 41 and 44, when the lower assembly 200 rotates for the ice-separation, the vertical wall 120*a* may be formed with the protrusion portion 121*a* protruding forward toward the lower tray 250 at one surface facing the lower tray 250.

In addition, the lower end of the protrusion portion 121*a* may form a cavity 122*a* recessed to the rear. In addition, the lower ejector body 410 of the lower ejector 400 may be received in the cavity 122*a*. Therefore, the lower ejector body 410 may be located under the protrusion portion 121*a*.

In addition, the cavity 122*a* may form guide slots 123*a* on both sides. In addition, guide protrusions 415 which are inserted into the guide slot 123*a* while being slid along the guide slot may be formed on both sides of the lower ejector body 410.

Thus, the lower ejector body 410 may be coupled while sliding upward from the lower side of the vertical wall 120*a*. At this time, the guide protrusions 415 at both sides of the lower ejector body 410 are inserted into the guide slots 123*a* formed at both sides of the cavity 122*a*.

In addition, in a state where the lower ejector body 410 is slid along and coupled to the vertical wall 120*a* as described above, by using a fastening means 430, such as bolts, screws, or the like, the lower ejector body 410 can be coupled to the upper surface 122*b* of the cavity 122*a*.

For this purpose, the lower ejector body 410 may be provided with a fastening groove portion 416 recessed from the front to the rear. A fastening hole 416*a* through which the fastening means 430 passes may be formed on an upper surface of the fastening groove portion 416.

In addition, the fastening groove portion 416 may be formed on the inclined surface 410*a*. The fastening groove portion 410*a* may have a form in which the width in the front and rear direction thereof gradually decreases from the upper portion to the lower portion.

In addition, the fastening groove portion 416 may be formed between the lower ejecting pins 420.

When the fastening groove portion 416 is formed as described above, in a state where the upper surface of the fastening groove portion 416 and the upper surface 122*b* of the cavity 122*a* are in surface contact with each other, the upper surface of the fastening groove portion 416 and the upper surface 122*b* of the cavity 122*a* are fastened from below the fastening groove portion 416 with the fastening means 430, and thus the lower ejector body 410 can be more easily fixed to the vertical wall 120*a*. In addition, the lower ejector 400 can be coupled to the vertical wall 120*a* without the fastening portion being exposed to the outside.

Referring to FIG. 41, a coupling groove portion 122*c* upwardly recessed may be further formed at a lower end of the vertical wall 120*a*.

In addition, in a state where the lower ejector body 410 is slid and coupled to the vertical wall 120*a*, using fastening means 430 such as bolts and screws, the lower ejector body 410 can be coupled to an upper surface 122*d* of the coupling groove portion 122*c*.

To this end, the lower ejector body 410 may form an extension portion 417 protruding rearward from the lower end. In addition, by the extension portion 417, the lower ejector body 410 may have a coupling step 418 facing the upper surface of the coupling groove portion 122*c* at the lower end of the rear surface. A fastening boss 417*b* having a fastening hole 417*a* may be formed in the extension portion 417.

When the coupling groove portion 122*c* and the extension portion 417 are formed as described above, in a state where the upper surface 122*d* of the coupling groove portion 122*c* and the coupling step 418 are in surface contact with each other, the lower ejector body 410 may be more easily fixed to the vertical wall 120*a* by fastening the upper surface 122*d* of the coupling groove portion 122*c* and the extension portion 417 with the fastening means 430 from below the extension portion 417. In addition, the lower ejector 400 may be coupled to the vertical wall 120*a* without the fastening portion being exposed to the outside.

When the lower ejector 400 is provided as described above, even if ice is not separated from the lower tray 250 by the own weight of the ice in a process of rotating the lower assembly 200 for the ice-separation, the lower tray 250 is pressed by the lower ejector 400, and as a result, ice in the lower chamber 252 may be separated from the lower tray 250.

In detail, the lower tray 250 is in contact with the lower ejecting pin 420 in a process in which the lower assembly 200 is rotated toward the lower ejector 400.

In addition, when the lower assembly 200 is continuously rotated in the side of lower ejector 400, and the lower ejecting pin 420 presses the lower tray 250 and thus the lower tray 250 is modified, and the pressing force of the lower ejecting pin 420 may be transferred to the ice to separate the ice from the surface of the lower tray 250. The ice separated from the surface of the lower tray 250 may be dropped down and stored in the ice bin 102.

At the time of rotation of the lower assembly 200 for the ice-separation described above, there is a fear that the lower assembly 200 does not reach the maximum ice-separation position (about 115 degrees) by the tolerance of the motor gear included in the drive unit 180. In this case, a problem arises that the ice-separation does not proceed completely. Therefore, the control may be performed to further rotate the motor included in the driving unit 180 so that the lower assembly 200 may exceed the maximum ice-separation position (about 115 degrees) so as to perform securely the ice-separation.

Hereinafter, a process of making ice by using the ice maker according to an embodiment will be described.

Figure 48:
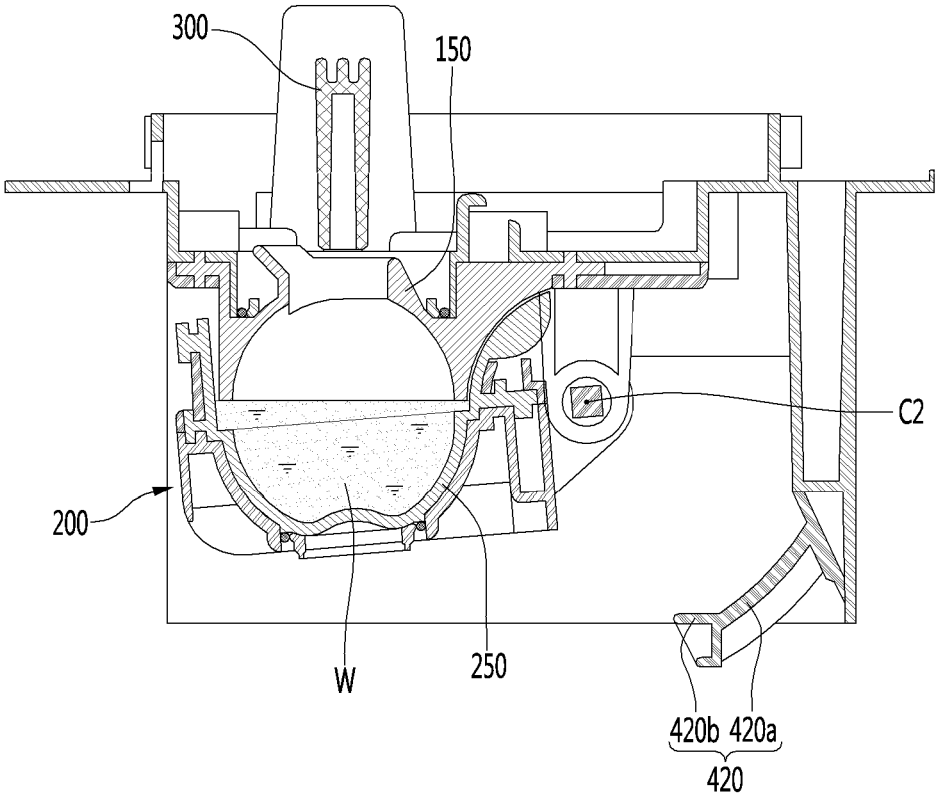
FIG. 48 is a sectional view taken along the line B-B of FIG. 3A in the water-supply state.
Figure 49:
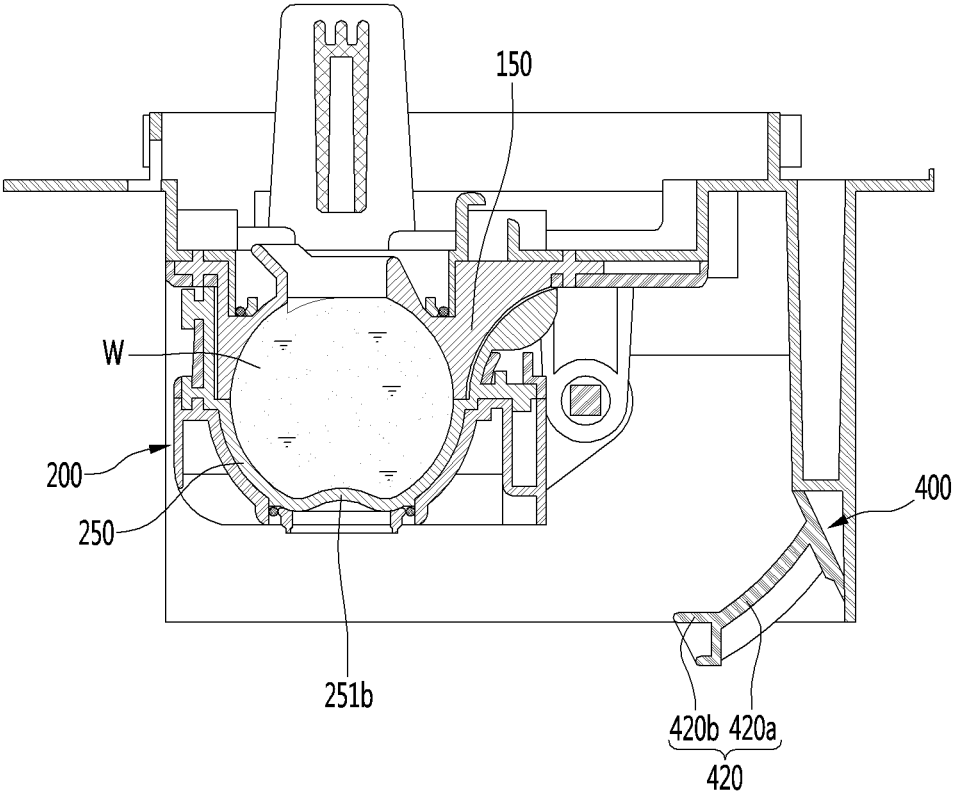
FIG. 49 is a sectional view taken along the line B-B of FIG. 3A in an ice-making state.

FIG. 48 is a sectional view taken along the line B-B of FIG. 3A in the water-supply state, and FIG. 49 is a sectional view taken along the line B-B of FIG. 3A in an ice-making state.

Figure 50:
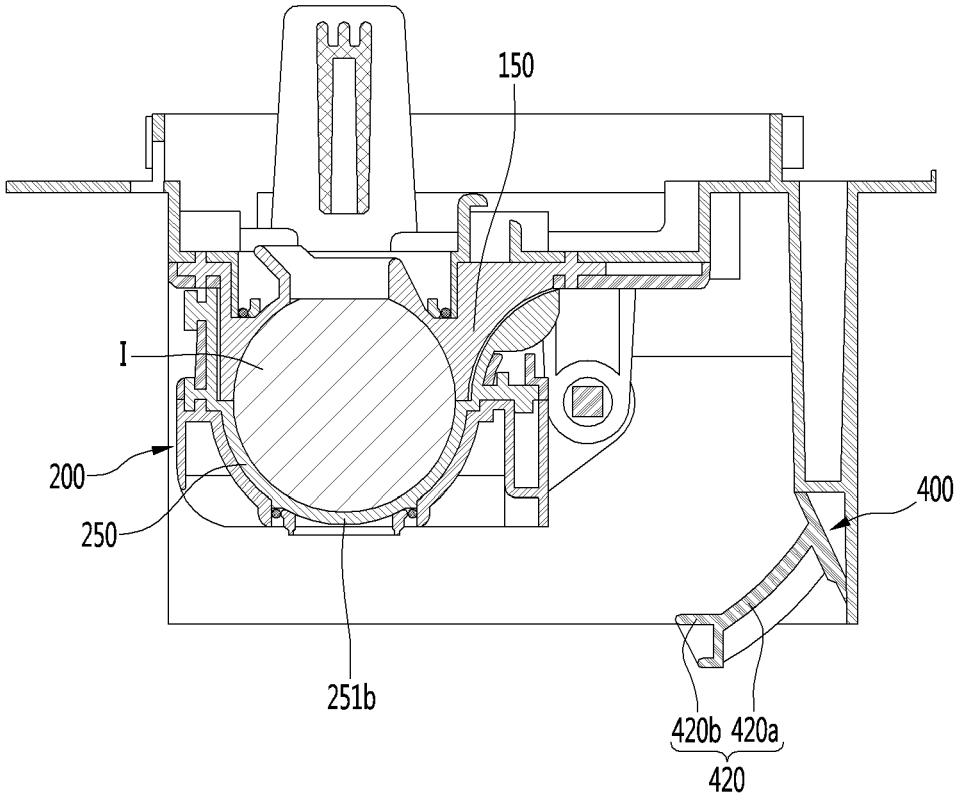
FIG. 50 is a sectional view taken along the line B-B of FIG. 3A in an ice-making state.
Figure 51:
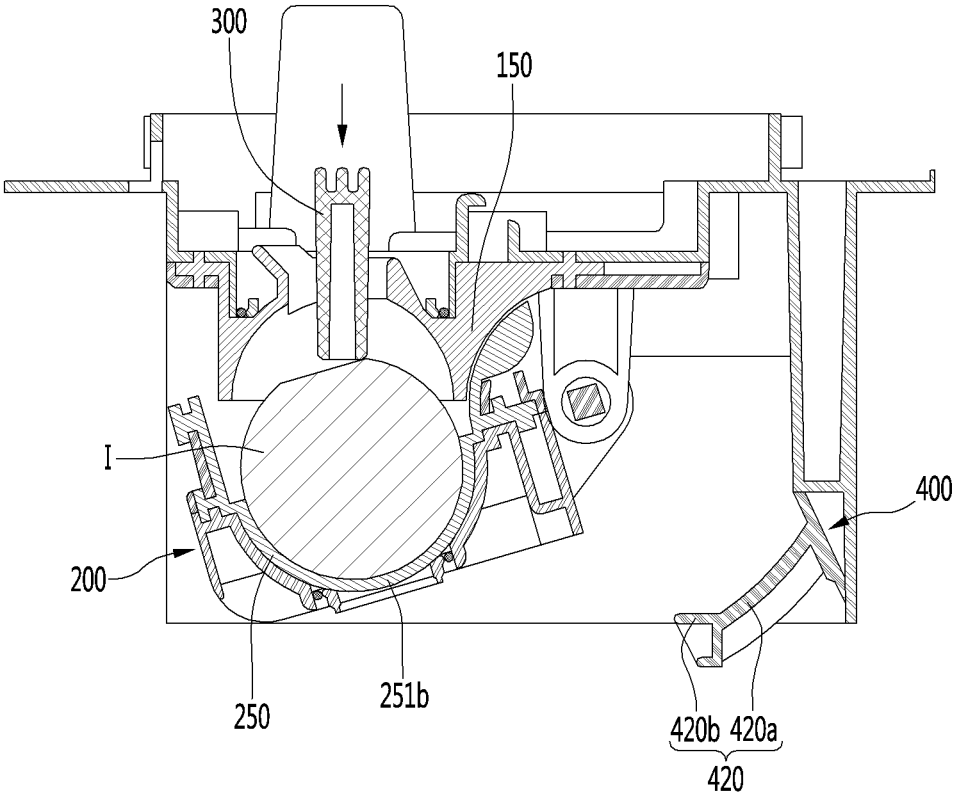
FIG. 51 is a sectional view taken along the line B-B of FIG. 3A in an initial ice-separation state.
Figure 52:
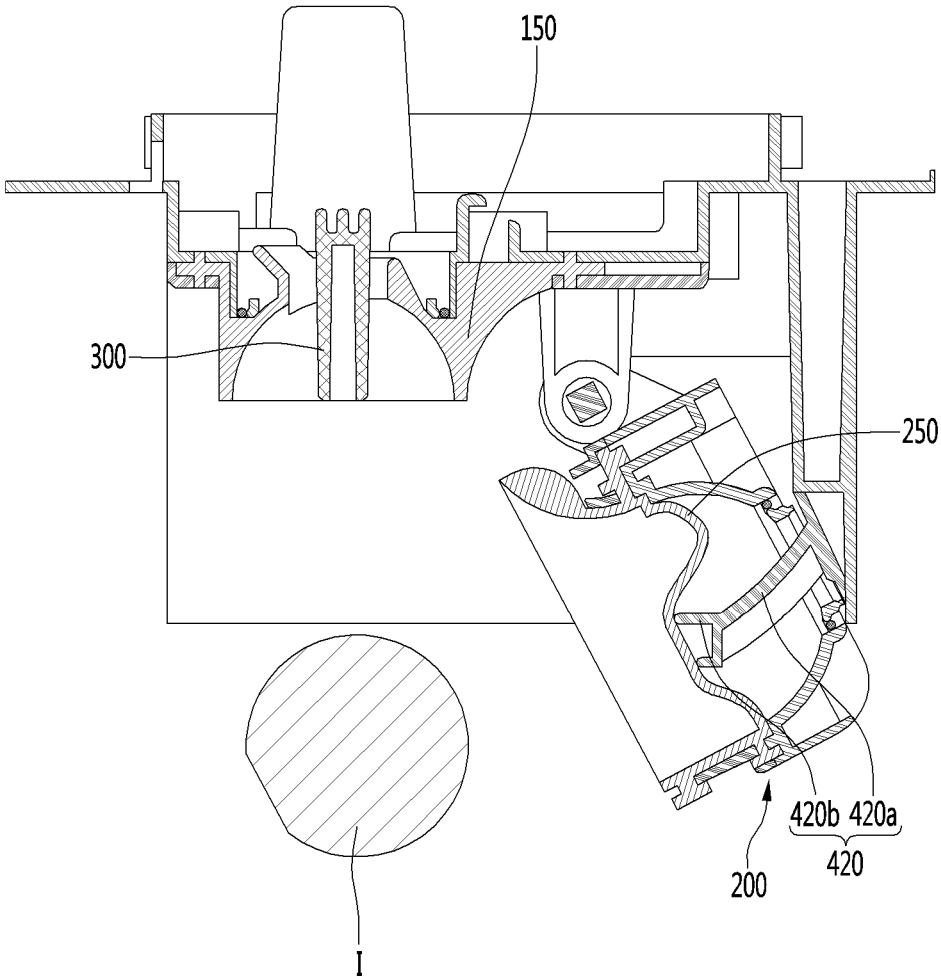
FIG. 52 is a sectional view taken along the line B-B of FIG. 3A in an ice-separation completion state.

FIG. 50 is a sectional view taken along the line B-B of FIG. 3A in an ice-making state, FIG. 51 is a sectional view taken along the line B-B of FIG. 3A in an initial ice-separation state, and FIG. 52 is a sectional view taken along the line B-B of FIG. 3A in an ice-separation completion state.

Referring to FIGS. 48 to 52, first, the lower assembly 200 rotates to a water supply standby position.

The top surface 251*e* of the lower tray 250 is spaced apart from the bottom surface 151*e* of the upper tray 150 at the water supply standby position of the lower assembly 200.

Although not limited, the lower surface 151*e* of the upper tray 150 may be located at the same or similar height as the rotation center C2 of the lower assembly 200.

In this embodiment, the direction in which the lower assembly 200 rotates (in a counterclockwise direction in the drawing) is referred to as a forward direction, and the opposite direction (in a clockwise direction) is referred to as a reverse direction.

Although not limited, an angle between the top surface 251*e* of the lower tray 250 and the bottom surface 151*e* of the upper tray 150 at the water supply standby position of the lower assembly 200 may be about 8 degrees.

In this state, the water is guided by the water supply portion 190 and supplied to the ice chamber 111.

Here, the water is supplied to the ice chamber 111 through one inlet opening of the plurality of inlet openings 154 of the upper tray 150.

In the state where the supply of the water is completed, a portion of the water may be fully filled into the lower chamber 252, and the other portion of the supplied water may be fully filled into the space between the upper tray 150 and the lower tray 250.

Another portion of the water may be filled in the upper chamber 151. Of course, the water may not be located in the upper chamber 152 after completion of water-supply according to the angle formed between the upper surface 251*e* of the lower tray 250 and the lower surface 151*e* of the upper tray 150 or the volume of the lower chamber 252 and the upper chamber 152.

In the case of this embodiment, a channel for communication between the three lower chambers 252 may be provided in the lower tray 250.

As described above, although the channel for the flow of the water is not provided in the lower tray 250, since the top surface 251*e* of the lower tray 250 and the bottom surface 151*e* of the upper tray 150 are spaced apart from each other, the water may flow to the other lower chamber along the top surface 251*e* of the lower tray 250 when the water is fully filled in a specific lower chamber in the water supply process.

Thus, the water may be fully filled in each of the plurality of lower chambers 252 of the lower tray 250.

In addition, in the case of this embodiment, since the channel for the communication between the lower chambers 252 is not provided in the lower tray 250, additional ice having a projection shape around the ice after the ice-making process may be prevented being made.

In the state where the supply of the water is completed, as illustrated in FIG. 42, the lower assembly 200 rotates reversely. When the lower assembly 200 rotates reversely, the top surface 251*e* of the lower tray 250 is close to the bottom surface 151*e* of the upper tray 150.

Thus, the water between the top surface 251*e* of the lower tray 250 and the bottom surface 151*e* of the upper tray 150 may be divided and distributed into the plurality of upper chambers 152.

In addition, when the top surface 251*e* of the lower tray 250 and the bottom surface 151*e* of the upper tray 150 are closely attached to each other, the water may be fully filled in the upper chamber 152.

In the state where the top surface 251*e* of the lower tray 250 and the bottom surface 151*e* of the upper tray 150 are closely attached to each other, a position of the lower assembly 200 may be called an ice-making position.

In the state where the lower assembly 200 moves to the ice-making position, ice-making is started.

Since the pressing force of water during ice-making is less than the force for deforming the convex portion 251*b* of the lower tray 250, the convex portion 251*b* may not be deformed to maintain its original shape.

When the ice-making is started, the lower heater 296 is turned on. When the lower heater 296 is turned on, the heat of the lower heater 296 is transferred to the lower tray 250.

Thus, when the ice-making is performed in the state where the lower heater 296 is turned on, ice may be made from the upper side in the ice chamber 111.

In other words, water in a portion adjacent to the inlet opening 154 in the ice chamber 111 is first frozen. Since ice is made from the upper side in the ice chamber 111, the bubbles in the ice chamber 111 may move downward.

Since the ice chamber 111 is formed in a spherical shape, the horizontal cross-sectional area is different for each height of the ice chamber 111.

Thus, the output of the lower heater 296 may vary according to the height at which ice is generated in the ice chamber 111.

As the horizontal cross-sectional area is increased from the upper side to the lower side, the horizontal cross-sectional area increases to the maximum at the boundary between the upper tray 150 and the lower tray 250 and decreases to the lower side again.

While ice is made from the upper side to the lower side in the ice chamber 111, the ice may contact a top surface of a block portion 251*b* of the lower tray 250.

In this state, when the ice is continuously made, the block portion 251*b* may be pressed and deformed as illustrated in FIG. 43, and the spherical ice may be made when the ice-making is completed.

A control unit (not illustrated) may determine whether the ice-making is completed based on the temperature sensed by the temperature sensor 500.

The lower heater 296 may be turned off at the ice-making completion or before the ice-making completion.

When the ice-making is completed, the upper heater 148 is first turned on for the ice-removal of the ice. When the upper heater 148 is turned on, the heat of the upper heater 148 is transferred to the upper tray 150, and thus, the ice may be separated from the surface (the inner face) of the upper tray 150.

After the upper heater 148 has been activated for a set time duration, the upper heater 148 may be turned off and then the drive unit 180 may be operated to rotate the lower assembly 200 in a forward direction.

As illustrated in FIG. 44, when the lower assembly 200 rotates forward, the lower tray 250 may be spaced apart from the upper tray 150.

In addition, the rotation force of the lower assembly 200 may be transmitted to the upper ejector 300 by the connection unit 350. Thus, the upper ejector 300 descends by the unit guides 181 and 182, and the upper ejecting pin 320 may be inserted into the upper chamber 152 through the inlet opening 154.

In the ice-separation process, the ice may be separated from the upper tray 250 before the upper ejecting pin 320 presses the ice. In other words, the ice may be separated from the surface of the upper tray 150 by the heat of the upper heater 148.

In this case, the ice may rotate together with the lower assembly 250 in the state of being supported by the lower tray 250.

Alternatively, even though the heat of the upper heater 148 is applied to the upper tray 150, the ice may not be separated from the surface of the upper tray 150.

Thus, when the lower assembly 200 rotates forward, the ice may be separated from the lower tray 250 in the state where the ice is closely attached to the upper tray 150.

In this state, while the lower assembly 200 rotates, the upper ejecting pin 320 passing through the inlet opening 154 may press the ice closely attached to the upper tray 150 to separate the ice from the upper tray 150. The ice separated from the upper tray 150 may be supported again by the lower tray 250.

When the ice rotates together with the lower assembly 250 in the state where the ice is supported by the lower tray 250, even though external force is not applied to the lower tray 250, the ice may be separated from the lower tray 250 by the self-weight thereof.

While the lower assembly 200 rotates, even though the ice is not separated from the lower tray 250 by the self-weight thereof, as in FIG. 45, when the lower tray 250 is pressed by the lower ejector 400, the ice may be separated from the lower tray 250.

Particularly, while the lower assembly 200 rotates, the lower tray 250 may contact the lower ejecting pin 420.

In addition, when the lower assembly 200 continuously rotates forward, the lower ejecting pin 420 may press the lower tray 250 to deform the lower tray 250, and the pressing force of the lower ejecting pin 420 may be transmitted to the ice to separate the ice from the lower tray 250. The ice separated from the surface of the lower tray 250 may drop downward and be stored in the ice bin 102.

After the ice is separated from the lower tray 250, the lower assembly 200 may be rotated in the reverse direction by the drive unit 180.

When the lower ejecting pin 420 is spaced apart from the lower tray 250 in a process in which the lower assembly 200 is rotated in the reverse direction, the deformed lower tray may be restored to its original form.

In addition, in the reverse rotation process of the lower assembly 200, the rotational force is transmitted to the upper ejector 300 by the connection unit 350, such that the upper ejector 300 is raised, and thus, the upper ejecting pin 320 is removed from the upper chamber 152.

As described above, while the lower assembly 200 is rotated in the reverse direction by the drive unit 180, the upper end of the lower assembly 200 is rotated to the first position.

At this time, although the upper tray 150 and the lower tray 250 are in contact with each other, there is a fear that the upper tray 150 and the lower tray 250 may not be completely in contact with each other.

In this state, when the driving unit 180 is stopped, the lower assembly 200 is pulled upward by the tensile force of the elastic member 360, the upper end of the lower assembly 200 rotates up to the second position higher than the first position, and as a result, the upper tray 150 and the lower tray 250 may be more completely coupled to each other.

In addition, when the lower assembly 200 reaches the water supply standby position, the drive unit 180 is stopped, and then the water supply starts again.

What is claimed is:

1. An ice maker comprising:

a first assembly comprising:

a first tray defining a plurality of first chambers recessed in a first direction, and a first cover supporting the first tray at a first side of the first tray;

a second assembly that is movably coupled to the first assembly and that comprises a second tray defining a plurality of second chambers recessed in a second direction opposite to the first direction, the plurality of first chambers and the plurality of second chambers being configured to, based on the first tray and the second tray coming together, define a plurality of ice chambers; and a first ejector configured to separate ice from the plurality of the ice chambers and comprising an ejector body and a plurality of ejecting pins extending from the ejector body, wherein the first ejector is configured to move in the first and second directions based on movement of the second assembly, wherein the first cover defines a plurality of openings through which at least a portion of the first side of the first tray is exposed, and wherein the plurality of ejecting pins are configured to pass through the plurality of openings of the first cover to separate the ice from the first tray.

2. The ice maker of claim 1, wherein the plurality of ice chambers are arranged along a third direction intersecting the first direction, the ejector body extends in the third direction, and the plurality of ejecting pins extend in the second direction.

3. The ice maker of claim 1, wherein the first cover comprises a first supporting part that (i) is in contact with the first tray to support the first tray and (ii) defines the plurality of openings, and wherein the first supporting part is configured to be disposed between the first ejector and the first tray based on the first ejector moving to a maximum position in the first direction.

4. The ice maker of claim 1, wherein the first tray comprises:

a tray body having chamber walls that define the plurality of first chambers; and an extension portion extending from the chamber walls and configured to be fixed to the first cover, wherein at least a portion of the tray body is configured to be exposed to cold air through the plurality of openings.

5. The ice maker of claim 1, wherein the first assembly further comprises (i) a second cover supporting the first tray at a second side of the first tray opposite to the first side of the first tray and (ii) a unit guide that is configured to guide the movement of the first ejector.

6. The ice maker of claim 5, wherein the second cover further comprises a second supporting part that is in contact with the first tray to support the first tray, and wherein the unit guide extends in the first direction from the second supporting part.

7. The ice maker of claim 6, wherein the second cover further comprise a side wall extending in the first direction from an edge of the second supporting part, and wherein the unit guide is connected to the side wall.

8. The ice maker of claim 5, wherein the unit guide comprises a guide slot (i) extending in the first direction and the second direction and (ii) through which at least a portion of the first ejector passes.

9. The ice maker of claim 8, further comprising:

a connector connecting the second assembly to the first ejector, and wherein the connector is connected to the first ejector based on a portion of the first ejector being passed through the guide slot.

10. The ice maker of claim 8, wherein the first ejector comprises a guide that is configured to be inserted into the guide slot and that has a width corresponding to a width of the guide slot, and wherein a cross-section of the guide in the first direction has a rectangular shape.

11. The ice maker of claim 10, wherein a length of the guide in the first direction is greater than the width of the guide.

12. The ice maker of claim 1, further comprising:

a pair of links connecting both sides of the ejector body and both sides of the second assembly, respectively, wherein the first cover comprises a first through-opening and a second through-opening through which the pair of links passes, respectively, and wherein the plurality of openings of the first cover is disposed between the first through-opening and the second through-opening.

13. The ice maker of claim 12, wherein the first cover further comprises a first groove disposed adjacent to the first through-opening, and a second groove disposed adjacent to the second through-opening, the first groove and the second groove being configured to, based on the first ejector being moved, block interference between the first cover and the first ejector, and wherein the plurality of openings of the first cover is disposed between the first groove and the second groove.

14. The ice maker of claim 13, wherein the first cover further comprises at least one rib extending in the first direction from the first cover and provided along a circumference of the first through-opening or the second through-opening.

15. A refrigerator comprising:

a cabinet defining a storage space; and an ice maker disposed in the storage space and comprising:

a first assembly comprising:

a first tray defining a plurality of first chambers recessed in a first direction, and a first cover supporting the first tray at a first side of the first tray, a second assembly that is movably coupled to the first assembly and that comprises a second tray defining a plurality of second chambers recessed in a second direction opposite to the first direction, the plurality of first chambers and the plurality of second chambers being configured to, based on the first tray and the second tray being coupled, define a plurality of ice chambers, and a first ejector configured to separate ice from the plurality of ice chambers and comprising an ejector body and a plurality of ejecting pins extending from the ejector body wherein the first ejector is configured to, based on movement of the second assembly, move in the first direction and the second direction, wherein the first cover defines a plurality of openings through which at least a portion of the first side of the first tray is exposed, and wherein the plurality of ejecting pins are configured to pass through the plurality of openings of the first cover to separate the ice from the first tray.

16. The refrigerator of claim 15, wherein the plurality of ice chambers are arranged along a third direction intersecting the first direction, the ejector body extends in the third direction, and the plurality of ejecting pins extend in the second direction.

17. The refrigerator of claim 15, wherein the first cover comprises a first supporting part that (i) is in contact with the first tray to support the first tray and (ii) defines the plurality of openings, and wherein the first supporting part is configured to be disposed between the first ejector and the first tray based on the first ejector moves maximum in the first direction.

18. The refrigerator of claim 15, wherein the first assembly further comprises (i) a second cover supporting the first tray at a second side of the first tray opposite to the first side of the first tray and (ii) a unit guide that is configured to guide the movement of the first ejector.

19. The refrigerator of claim 18, wherein the unit guide comprises a guide slot (i) extending in the first direction and the second direction and (ii) through which at least a portion of the first ejector passes.

20. The refrigerator of claim 15, further comprising:

a pair of links connecting both sides of the ejector body and both sides of the second assembly, respectively, wherein the first cover comprises a first through-opening and a second through-opening through which the pair of links passes, respectively, and wherein the plurality of openings of the first cover is disposed between the first through-opening and the second through-opening.

* * * * *